US006402666B2

(12) United States Patent
Krull

(10) Patent No.: US 6,402,666 B2
(45) Date of Patent: Jun. 11, 2002

(54) ADJUSTABLE WEIGHT EXERCISE METHODS AND APPARATUS

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 0 days.

(21) Appl. No.: 09/747,214

(22) Filed: Dec. 21, 2000

Related U.S. Application Data

(63) Continuation-in-part of application No. 09/290,144, filed on Apr. 13, 1999, now Pat. No. 6,322,481.
(60) Provisional application No. 60/171,813, filed on Dec. 21, 1999.

(51) Int. Cl.[7] ..... A63B 21/075
(52) U.S. Cl. ..... 482/107; 482/108
(58) Field of Search ..... 482/93, 106–108; D21/679–682

(56) References Cited

U.S. PATENT DOCUMENTS 6,083,144 A * 7/2000 Towley et al. ..... 482/107

* cited by examiner

*Primary Examiner*—John M. Mulcahy

(57) ABSTRACT

An exercise dumbbell includes a handle and weight plates maintained in spaced relationship relative thereto. At least one latch is movable into and out of engagement with desired weight plates to prevent movement of the engaged weight plates in a first direction, and thereby secure same relative to the handle. At least one catch is connected to the at least one latch and operable in a second, discrete direction to encourage the latch to remain engaged with the weight plates.

40 Claims, 43 Drawing Sheets

FIG. 17
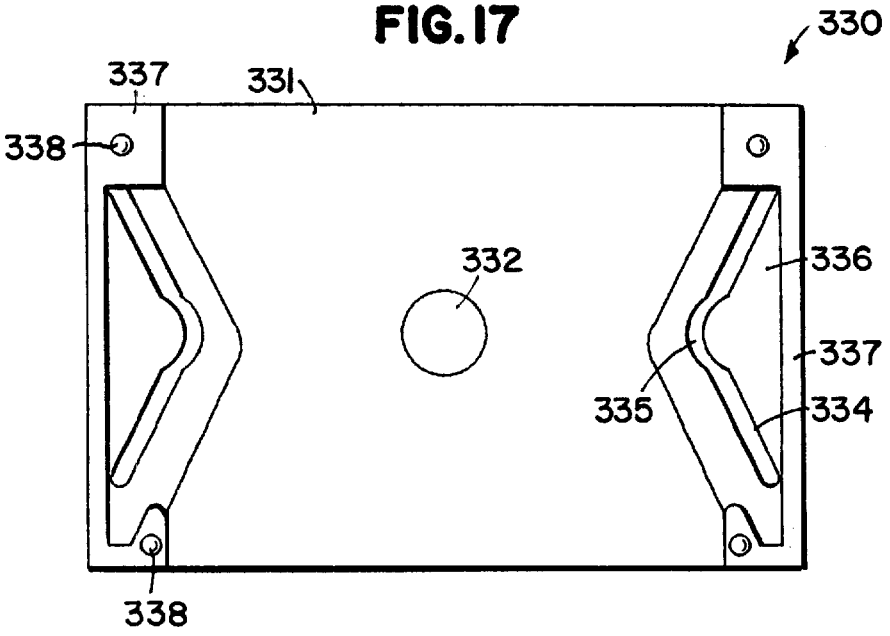
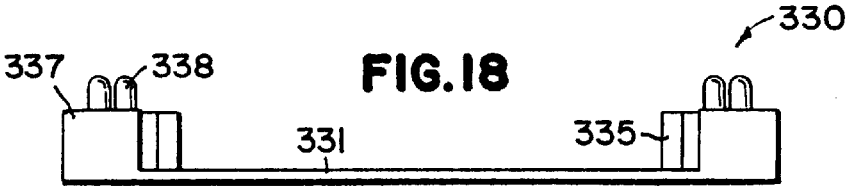
FIG. 18
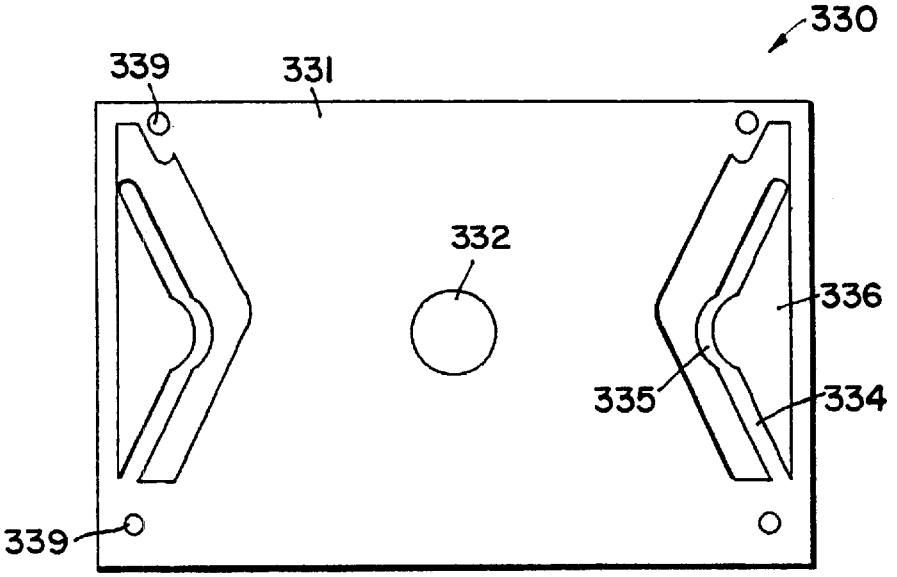
FIG. 19

Fig. 33
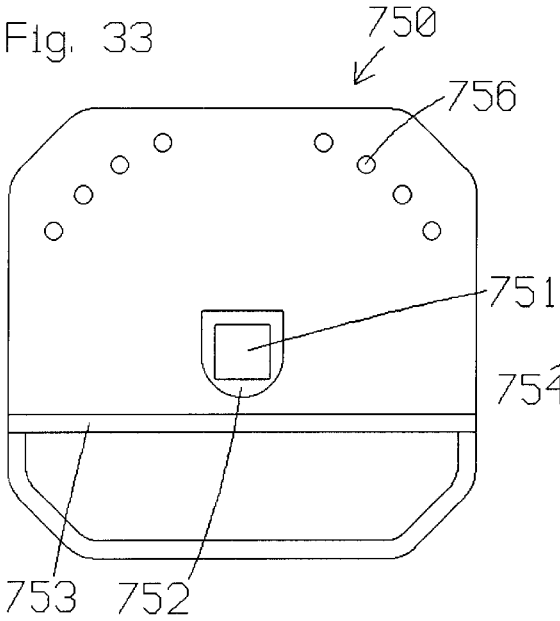
Fig. 32
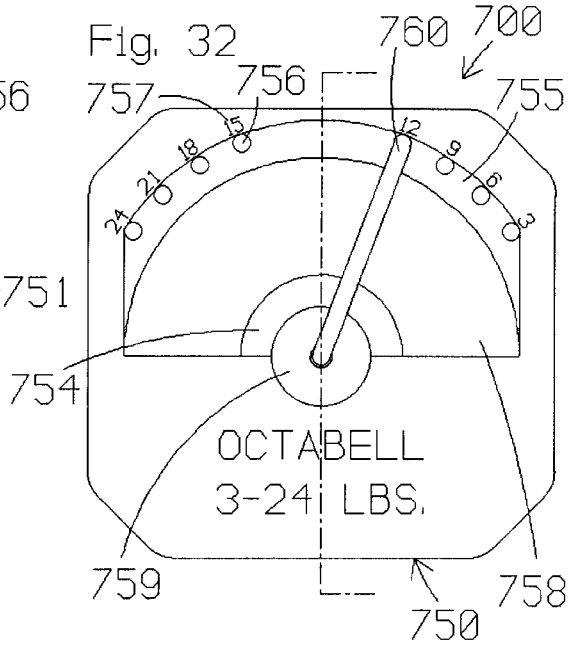
Fig. 37
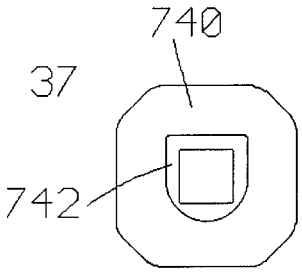
Fig. 38
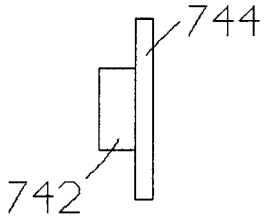
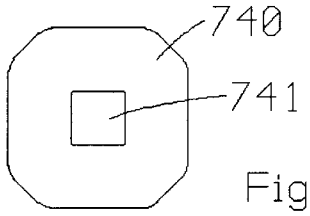
Fig. 39
Fig. 36
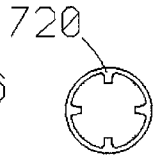
Fig. 35
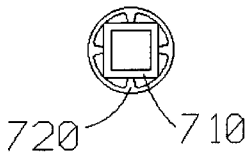
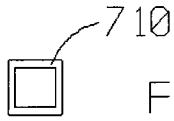
Fig. 34

Fig. 47
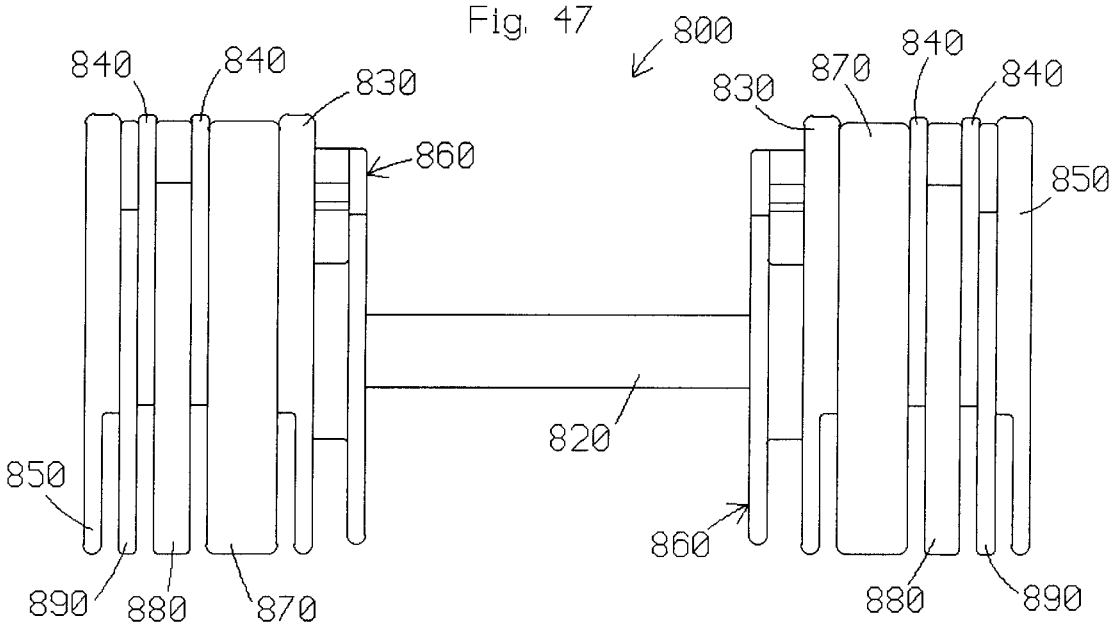
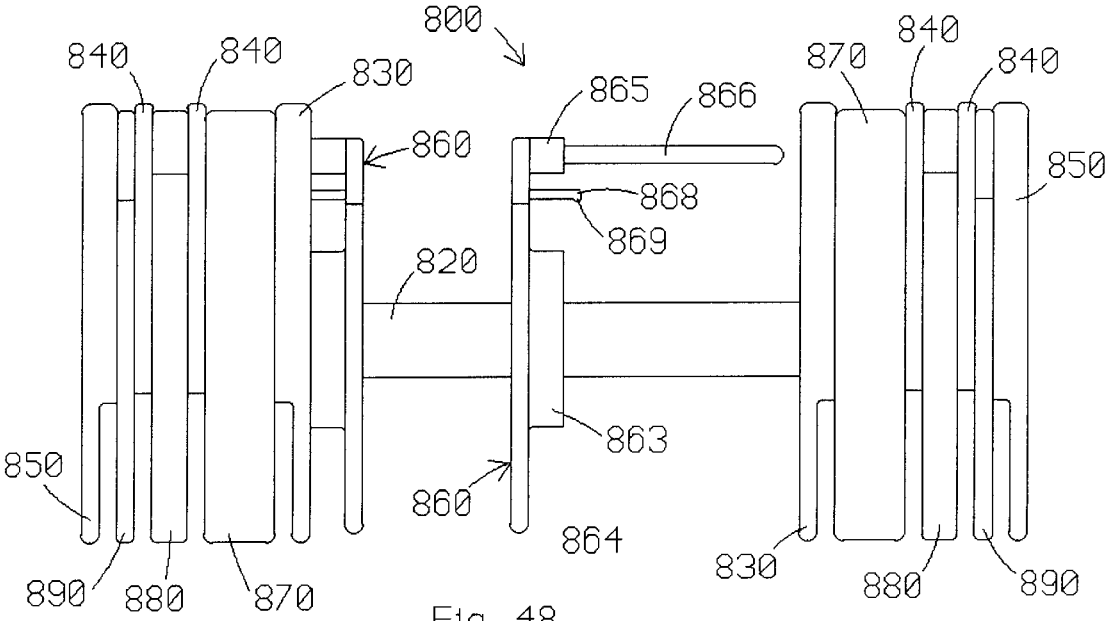
Fig. 48

Fig. 90
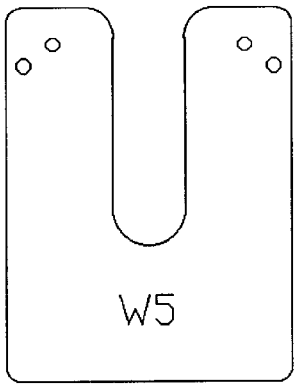
Fig. 91
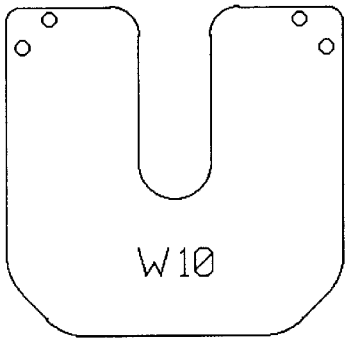
Fig. 92
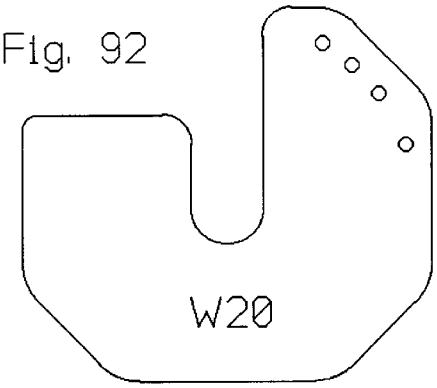
Fig. 93
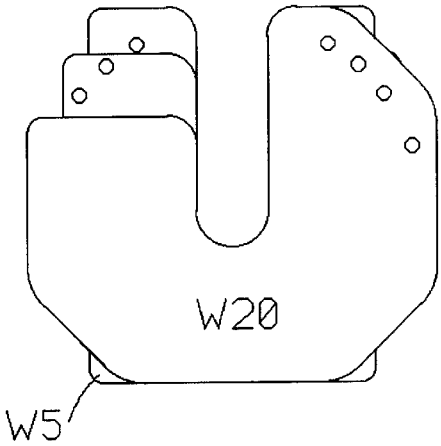
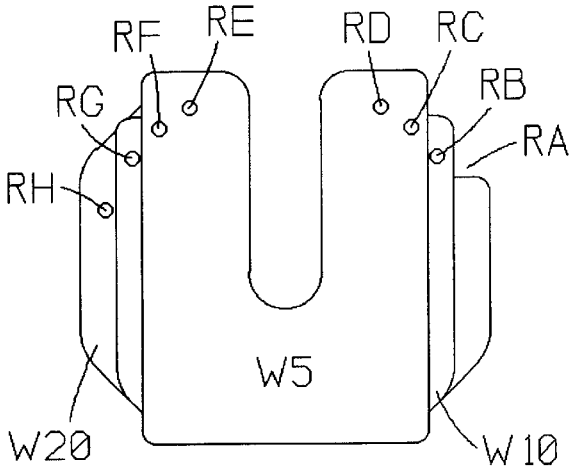
Fig. 94

Fig. 108
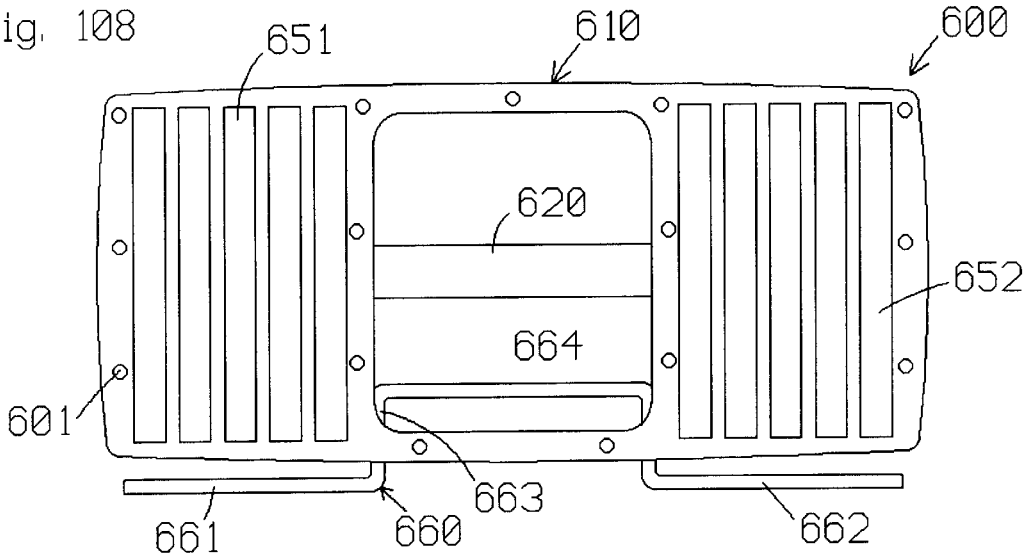
Fig. 109
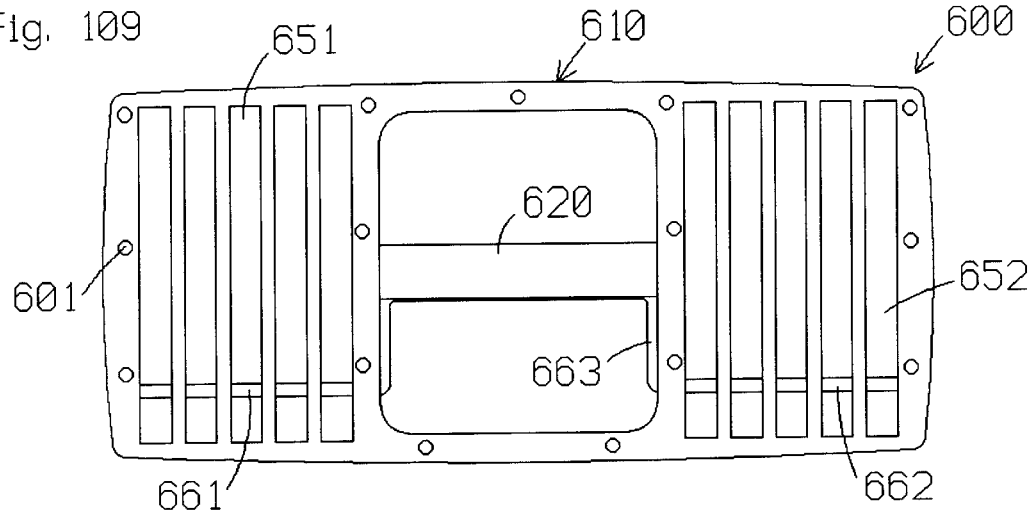
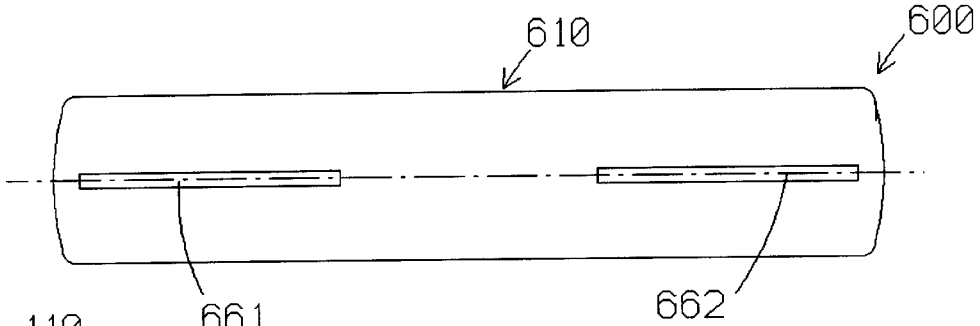
Fig. 110

2481
2410
2480
2483
2482
2400
2484
2420
2416
2414
2441
2442
2440
2443
2444
2494
2493
2490
2495
2492

2417
2410
2484
2416
2449
2448
2440
2445
2491
2490

ADJUSTABLE WEIGHT EXERCISE METHODS AND APPARATUS

CROSS-REFERENCE TO RELATED APPLICATIONS

This application is a continuation-in-part of U.S. patent application Ser. No. 09/290,144, filed on Apr. 13, 1999, now U.S. Pat. No. 6,322,481; and this application also discloses subject matter entitled to the filing date of U.S. Provisional Application Ser. No. 60/171,813, filed on Dec. 21, 1999.

FIELD OF THE INVENTION

The present invention relates to exercise equipment and more particularly, to methods and apparatus for adjusting weight resistance to exercise.

BACKGROUND OF THE INVENTION

An object of the present invention is to provide improved apparatus and/or methods for adjusting resistance to exercise.

SUMMARY OF THE INVENTION

The present invention provides methods and apparatus which facilitate exercise involving the movement of weights subject to gravitational force. Generally speaking, the present invention allows a person to adjust weight resistance by latching a desired number of weights relative to a movable member and/or securing a desired amount of weight on opposite ends of a base member. The present invention may be applied to exercise weight stacks and/or free weight assemblies such as dumbbells and barbells.

A preferred dumbbell embodiment of the present invention may be described in terms of a handle; weights disposed on opposite ends of the handle and maintained in spaced relationship relative thereto; at least one latch having an intermediate portion that nests within the handle, and opposite ends portions that are radially offset from the intermediate portion and movable into and out of engagement with the weights to prevent movement of the engaged weights relative to the handle. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 17 is an end view of one of the weight supports on the dumbbell of FIG. 14;

FIG. 18 is a bottom view of the weight support of FIG. 17;

FIG. 19 is an opposite end view of the weight support of FIG. 17;

FIG. 30 is a partially sectioned side view of a cradle suitable for use with the preferred embodiment dumbbell first shown in FIG. 31;

FIG. 32 is an end view of the dumbbell of FIG. 31;

FIG. 33 is an opposite end view of an end wall on the dumbbell of FIG. 31;

FIG. 34 is an end view of a bar on the dumbbell of FIG. 31;

FIG. 35 is an end view of a handle grip segment on the bar of FIG. 34;

FIG. 36 is an end view of the handle grip member of FIG. 35 apart from the bar of FIG. 34;

FIG. 37 is an end view of a spacer on the dumbbell of FIG. 31;

FIG. 38 is a side view of the spacer of FIG. 37;

FIG. 39 is an opposite end view of the spacer of FIG. 37;

FIG. 47 is a side view of an alternative embodiment dumbbell constructed according to the principles of the present invention;

FIG. 48 is a side view of the dumbbell of FIG. 47, with a weight selector member moved to a disengaged position;

FIG. 90 is an end view of another "first" weight plate constructed according to the principles of the present invention;

FIG. 91 is an end view of another "second" weight plate constructed according to the principles of the present invention;

FIG. 92 is an end view of another "third" weight plate constructed according to the principles of the present invention;

FIG. 93 is an end view of the plates of FIGS. 90–92 aligned with one another;

FIG. 94 is an opposite end view of the aligned plates of FIG. 93;

FIG. 108 is a top view of yet another dumbbell constructed according to the principles of the present invention;

FIG. 109 is a top view of the dumbbell of FIG. 108 in a second configuration;

FIG. 110 is a front view of the dumbbell of FIG. 108;

FIG. 119 is a top view of another dumbbell constructed according to the principles of the present invention;

FIG. 120 is a side view of the dumbbell of FIG. 119; and

FIG. 121 is a top view of the dumbbell of FIG. 119 in a second configuration.

DESCRIPTION OF A PREFERRED EMBODIMENT

The present invention is described primarily with reference to exercise dumbbells. However, those skilled in the art will recognize that one or more features and/or combination of features which are disclosed herein with reference to dumbbells may also be applied to other exercise equipment, including weight stack machines, for example. Some examples of cross-over applications are disclosed in U.S. Pat. No. 6,033,350 to Krull, and pending U.S. patent application Ser. No. 09/300,546 (filed by Krull on Apr. 27, 1999), both of which are incorporated herein by reference. Also incorporated herein by reference are U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley, III et al.; U.S. Pat. No. 5,839,997 to Roth et al.; and U.S. Pat. No. 6,099,442 to Krull, one or more of which may contribute to understanding of the present invention.

Figure 31:
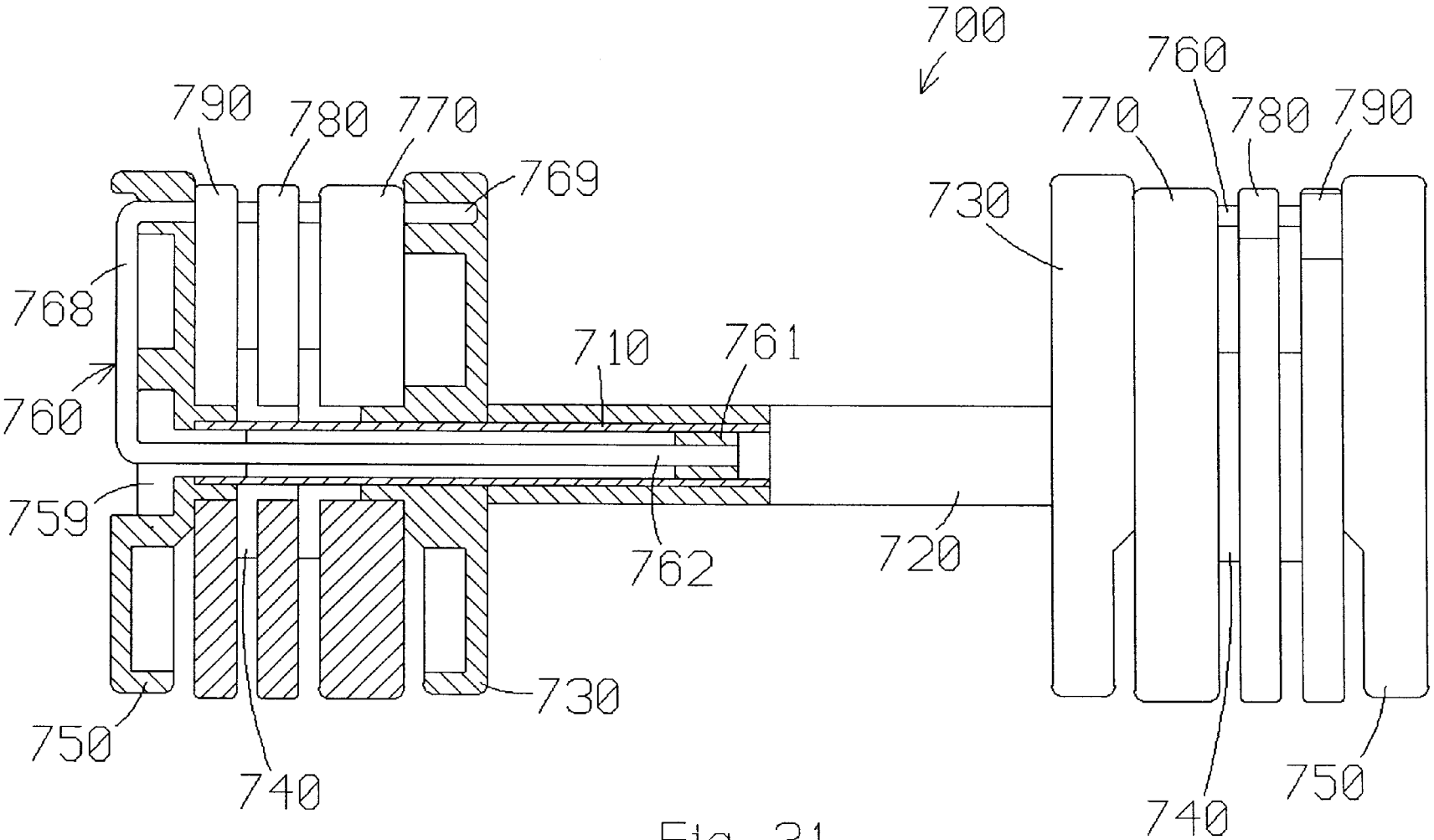
FIG. 31 is a partially sectioned side view of a preferred embodiment dumbbell constructed according to the principles of the present invention.

A first dumbbell constructed according to the principles of the present invention is designated as 700 in FIGS. 31–32. As shown in FIGS. 31 and 34, the dumbbell 700 includes a bar 710 which is preferably a square tube and made of steel. As shown in FIGS. 31 and 36, the dumbbell 700 also includes a handle grip member 720 which is preferably a cylindrical tube and made of plastic. As shown in FIG. 35, the bar 710 and the handle grip member 720 are sized and configured so that the former fits snugly inside the latter, and the parts are secured against rotation relative to one another.

Interior supports or plates 730 are mounted on the bar 710 outside each end of the handle grip member 720. Each support 730 provides a smooth inwardly facing surface which abuts an end of the handle grip member 720, and an irregular outwardly facing surface which is discussed in greater detail below.

Two spacers 740 are mounted on each end of the bar 710, outward from a respective interior support 730. As shown in FIGS. 37–39, each spacer 740 includes an axially extending offset 742 and a radially extending plate 744. A hole 741, sized and configured to receive the bar 710, extends through both portions of the spacer 740. Each spacer 740 is oriented so the offset 742 extends inward, toward the handle grip member 720.

Exterior supports or plates 750 are mounted on opposite ends of the bar 710, outside respective spacers 740. As shown in FIG. 33, most of the inwardly facing side of each support 750 is smooth. However, an axially extending offset 752 extends inward from each support 750 and abuts the plate portion 744 of a respective spacer 740. Also, for reasons discussed below, a lower portion of the inwardly facing side is recessed, and a beveled or ramped surface 753 is provided between the upper and lower portions. As shown in FIG. 32, the lower half of the outwardly facing side of each support 750 is smooth (and well suited for bearing information about the product 700 and/or its manufacturer). The upper half of the outwardly facing side includes recessed surfaces 754 and 755, which are separated by a more deeply recessed surface 758.

Circumferentially spaced holes 756 are formed through each support 750 proximate the outermost edge of the recessed surface 755. A visual indicator is provided proximate each of the holes 756 for reasons discussed below. Both a hole and a depression are provided in the center of each support 750 to accommodate an end fastener 759. A shaft on the fastener 759 is anchored inside a respective end of the bar 710, and a head on the fastener 759 overlies a portion of a respective support 750.

Selector rods 760 have first ends 762 which are inserted through respective fasteners 759 and into respective ends of the bar 710. The rods 760 are selectively movable in both rotational and axial fashion relative to the bar 710. Cylindrical bushings 761 are connected to the ends 762 of respective rods 760 and bear against the inside walls of the bar 710. From a manufacturing perspective, the selector rods 760 are inserted through respective fasteners 759 and connected to respective bushings 761 before the fasteners 759 are secured to the bar 710.

An intermediate portion 768 of each selector rod 760 extends perpendicular to the first end 762 thereof (radially relative to the longitudinal axis of the bar 710). The intermediate portion 768 spans the surfaces 754, 758 and 755 on the outwardly facing side of a respective exterior support 750. Each support 750 is configured so that a respective intermediate portion 768 may rest outward from the surfaces 754 and 755 but inside an outermost surface defined by the support 750. Also, the recessed surface 758 allows a person to maneuver one or more fingers behind the intermediate portion (or handle portion) 768 in order to pull the selector rod 760 axially outward.

A second end 769 of each selector rod extends parallel to a respective first end 762 (and parallel to the longitudinal axis of the bar 710). The second end 769 aligns with any of the holes 756 in the exterior support 750 and has a beveled tip to facilitate insertion therein. Aligned openings are provided in each of the interior supports 730 to similarly receive the second ends 769 of a respective selector rod 760. Since the second end 769 is relatively shorter than the first end 762, the former may be pulled from the exterior support 750 and reoriented relative to same, while a portion of the latter remains inside the tube 710. As a result, the second end 769 may be inserted into any of the holes 756 at the discretion of the user.

The selector rods 760 may be biased relative to the tube 710 and/or one another, to remain in axially inward positions relative to the tube 710 and/or to resist axially outward movement. Some examples of suitable biasing arrangements are shown in FIGS. 79–89 and described below.

Figure 79:
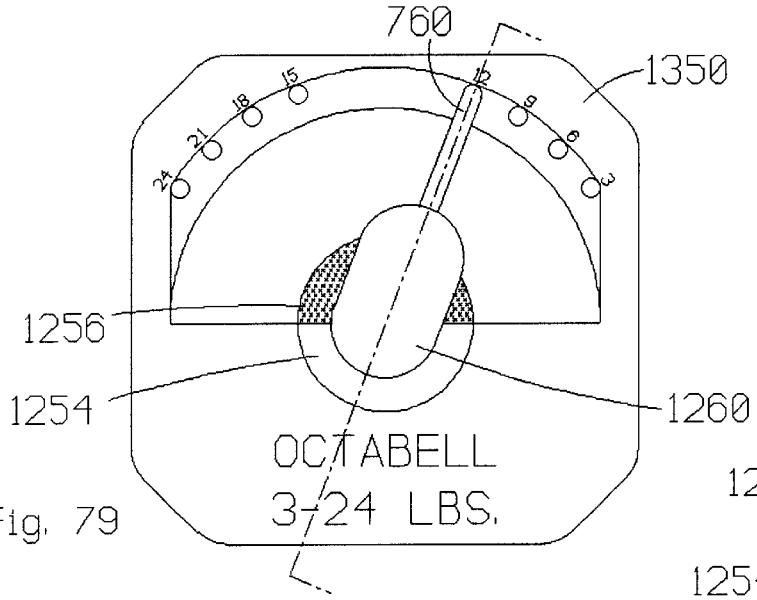
FIG. 79 is an end view of a biasing arrangement suitable for use in accordance with the present invention.
Figure 80:
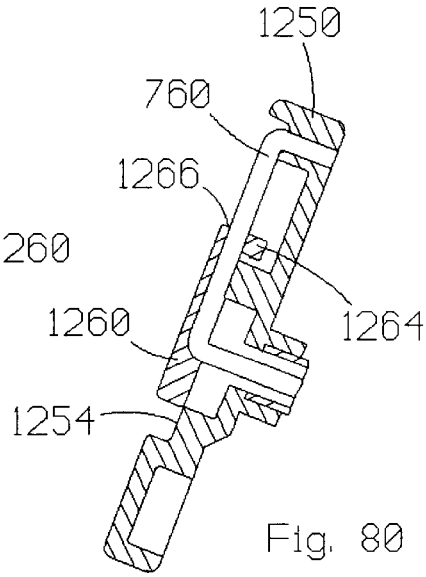
FIG. 80 is a sectioned side view of the biasing arrangement of FIG. 79.

FIGS. 79–80 show an end plate or support 1250 which is similar to the support 750 on the preferred embodiment 700. However, a relatively larger recessed surface 1254 is provided on the support 1250, and loop type fasteners 1256 are mounted on at least a portion of the surface 1254. Also, a cover 1260 is mounted on the selector rod 760 and overlies at least a portion of the surface 1254. An opening 1266 is provided in a flange 1264 on the cover 1260 in order to receive and/or retain the selector rod 760. On this particular arrangement, hook type fasteners are mounted on the cover 1260 to mate with the loop type fasteners 1256 on the support 1250. The hook and loop type fasteners cooperate to discourage movement of the selector rod 760 axially away from the support 1250. The hook and loop type fasteners may be replaced by other suitable connecting means.

Figure 81:
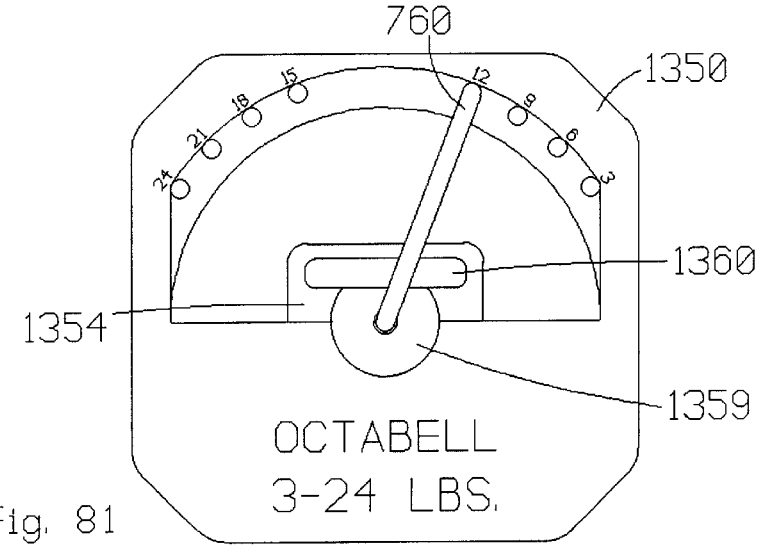
FIG. 81 is an end view of another biasing arrangement suitable for use in accordance with the present invention.

FIG. 81 shows an end plate or support 1350 which is similar to the support 750 on the preferred embodiment 700. However, a different recessed surface 1354 on the support 1350 cooperates with a distinct end fastener 1359 to accommodate a magnet 1360. The magnet 1360 is sized and situated to span the selector rod 760 regardless of the latter's orientation relative to the support 1350. The magnet 1360 cooperates with the steel selector rod 760 to discourage movement of the latter axially away from the support 1350.

Figure 82:
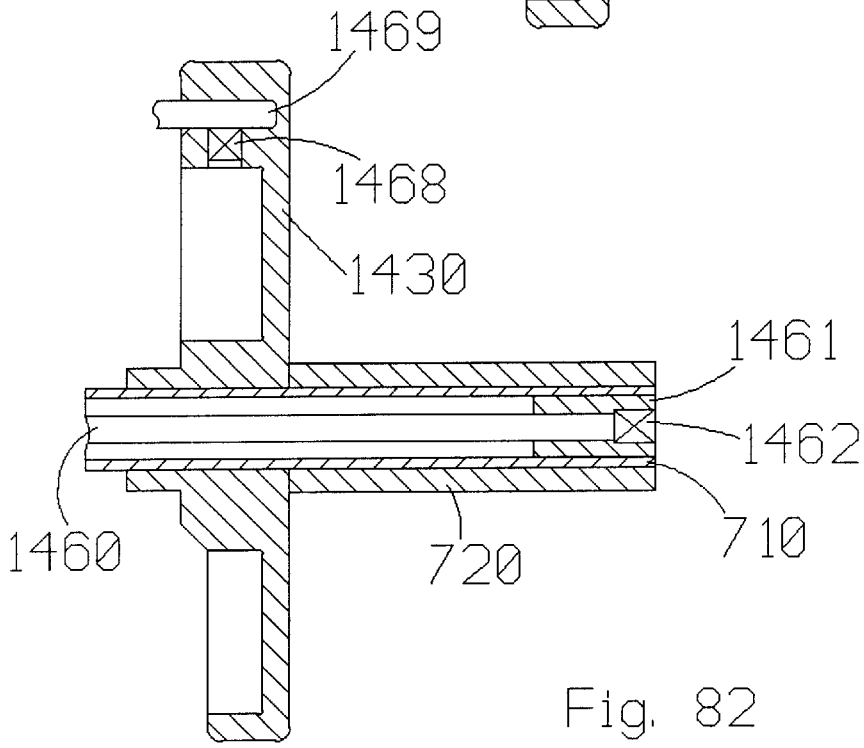
FIG. 82 is a sectioned side view of additional biasing arrangements suitable for use in accordance with the present invention.

FIG. 82 shows two additional biasing arrangements with reference to an inside plate or support 1430 which is similar to the support 730 on the preferred embodiment 700. For one of the biasing arrangements, an arcuate cavity is provided in the support 1430 to receive and/or retain an arcuate strip of magnetic material 1468. The magnet 1468 cooperates with the distal end 1469 of the steel selector rod 1460 to discourage movement of the latter axially away from the middle of the handle 720. For the other biasing arrangement, a bushing 1461 is secured to the opposite end of the selector rod 1460, and a magnet 1462 is mounted on the bushing 1461. The lengths of the opposite end selector rods are such that the magnet 1462 on the depicted rod 1460 engages either a similar magnet or a steel plate on the other selector rod when both occupy their respective fully engaged positions. The magnetic attraction between the abutting ends of the selector rods discourages movement of either rod axially away from the middle of the handle 720 and/or the other rod. The magnets on the abutting ends of the selector rods may be replaced by other suitable connecting means, such as hook and loop fasteners, for example. Those skilled in the art will also recognize that the two arrangements shown in FIG. 82 may be used in combination or in the alternative.

Figure 83:
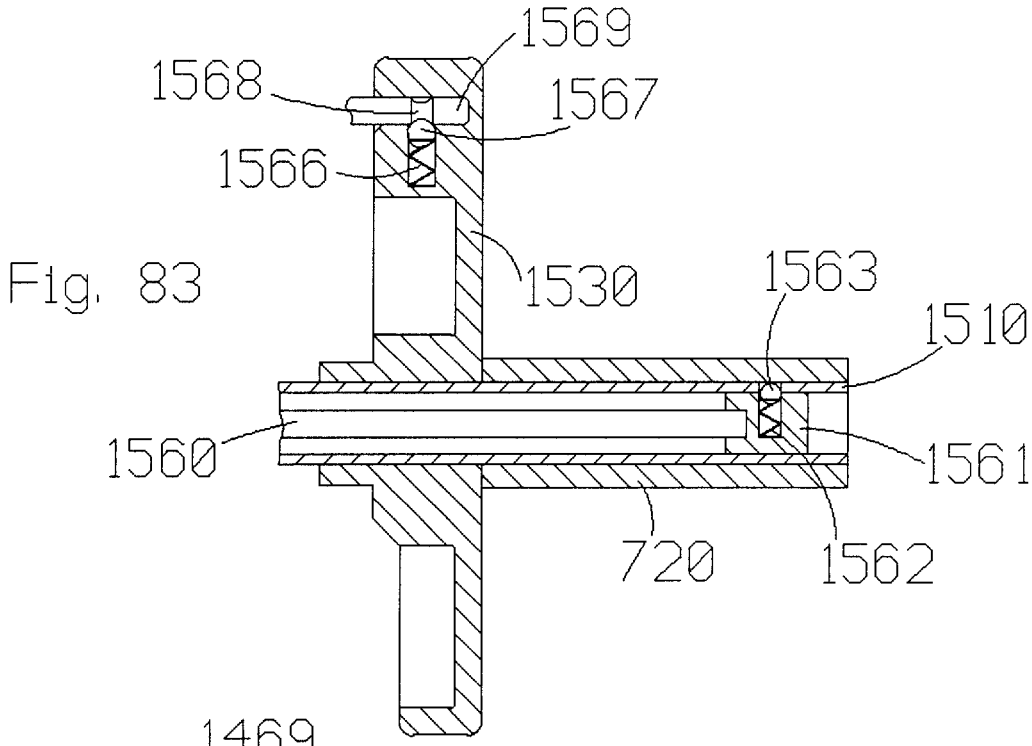
FIG. 83 is a sectioned side view of more biasing arrangements suitable for use in accordance with the present invention.

FIG. 83 shows two additional biasing arrangements which also may be used in combination or in the alternative. The arrangements are shown with reference to an inside plate or support 1530 which is similar to the support 730 on the preferred embodiment 700. However, for one of the biasing arrangements, an arcuate cavity is provided in the support 1530 to receive an arcuate rod 1567 having a circular cross-section. Relatively deeper cavities are provided in the support 1530, at spaced locations, to receive respective coil springs 1566. The springs 1566 bias the rod 1567 toward the top of the support 1530 and into an annular groove 1568 provided in the end 1569 of the selector rod 1560. The rod 1567 cooperates with the groove 1568. in the rod 1560 to discourage movement of the latter axially away from the middle of the handle 720.

For the other biasing arrangement, a bushing 1561 is secured to the opposite end of the selector rod 1460, and a cavity is provided in the bushing 1561 to receive both a coil spring 1562 and a ball 1563. The spring 1562 biases the ball 1563 toward the top of the support 1530 and into a hole provided in the tube 1510. The ball 1563 cooperates with the hole in the tube 1510 to discourage movement of the rod 1560 axially away from the middle of the handle 720.

Figure 85:
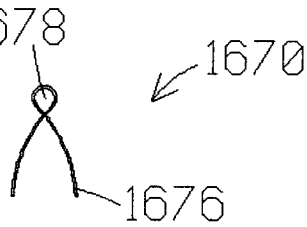
FIG. 85 is a front view of a clip suitable for use in conjunction with a selector rod shown in FIG. 84
Figure 84:
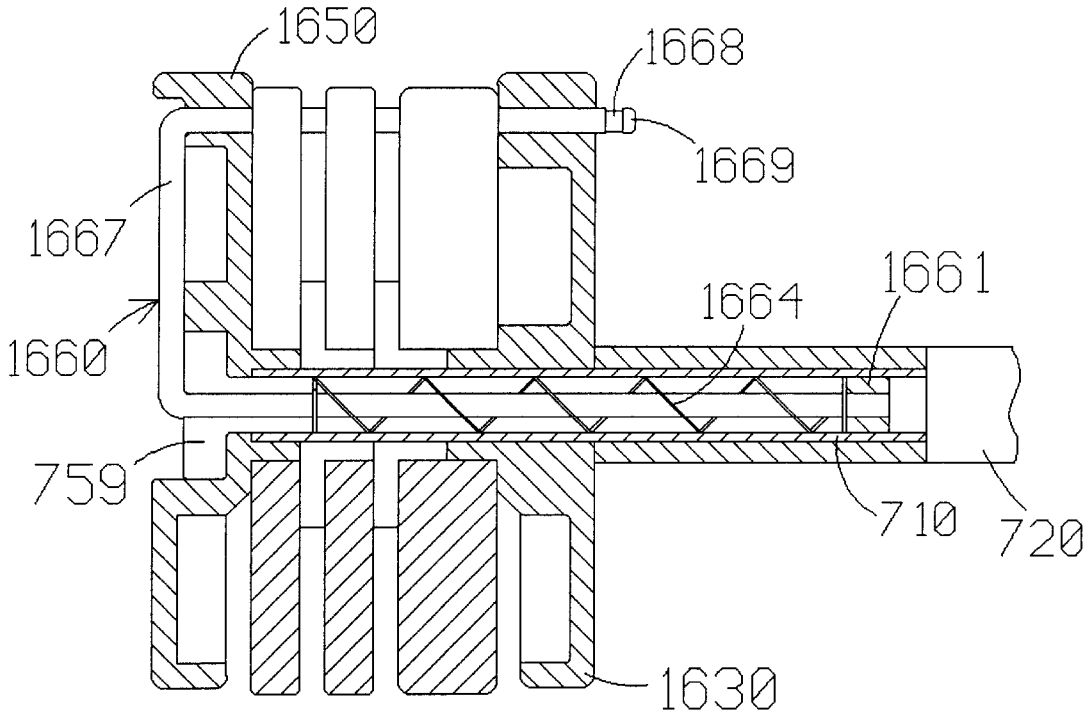
FIG. 84 is a sectioned side view of still more biasing arrangement suitable for use in accordance with the present invention.

FIGS. 84–85 shows two additional biasing arrangements suitable for use in accordance with the present invention. Among other things, FIG. 84 shows a selector rod 1660 extending through the end fastener 759 and having a first end anchored to a bushing 1661. The end fastener 759 is rigidly secured to the tube 710, and the bushing 1661 is slidably and rotatably mounted inside the tube 710. A coil spring 1664 is compressed between the bushing 1661 and the end fastener 759. The compression of the spring 1664 between the bushing 1661 and the end fastener 759 both discourages and resists movement of the selector rod 1660 axially away from the middle of the handle 720.

FIG. 84 also shows an interior plate or support 1630 having through holes aligned with the opposite end 1669 of the selector rod 1660. An annular groove 1668 is provided in the protruding end 1669 of the selector rod 1660 to facilitate mounting of a spring clip 1670 thereon. As shown in FIG. 85, the spring clip 1670 includes a circular intermediate portion 1678 sized and configured to occupy the groove 1668 in the absence of externally applied force. The spring clip 1670 also includes opposite end portions 1676 which may be squeezed together to enlarge the inside diameter of the intermediate portion 1678 to facilitate attachment and removal of the spring clip 1670 relative to the end 1669 of the selector rod 1660. When properly secured to the selector rod 1660, the spring clip 1670 discourages movement of the selector rod 1660 axially away from the middle of the handle 720.

Figure 87:
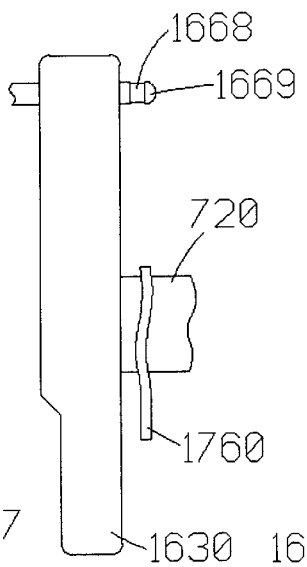
FIG. 87 is a side view of the biasing arrangement of FIG. 86.
Figure 86:
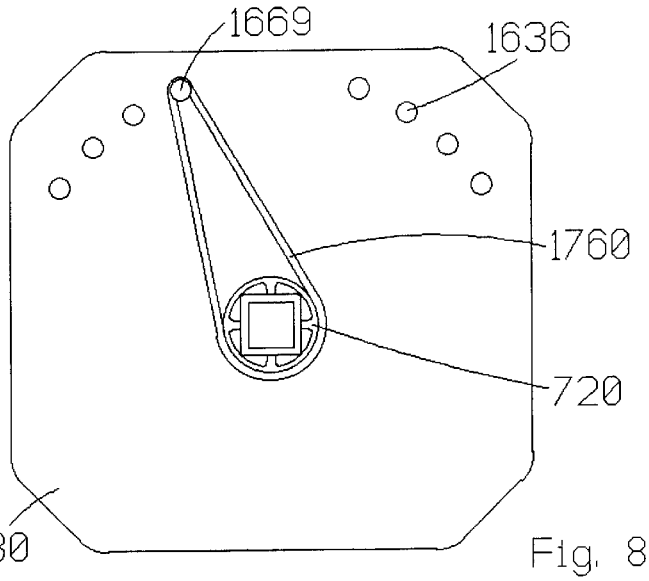
FIG. 86 is an end view of yet another biasing arrangement suitable for use in accordance with the present invention.

FIGS. 86–87 show yet another biasing arrangement suitable for use in accordance with the present invention. The arrangement is described with reference to the same handle 720, interior support 1630, and selector rod 1660 as those described above with reference to FIG. 84. The annular groove 1668 is exposed upon insertion of the end 1669 of the selector rod 1660 through any of the holes 1636 in the support 1630. An elastic band 1760 is disposed loosely about the handle 720 and may be stretched to also encompass the end 1669 of the selector rod 1660. The band 1760 is sized and configured to occupy the groove 1668 in the selector rod 1660, and the tension and presence of the band 1760 discourage movement of the selector rod 1660 axially away from the middle of the handle 720.

Figure 89:
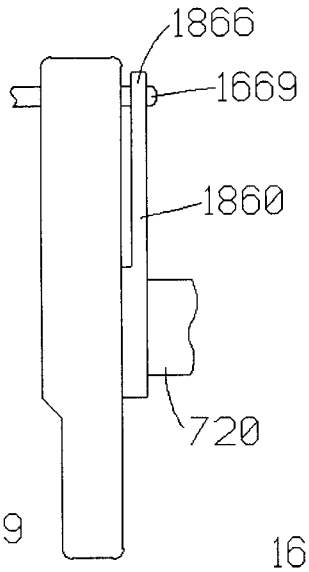
FIG. 89 is a side view of the biasing arrangement of FIG. 88.
Figure 88:
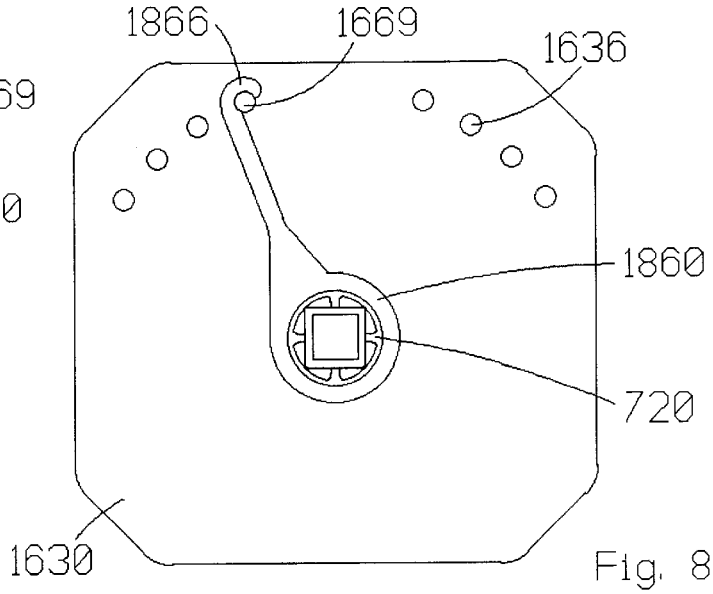
FIG. 88 is an end view of yet another biasing arrangement suitable for use in accordance with the present invention.

FIGS. 88–89 show still another biasing arrangement suitable for use in accordance with the present invention. The arrangement is also described with reference to the same handle 720, interior support 1630, and selector rod 1660 as those described above with reference to FIG. 84. A resilient hook member 1860 is rotatably mounted on the handle 720 and has a distal end 1866 which may snapped into engagement with the end 1669 of the selector rod 1660. The distal end 1866 is sized and configured to occupy the groove 1668 in the selector rod 1660 and thereby discourage movement of the selector rod 1660 axially away from the middle of the handle 720.

When free to move axially, the selector rods are rotatable into alignment with different amounts and/or combinations of weights. For example, the preferred embodiment dumbbell 700 includes three pairs of weight plates 770, 780, and 790, which weigh six pounds, three pounds, and one and one-half pounds, respectively. The plates 770, 780, and 790 are selectively secured, in any combination, to respective supports 730 and 750 by means of respective selector rods 760.

Figure 30:
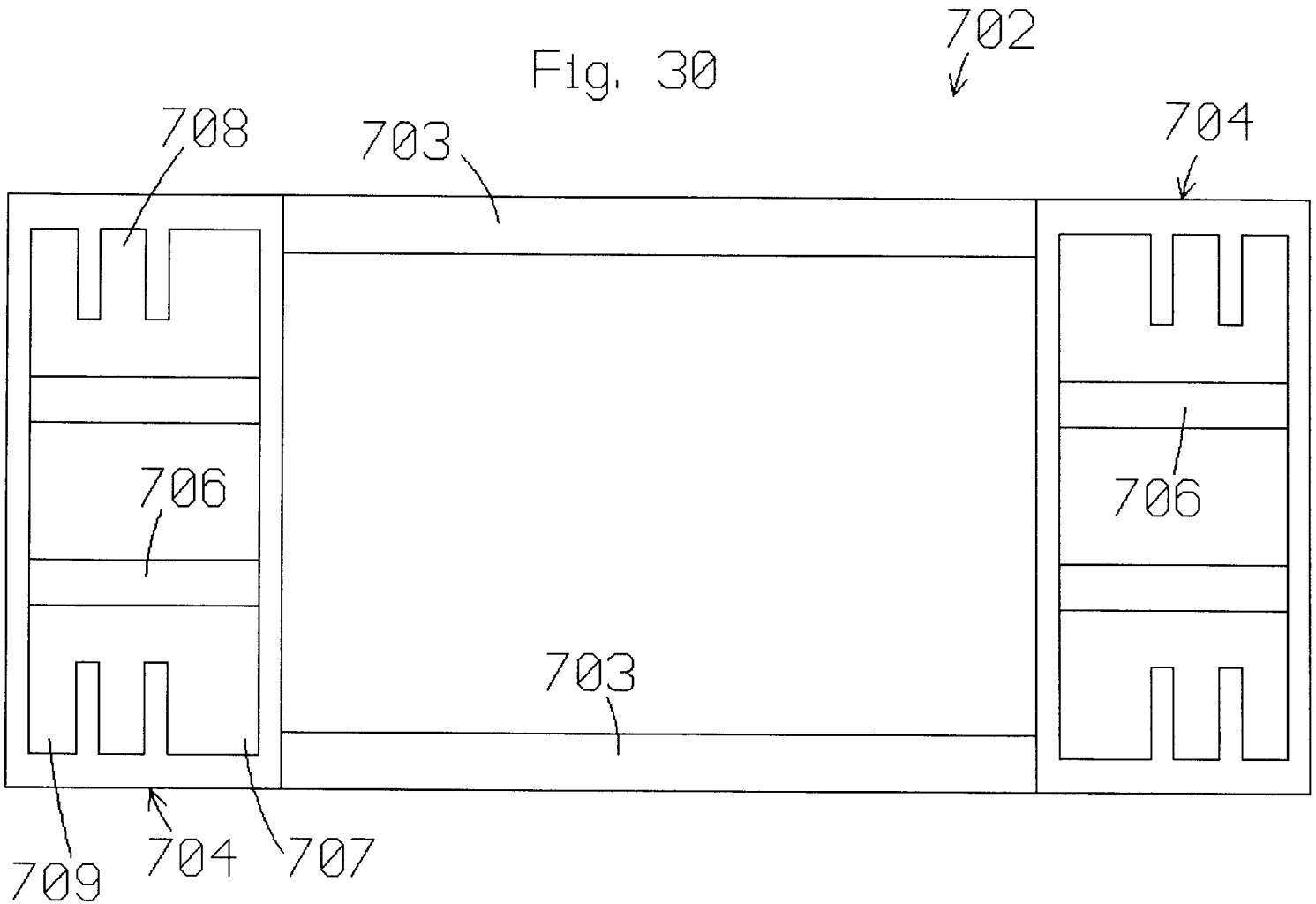
FIG. 30 is a top view of a cradle suitable for use with the preferred embodiment dumbbell first shown in FIG. 31.
Figure 45:
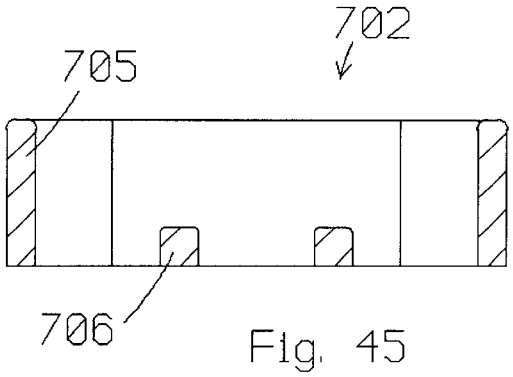
FIG. 45 is a sectioned end view of the cradle of FIG. 30.
Figure 46:
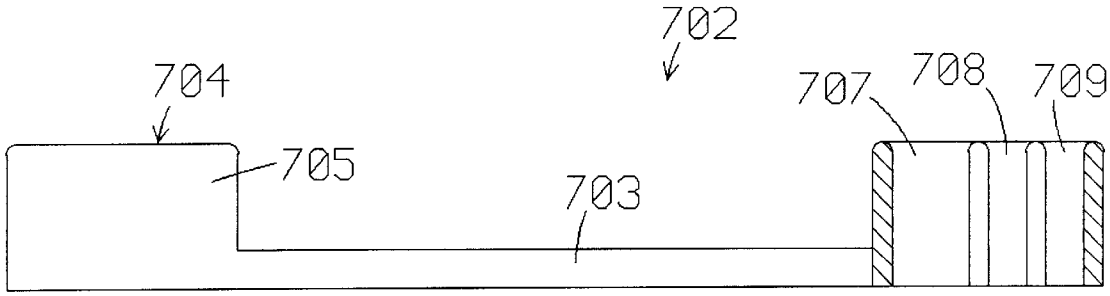
FIG. 46 is a partially sectioned side view of the cradle of FIG. 30.

When not in use, the dumbbell 700 rests on base or cradle having walls sized and configured to receive and retain the weights 770, 780, and 790. For example, a suitable cradle 702 is shown in FIGS. 30 and 45–46. The cradle 702 includes intermediate members 703 and opposite end members 704. The intermediate members 703 maintain the end members 704 an appropriate distance apart from one another. Each end member 704 is bounded by side walls 705 and at least one bottom member 706. Spacers extend inward from opposing side walls 705 of the cradle 702 and are sized and configured to align with the supports 730 and 750 and the spacers 740 on the dumbbell 700. In other words, the spacers on the cradle 702 define slots 707, 708, and 709 which are sized and configured to receive the weights 770, 780, and 790, respectively. Some of the possible cradle arrangements and/or features are disclosed in the patents already incorporated herein by-reference.

Figure 40:
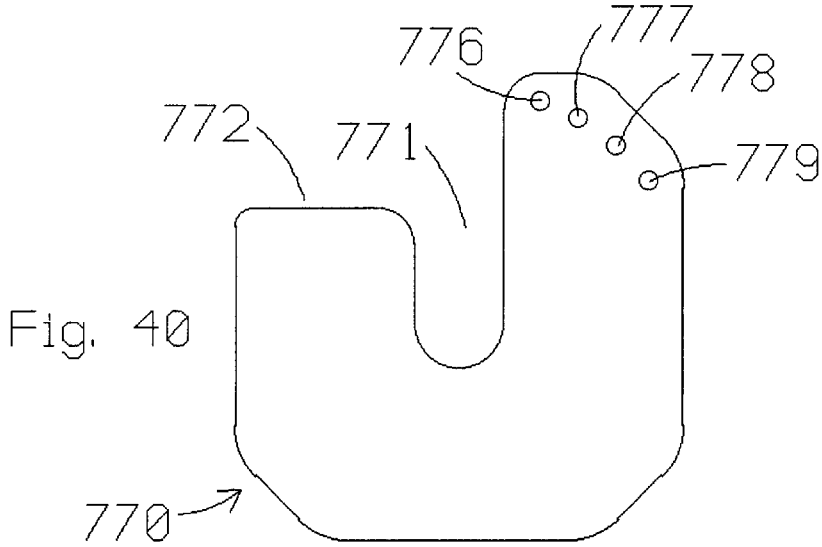
FIG. 40 is an end view of a first weight plate on the dumbbell of FIG. 31.

FIG. 40 shows one of the six pound plates 770, as viewed by a person looking from the handle grip member 720 outward toward the exterior support 750 shown in FIG. 32. Each plate 770 is provided with an upwardly opening slot 771 sized and configured to receive both the axial offset 742 on a respective spacer 740 and an axial offset on a respective interior support 730. From a manufacturing perspective, this arrangement with the interior supports 730 is desirable because all of the intermediate spacers 740 may be made identical. On one side of the plate 770, a notch 772 provides clearance for the selector rod 760 when it is inserted into the "3" hole shown in FIG. 32 (as well as any of the "6", "9", or "12" holes). On an opposite side of the plate 770, holes 776–779 are provided to receive the selector rod 760 when it is inserted into any of the "15", "18", "21", or "24" holes, respectively.

Figure 41:
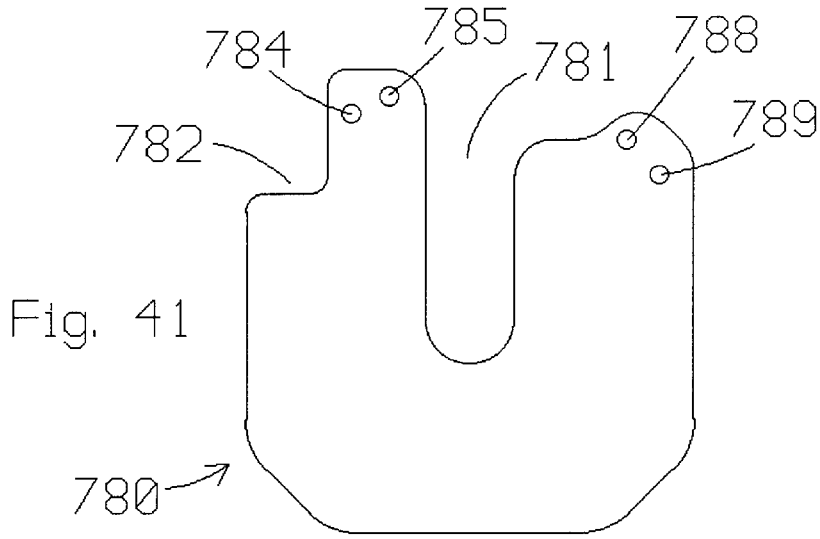
FIG. 41 is an end view of a second weight plate on the dumbbell of FIG. 31.

FIG. 41 shows one of the three pound plates 780, as viewed by a person looking from the handle grip member 720 outward toward the exterior support 750 shown in FIG. 32. Each plate 780 is provided with an upwardly opening slot 781 sized and configured to receive the axial offset 742 on a respective spacer 740. On one side of the plate 780, a notch 782 provides clearance for the selector rod 760 when it is inserted into the 11311 hole shown in FIG. 32 (as well as the "6" hole). Holes 784 and 785 are provided on this same side of the plate 780 to receive the selector rod 760 when it is inserted into either of the "19" or "12" holes, respectively. On an opposite side of the plate 780, holes 788 and 789 are provided to receive the selector rod 760 when it is inserted into either of the "21" or "24" holes, respectively. The plates 780 and 770 are sized and configured so that the holes 788 and 789 align with the holes 778 and 779, respectively.

Figure 42:
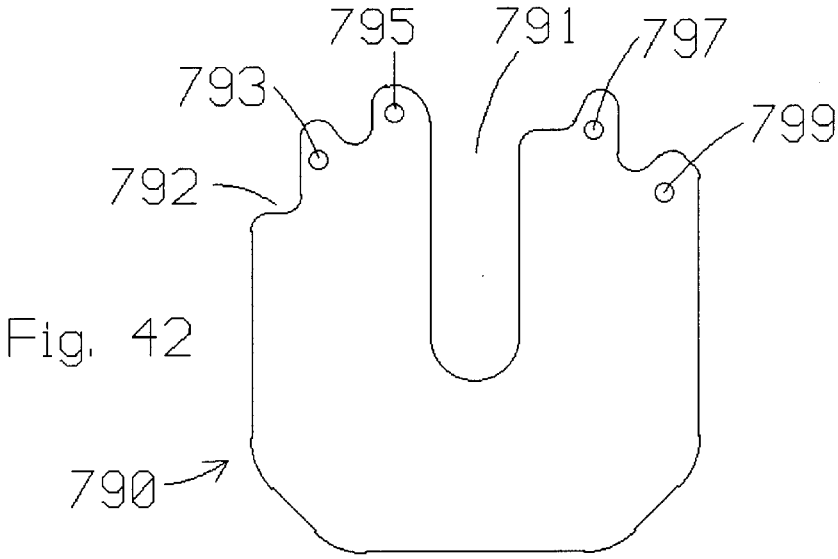
FIG. 42 is an end view of a third weight plate on the dumbbell of FIG. 31.

FIG. 42 shows one of the one and one-half pound plates 790, as viewed by a person looking from the handle grip member 720 outward toward the exterior support 750 shown in FIG. 32. Each plate 790 is provided with an upwardly opening slot 791 sized and configured to receive the axial offset 752 on a respective exterior support 750. The plates 790 are shown with the same thickness as the plates 780 to emphasize that some or all of the plates 770, 780, and 790 can be of similar thickness if they have different densities. On one side of the plate 790, a notch 792 provides clearance for the selector rod 760 when it is inserted into the "3" hole shown in FIG. 32. Holes 793 and 795 are provided on this same side of the plate 790 to receive the selector rod 760 when it is inserted into either of the "6" or "12" holes, respectively. On an opposite side of the plate 790, holes 797 and 799 are provided to receive the selector rod 760 when it is inserted into either of the "18" or "24" holes, respectively. The plates 790 and 780 are sized and configured so that the holes 795 and 799 align with the holes 785 and 789, respectively. Also, the plates 790 and 770 are sized and configured to that the holes 797 and 799 align with the holes 777 and 779, respectively.

Figure 43:
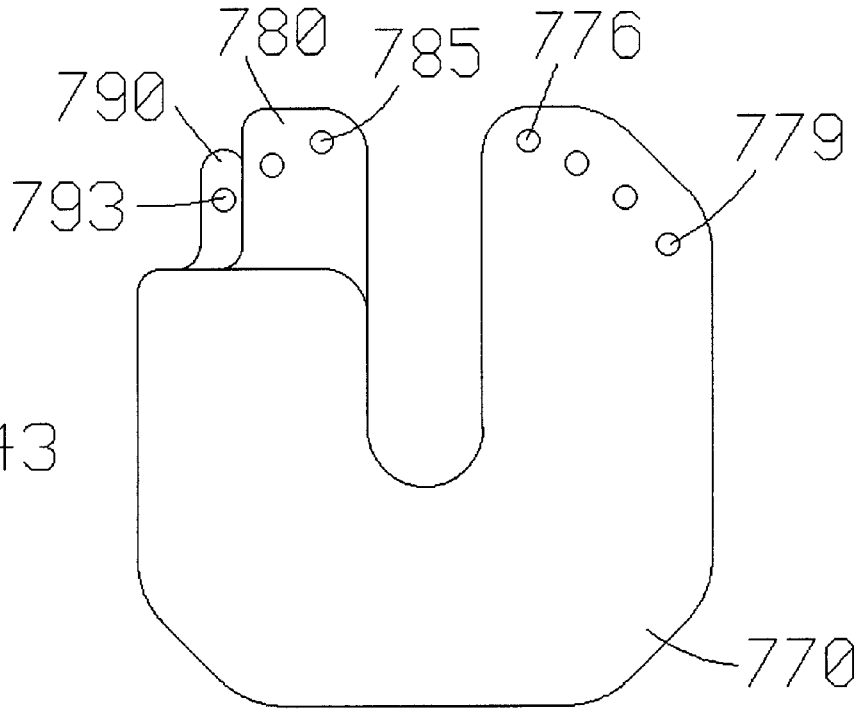
FIG. 43 is an end view of the weight plates of FIGS. 40–42 aligned with one another.
Figure 44:
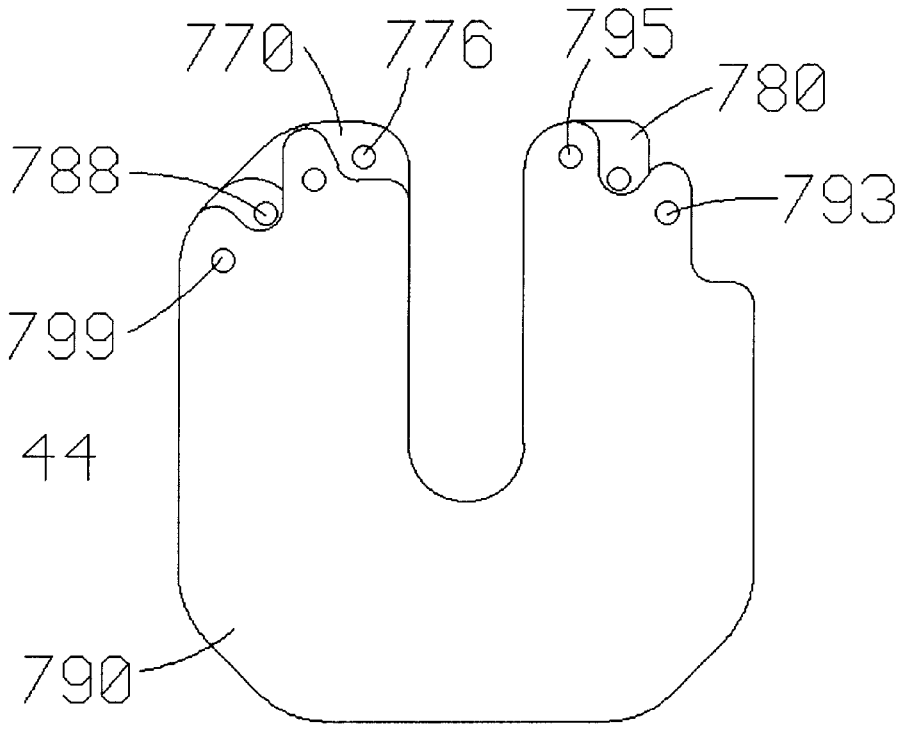
FIG. 44 is an opposite end view of the weight plates of FIG. 43.

FIGS. 43–44 show the three plates 770, 780, and 790 axially aligned relative to one another, with FIG. 44 being viewed from the same perspective as FIG. 32. Assuming that the unloaded handle assembly (the dumbbell 700 without any of the weights 770, 780, or 790) weighs three pounds, the weights 770, 780, and 790 may be added to the handle assembly in various combinations to provide each of the weights set forth below:

| Rod | Handle | Weights 770 | Weights 780 | Weights 790 | Total |
|---|---|---|---|---|---|
| "3" | 3 | 0 | 0 | 0 | 3 |
| "6" | 3 | 3 | 0 | 0 | 6 |
| "9" | 3 | 0 | 6 | 0 | 9 |
| "12" | 3 | 3 | 6 | 0 | 12 |
| "15" | 3 | 0 | 0 | 12 | 15 |
| "18" | 3 | 3 | 0 | 12 | 18 |

-continued

| Rod | Handle | Weights 770 | Weights 780 | Weights 790 | Total |
|---|---|---|---|---|---|
| "21" | 3 | 0 | 6 | 12 | 21 |
| "24" | 3 | 3 | 6 | 12 | 24 |

An advantage of this embodiment 700 is that only three discrete weights are required on each side of the dumbbell to provide eight different dumbbell loads.

FIGS. 90–94 show three alternative weight plates W5, W10, and W20, which also may be connected in any combination to a similar handle member to provide eight different amounts of weight resistance. As compared to the weight plates 790, 780, and 770, the weight plates W5, W10, and W20 are somewhat simpler in shape (and larger in mass), but they do not provide a sequentially increasing amount of weight as a function of selector rod orientation. In this regard, as the selector rod is sequentially moved clockwise to each of the positions RA–RH, the selected mass changes from zero pounds to ten pounds to fifteen pounds to five pounds to twenty-five pounds to thirty-five pounds to thirty pounds to twenty pounds, respectively.

Figure 96:
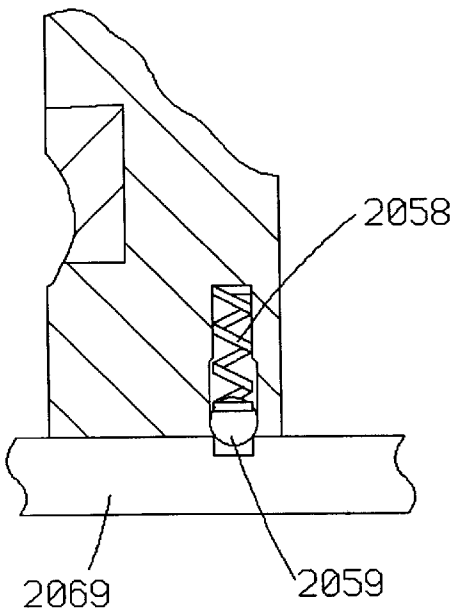
FIG. 96 is an enlarged, fragmentary and sectioned side view of a portion of the dumbbell of FIG. 95.
Figure 95:
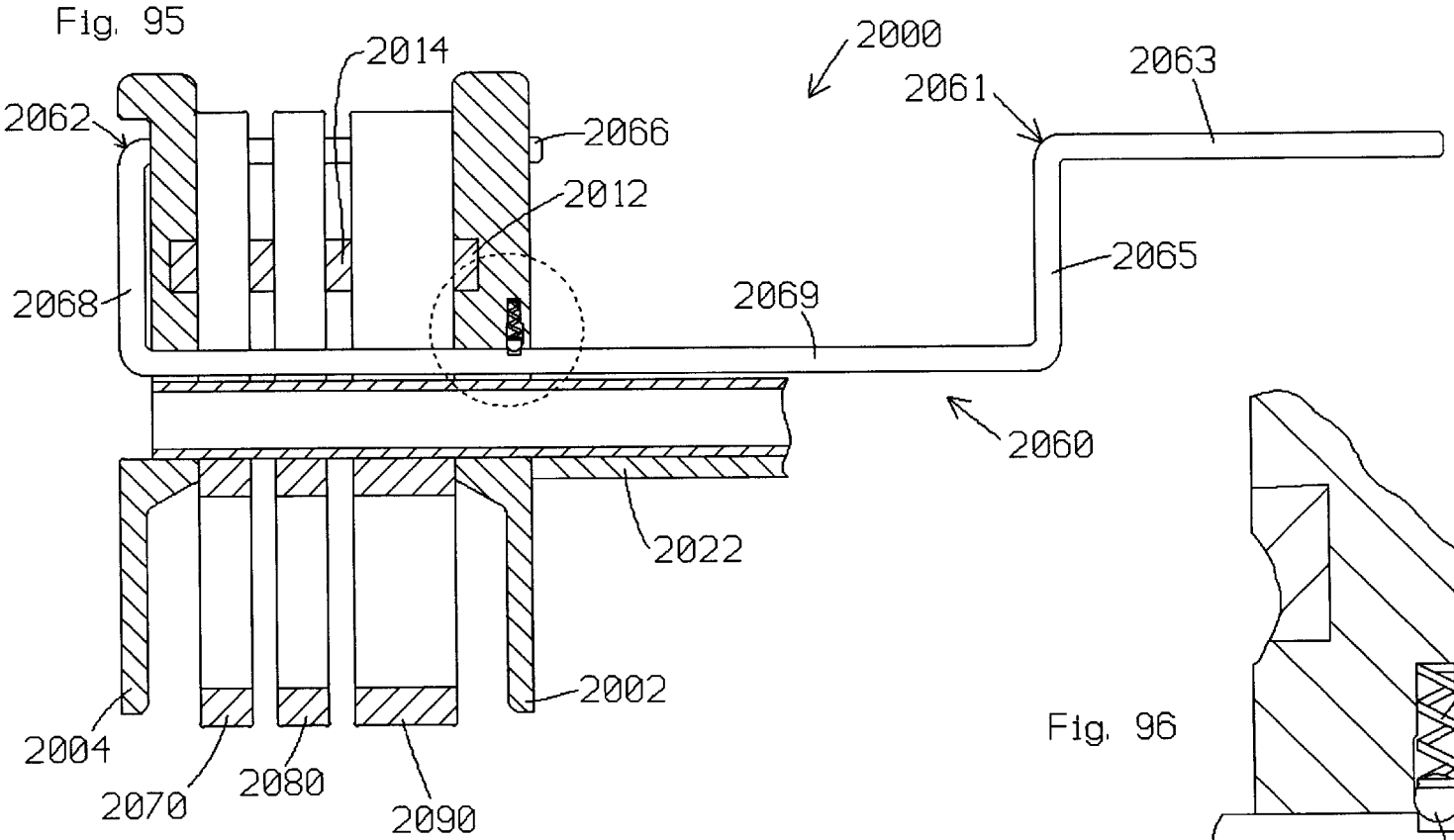
FIG. 95 is a fragmentary and sectioned side view of a dumbbell constructed according to the principles of the present invention and including another type of selector pin suitable for use in connection with various embodiments of the present invention.
Figure 97:
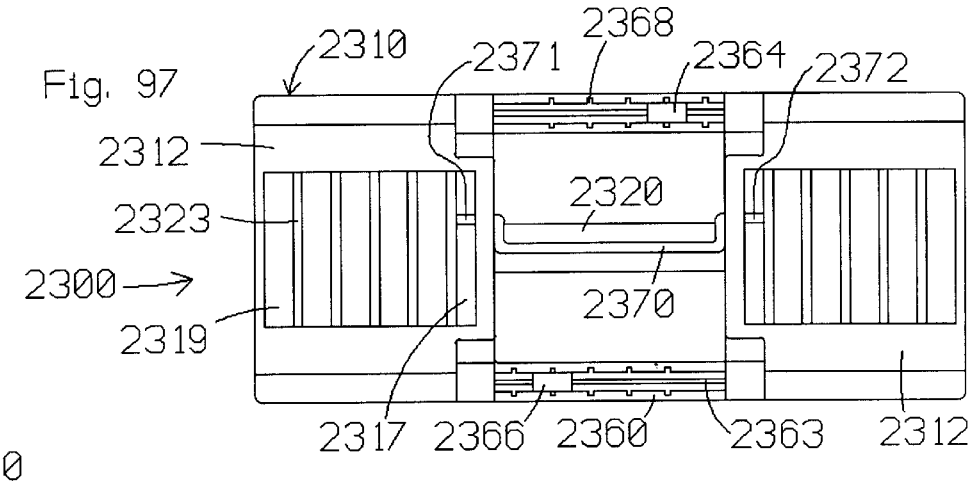
FIG. 97 is a top view of another dumbbell constructed according to the principles of the present invention.
Figure 97:
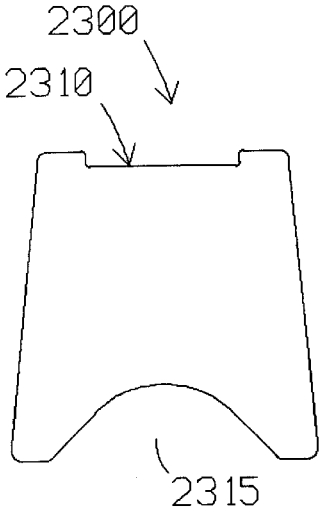

FIGS. 95–96 show another selector rod and biasing arrangement suitable for use on several of the embodiments disclosed herein, including the partially shown dumbbell designated as 2000 in FIG. 95. The rod or pin 2060 includes first and second L-shaped members 2061 and 2062 which are movable axially and rotatable relative to a dumbbell handle. The handle includes a steel tube 2020 that extends the length of the dumbbell 2000, and a plastic hand grip 2022 that fits over the steel tube 2020 and spans an intermediate portion of the dumbbell 2000. A first segment 2063 on the first member 2061 extends axially into engagement with the weight plates (not shown) on the right end of the dumbbell 2000, and a second, orthogonal segment 2065 on the first member 2061 extends radially away from the first segment 2063 and toward the hand grip 2022. A first segment 2066 on the second member 2062 extends axially into engagement with the weight plates 2070, 2080, and 2090 on the left end of the dumbbell 2000, and a second, orthogonal segment 2068 on the second member 2062 extends radially away from the first segment 2066 and toward the hand grip 2022.

An intermediate member 2069 is rigidly interconnected between the opposite ends of respective second segments 2065 and 2068 and extends axially therebetween. The intermediate member 2069 nests within an axially extending groove in the hand grip 2022. As a result of this arrangement, the first segments 2063 and 2066 are simultaneously pulled out of engagement with respective plates 2070, 2080, and 2090 (which are configured for selection in the same manner as the plates W5, W10, and W20, for example). The plates 2070, 2080, and 2090 are similarly slotted to accommodate the handle member 2020, and they are maintained in respective axial positions by a support 2012 interconnected between inner and outer base plates 2002 and 2004. The support 2012 has a rectangular perimeter and intermediate spacers 2014 similar to those on the member designated as 1000 in FIG. 66.

A notch is provided in the intermediate member 2069 to receive a ball 2059 that is biased toward the intermediate member 2069 by means of a compressed spring 2058. The notch spans a sufficiently large arc about the intermediate member 2069 to accommodate the entire range of selector pin orientations. The ball 2059 encourages the selector pin 2060 to remain in the axial position shown in FIG. 95 relative to the hand grip 2022. Other suitable latching and/or biasing means are disclosed herein with reference to other embodiments.

Among other things, the selector rod 2060 may be described as having first and second axially extending portions which are movable axially into and out of engagement with respective holes provided in respective sets of weights at opposite ends of a base; and an intermediate axially extending portion which is interconnected between the first and second axially extending portions and radially offset relative thereto.

On several of the embodiments disclosed herein, the number of available dumbbell loads may be doubled by supplementing the dumbbell 700 with two "half-weights" which weigh three-quarters of one pound. Such half-weights may be attached to the dumbbell 700 in various manners, including magnets or hook and loop fasteners, for example.

Another way to accommodate additional "fourth" weights or half-weights on certain embodiments is illustrated in FIGS. 71–78. The four weight plates W1–W4 may be connected in any combination to a handle member to provide sixteen different, balanced amounts of weight. As compared to the weight plates 790, 780, and 770, the weight plates W1, W2, and W4 include an additional set of holes QA–QH to accommodate the addition of an extra plate W3 to any combination of the other three plates W1, W2, and W4. In other words, the holes PA–PH accommodate any combination of the plates W1, W2, and W4 without the plate W3, and the holes QA–QH accommodate any combination of the plates W1, W2, and W4 together with the plate W3. For a dumbbell having two of each of the weights W1–W4 on each end of the handle, the plates W3 add a pound of mass to the weight being lifted whenever the selector pin occupies any of the holes QA–QH. The other three plates W1, W2, and W4 add different combinations of two pounds, four pounds, and eight pounds in much the same manner as the plates 790, 780, and 770.

The weight plates W1–W4 require a selector pin which differs from those described above. One suitable option is the pin designated as 2108 in FIG. 77. The pin 2108 includes an elongate first member 2110 which moves axially and rotates relative to a dumbbell handle member, and an L-shaped second member 2120 which moves radially relative to the first member 2110. The first member 2110 has a first end 2111 which extends axially into the handle member, and a second, opposite end 2112 which is formed into a closed loop. A first segment 2121 on the L-shaped member 2120 extends radially through the closed loop 2112 and terminates in a head 2122 of relatively larger diameter or cross-section. A second, orthogonal segment 2124 on the L-shaped member 2120 extends axially away from the first segment 2121 and terminates in a distal end 2128 which is inserted through the selected weights. The loop 2112 and the segment 2121 are preferably configured to permit sliding, but not rotation, of the latter relative to the former.

Figure 78:
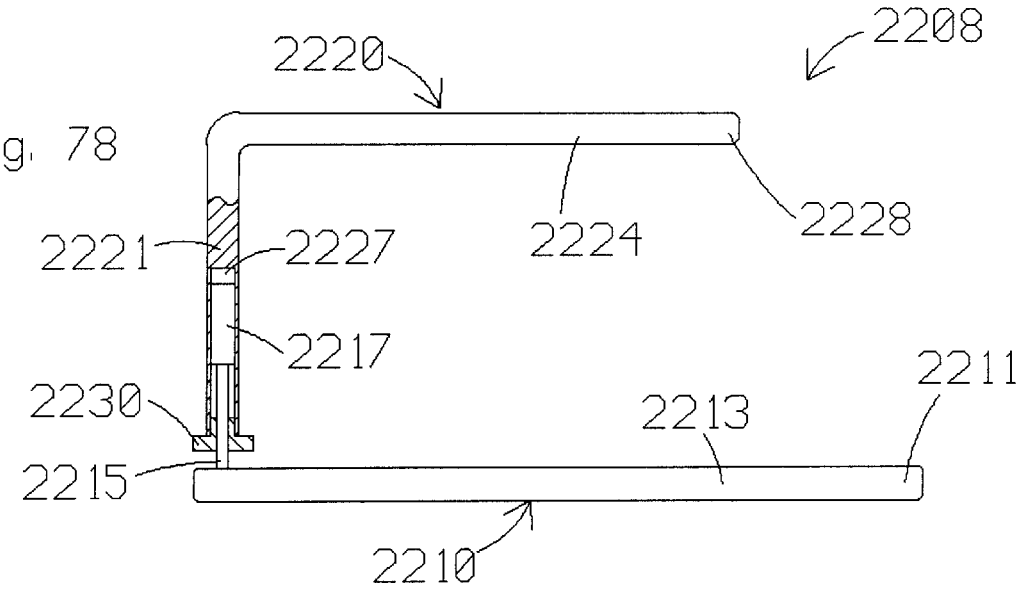
FIG. 78 is a partially sectioned side view of another selector pin constructed according to the principles of the present invention and suitable for use with the plates of FIGS. 74 and 76.

Another suitable replacement pin is designated as 2208 in FIG. 78. The pin 2208 includes a first L-shaped member 2210 which rotates and moves axially relative to a dumbbell handle member, and a second L-shaped member 2220 which moves radially relative to the first member 2210. The first member 2210 has an axial segment 2213 which extends into the handle member and terminates in a distal end 2211. The first member 2210 has a radial segment 2215 which is connected to an opposite end of the axial segment 2213 and terminates in a slide block 2217. A first segment 2221 on the second member 2220 is provided with a bore 2227 sized and configured to receive the slide block 2217. A fastener 2230 is secured to the distal end of the first segment 2221 to retain the slide block 2217 inside the bore 2227. The bore 2227 and the slide block 2217 are preferably configured to permit sliding, but not rotation, of the latter relative to the former. A second segment 2224 on the second member 2220 extends perpendicularly away from the first segment 2221 and terminates in a distal end 2228 which is inserted through the selected weights.

The telescoping action of either pin 2108 or 2208 facilitates movement of the respective weight engaging portion 2124 or 2224 between the upper set of holes PA–PH and the lower set of holes QA–QH. Although both sets of holes PA–PH and QA–QH are arranged in arcs about a common axis, the telescoping selector pin eliminates the need to arrange the selection holes in this manner or any other particular manner. Also, these substitute pins 2108 and 2208 may be latched in place by one or more means described with reference to the other embodiments.

Generally speaking, several embodiments of the subject invention may be described, for example, in terms of an adjustable weight exercise system, comprising: a base; at least three individual weights having respective overlapping portions and respective non-overlapping portions which are arranged to provide separate paths through each possible combination of the weights; holes extending through the base and the weights at each point of intersection between the paths and the weights, wherein some of the holes extend through respective overlapping portions and are aligned with one another, and some of the holes extend through respective non-overlapping portions; and a connecting pin selectively insertable through the base and all of the holes along any one of the paths to select any combination of the weights. Within this context, either selector pin 2108 or 2208 may further be described as movable axially into and out of the sets of holes and adjustable both radially and circumferentially relative to the sets of holes.

Figure 50:
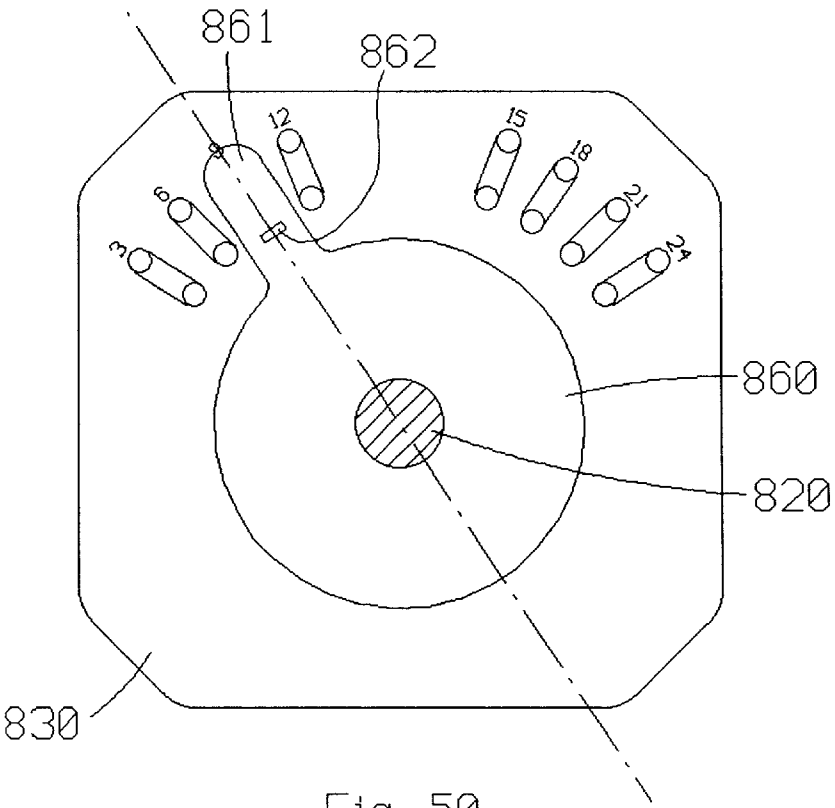
FIG. 50 is a sectioned end view of the dumbbell of FIG. 47, showing the weight selector member of FIG. 48 in front of the interior support of FIG. 49.

Another embodiment dumbbell constructed according to the principles of the present invention is designated as 800 in FIGS. 47–48. The dumbbell 800 includes a bar 820 which is made of steel and may be described with reference to three discrete sections. An intermediate section of the bar 820 has a circular profile or cross-section, as shown in FIG. 50. Each distal end portion of the bar 820 is primarily cylindrical but interrupted by a flat surface which extend lengthwise along each end of the bar (to fit snugly within the hole designated as 832 in FIG. 49). The exterior of the intermediate section may be knurled or otherwise textured to facilitate gripping thereof.

After first and second weight selecting members 860 are rotatably mounted on the intermediate section of the bar 820, first and second interior supports 830 are mounted on opposite end portions of the bar 820. Each support 830 provides a smooth inwardly facing surface which abuts a respective end of the intermediate portion of the bar 820. Each support 830 also provides an outwardly extending offset or collar 834 for reasons explained below.

Circumferentially spaced holes 836 are formed through each support 830 proximate the upper edge thereof. A visual indicator 835 is provided proximate each of the holes 836 for reasons discussed below. Also, grooves 837 extend radially inward from respective holes 836 to respective holes 838 (which are also circumferentially spaced).

Figure 51:
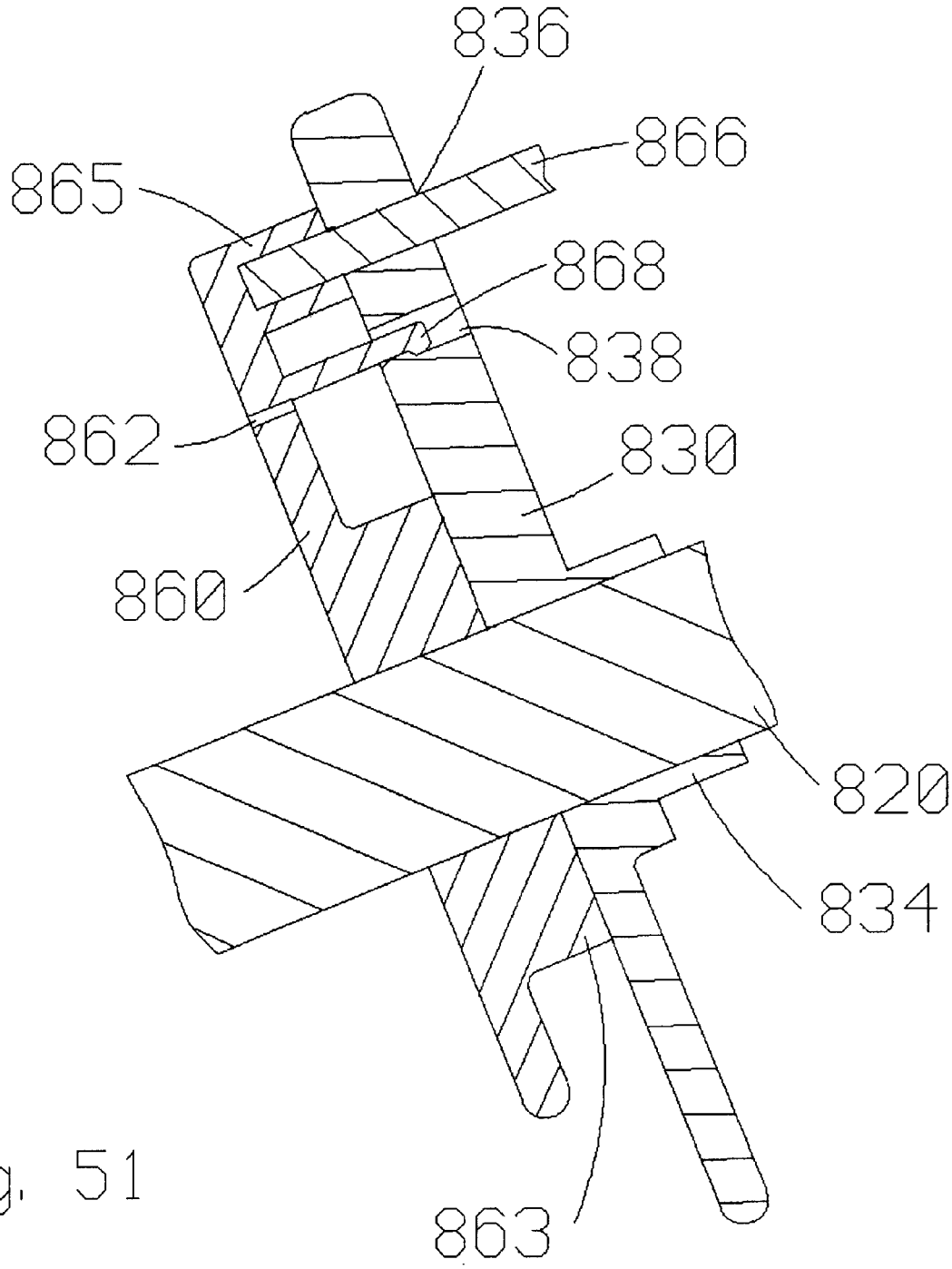
FIG. 51 is a sectioned view of the dumbbell of FIG. 47, taken along the section line shown in FIG. 50.

As shown in FIG. 50, each selecting member 860 may be described as primarily disc-shaped with a radially extending finger 861. Both a selector rod 866 and a prong 868 extend axially from the finger 861 proximate its distal end. As shown in FIG. 51, each of the holes 836 is sized and configured to receive the selector rod 866. A first end of the selector rod 866 is anchored within a boss 865 on a respective selecting member 860. An opposite, second end of each selector rod 866 terminates in a rounded tip suitable for insertion through the holes 836 (and aligned holes in any aligned dumbbell components).

FIG. 51 also shows that each of the holes 838 is sized and configured to receive the prong 868. On this embodiment 800, a first end of the prong 868 is integrally joined to the selecting member 860. As shown in FIGS. 48 and 51, an opposite, second end of the prong 868 is provided with a nub 869 sized and configured to snap into place behind a shoulder or lip on the sidewall of any of the holes 838. In this regard, the prong 868 is made of a resilient material and operates like a leaf spring. Those skilled in the art will recognize that the lips in the holes 838 may be formed during injection molding of the support 830. The nub 869 may also be formed during injection molding of the selecting member 860, by bringing a mold element through the opening designated as 862 in FIGS. 50 and 51, for example. A central boss 863 extends axially outward from each selecting member 860 to facilitate grasping of a respective rim 864 when it is abutting a respective support 830.

Figure 53:
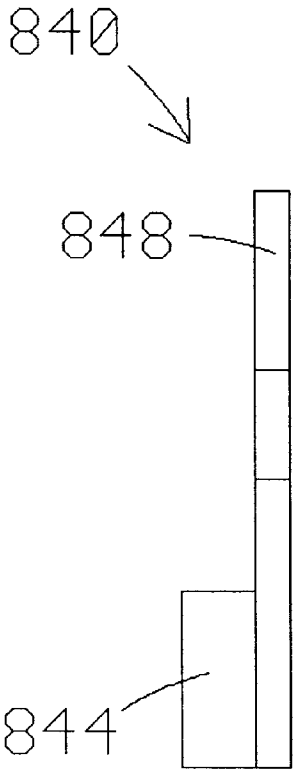
FIG. 53 is a side view of the spacer of FIG. 52.
Figure 52:
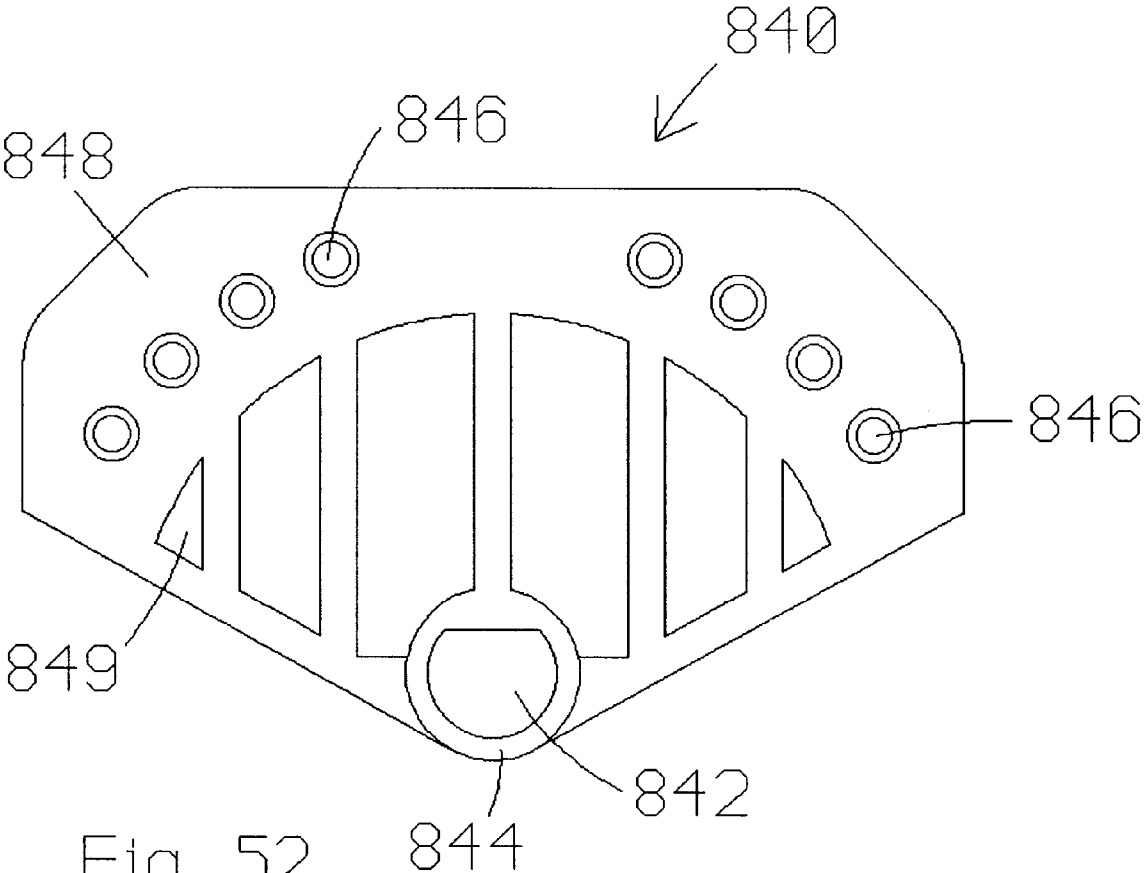
FIG. 52 is an end view of a spacer on the dumbbell of FIG. 47.

Two spacers 840 are mounted on each end of the bar 820 outside respective interior supports 830. As shown in FIGS. 52–53, each spacer 840 includes an axially extending offset 844 and a radially extending plate 848. A hole 842, sized and configured to receive an end portion of the bar 820, extends through both portions of the spacer 840. Each spacer 840 is oriented so the offset 844 extends axially inward, toward the intermediate section of the bar 820. Recessed areas 849 may be formed in the plate 848 to reduce the mass of the spacers 840 and/or to conserve resources. Circumferentially spaced holes 846 extend through each spacer 840 proximate the upper edge thereof. The sidewalls of the holes 846 extend in divergent fashion toward the intermediate section of the bar 820 to facilitate insertion of the selector rod 860 therein.

Figure 55:
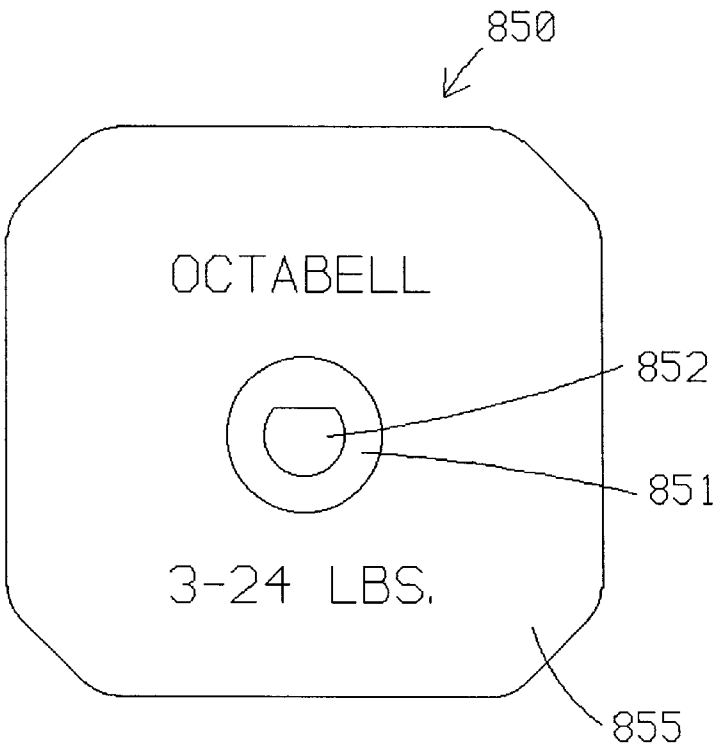
FIG. 55 is an opposite end view of the exterior support of FIG. 54.
Figure 54:
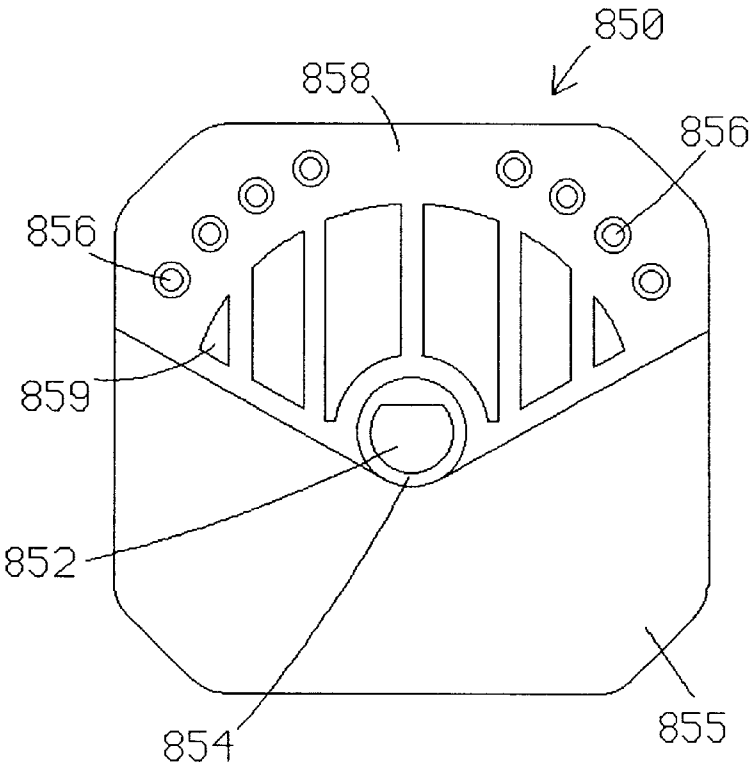
FIG. 54 is an end view of an exterior support on the dumbbell of FIG. 47.

First and second exterior supports 850 are mounted on opposite end sections of the bar 820 outside respective spacers 840. As shown in FIGS. 54–55, each support 850 has an axially extending offset or collar 854 which extends axially inward and abuts the plate portion 848 of a respective spacer 840. Each support 850 also has a radially extending plate 855 which is similar in size and configuration to the interior supports 830. A hole 852, sized and configured to receive an end portion of the bar 820, extends through both the collar 854 and the plate 855. A recessed cavity 851 is provided in the smooth, outwardly facing side of each support 850 to receive a countersunk end fastener (not shown) which is rigidly anchored to the end of the bar 820.

A plateau or offset surface 858 is provided on the inwardly facing side of each support 850, both on the upper portion thereof and about the collar 854. Recessed areas 859 may be formed in the plateau 858 to reduce the mass of the supports 850 and/or to conserve resources. Circumferentially spaced holes 856 extend into each plateau 858 proximate the upper edge thereof. The sidewalls of the holes 856 extend in divergent fashion toward the intermediate section of the bar 820 to facilitate insertion of the selector rod 860 therein. The plateau 858 provides both additional depth for receiving the selector rod 860 and room for a spacer on a cradle to extend upward between the support 850 and an adjacent weight plate 890.

The dumbbell 800 includes three pairs of weight plates 870, 880, and 890, which weigh six pounds, three pounds, and one and one-half pounds, respectively. The plates 870, 880, and 890 are selectively secured, in any combination, to respective supports 830 and 850 and spacers 840 by means of respective selector rods 860. When not in use, the dumbbell 800 rests on a cradle having walls and/or spacers sized and configured to receive and retain the weights 870, 880, and 890. As on the cradle 702 described above, spacers extend inward and/or upward from one or more walls to align with the supports 830 and 850 and the spacers 840 and thereby maintain the proper alignment and spacing between the weights 870, 880, and 890.

Figure 49:
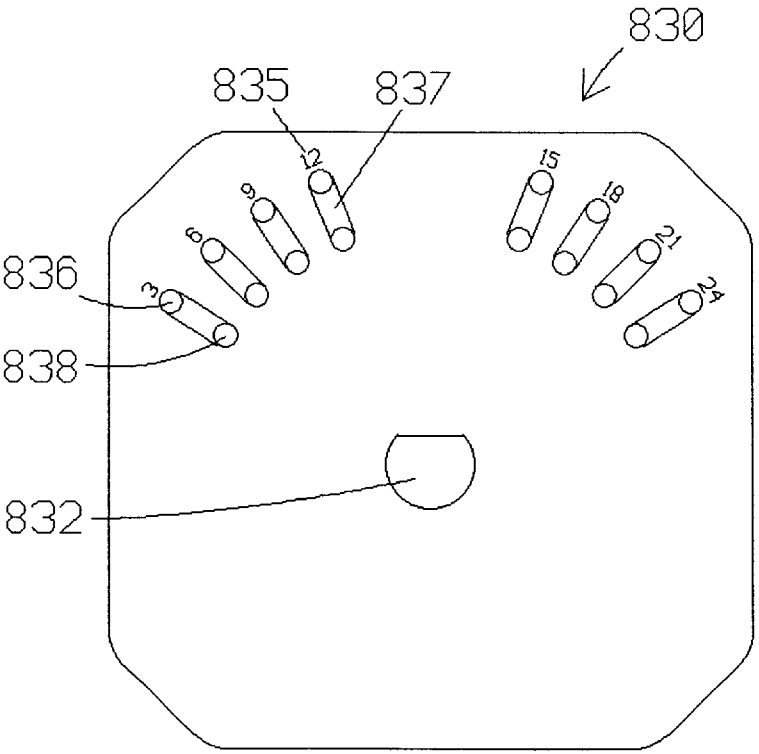
FIG. 49 is an end view of an interior support on the dumbbell of FIG. 47.
Figure 56:
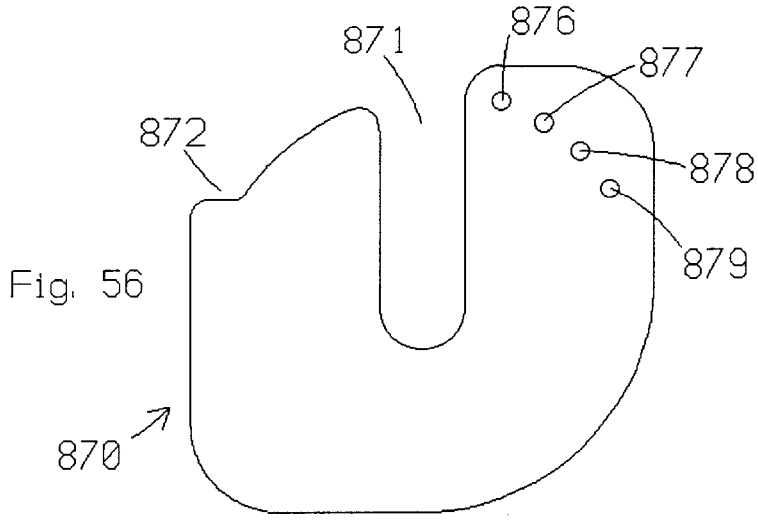
FIG. 56 is an end view of a first weight plate on the dumbbell of FIG. 47.

FIG. 56 shows one of the six pound plates 870, as viewed by a person looking from the intermediate section of the bar 820 outward toward the interior support 830 shown in FIGS. 49 and 50. Each plate 870 is provided with an upwardly opening slot 871 sized and configured to receive both the axial offset 844 on a respective spacer 840 and the axial offset 834 on a respective interior support 830. Again, this arrangement of offsets is desirable because all of the intermediate spacers 840 may be made identical in size and shape. On one side of the plate 870, a notch 872 provides clearance for the selector rod 860 when it is inserted into the "3" hole shown in FIGS. 49 and 50 (as well as any of the "6", "9", or "12" holes). On an opposite side of the plate 870, holes 876–879 are provided to receive the selector rod 860 when it is inserted into any of the "15", "18", "21", or "24" holes, respectively.

Figure 57:
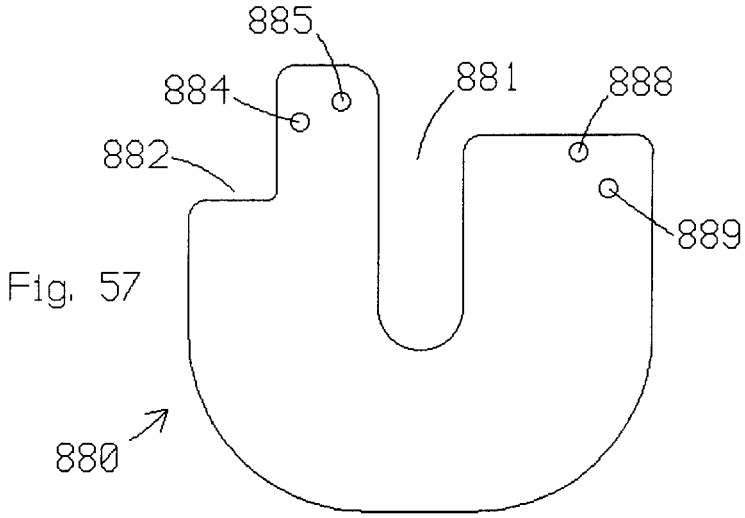
FIG. 57 is an end view of a second weight plate on the dumbbell of FIG. 47.

FIG. 57 shows one of the three pound plates 880, as viewed by a person looking from the intermediate section of the bar 820 outward toward the interior support 830 shown in FIGS. 49–50. Each plate 880 is provided with an upwardly opening slot 881 sized and configured to receive the axial offset 844 on a respective spacer 840. On one side of the plate 880, a notch 882 10 provides clearance for the selector rod 860 when it is inserted into the "3" hole shown in FIGS. 49–50 (as well as the "6" hole). Holes 884 and 885 are provided on this same side of the plate 880 to receive the selector rod 860 when it is inserted into either of the "9" or "12" holes, respectively. On an opposite side of the plate 880, holes 888 and 889 are provided to receive the selector rod 860 when it is inserted into either of the "21" or "24" holes, respectively. The plates 880 and 870 are sized and configured so that the holes 888 and 889 align with the holes 878 and 879, respectively, to facilitate contemporaneous engagement of both plates 880 and 870 in these two selector rod orientations.

Figure 58:
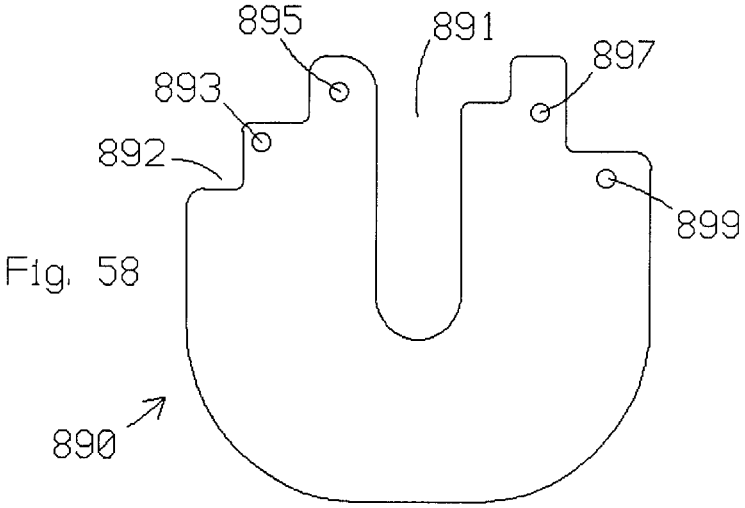
FIG. 58 is an end view of a third weight plate on the dumbbell of FIG. 47.

FIG. 58 shows one of the one and one-half pound plates 890, as viewed by a person looking from the intermediate portion of the bar 820 outward toward the interior support 830 shown in FIGS. 49–50. Each plate 890 is provided with an upwardly opening slot 891 sized and configured to receive the axial offset 854 on a respective exterior support 850. The plates 890 are shown with one-half the thickness of the plates 880 with the understanding that the plates 870, 880, and 890 are equally dense. On one side of the plate 890, a notch 892 provides clearance for the selector rod 860 when it is inserted into the "3" hole shown in FIGS. 49–50. Holes 893 and 895 are provided on this same side of the plate 890 to receive the selector rod 860 when it is inserted into either of the "6" or "12" holes, respectively. On an opposite side of the plate 890, holes 897 and 899 are provided to receive the selector rod 860 when it is inserted into either of the "18" or "24" holes, respectively. The plates 890 and 880 are sized and configured so that the holes 895 and 899 align with the holes 885 and 889, respectively, to facilitate contemporaneous engagement of both plates 890 and 880 in these two selector rod orientations. Also, the plates 890 and 870 are sized and configured to that the holes 897 and 899 align with the holes 877 and 879, respectively, to facilitate contemporaneous engagement of both plates 890 and 870 in these two selector rod orientations.

Figure 59:
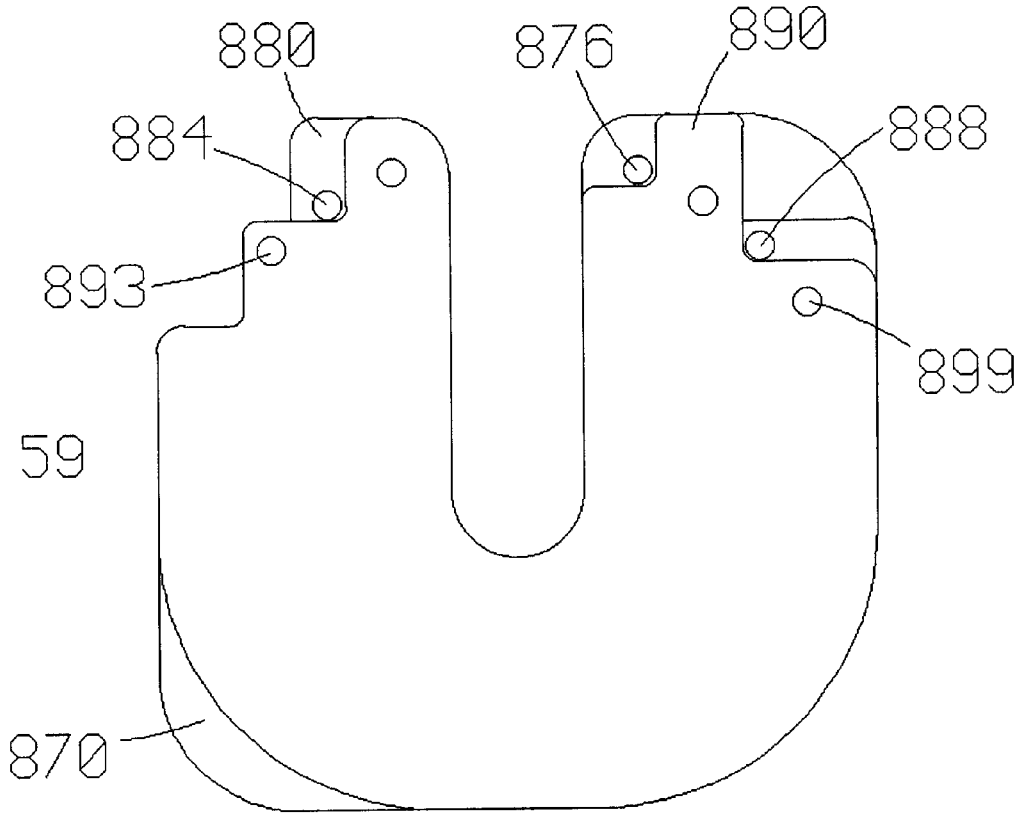
FIG. 59 is an end view of the weight plates of FIGS. 56–58 aligned with one another.

FIG. 59 shows the three different plates 870, 880, and 890 aligned relative to one another, and viewed from the same perspective as FIGS. 56–58. Assuming that the unloaded handle assembly (the dumbbell 800 without any of the plates 870, 880, or 890) weighs three pounds, the weight plates 870, 880, and 890 may be added to the handle assembly to provide the same range of dumbbell loads as the previous embodiment 700.

An advantage of the dumbbell 800 is that a user's hand is placed between the selecting members 860when the dumbbell 800 is in use. Also, the extent of the offsets 863 may be made adjustable to customize the distance between the opposing rims 864. In any event, the selecting members 860 may be less likely to withdraw during use, and/or a user may more readily notice withdrawal of the selecting members 860 during use. Another advantage of the dumbbell 800 is that the spacers 840 support the selector rods 860 at intermediate positions between the supports 830 and 850. Also, the dumbbell 800 may be described as somewhat more self-contained, since the selecting members 860 may be operated within the planform of the dumbbell 800. With respect to the biasing arrangement on the dumbbell 800, those skilled in the art will recognize that it may be adapted for use on various other dumbbells described herein, and/or one or more biasing arrangements described with reference to other dumbbells may be adapted for use on the dumbbell 800.

Figure 60:
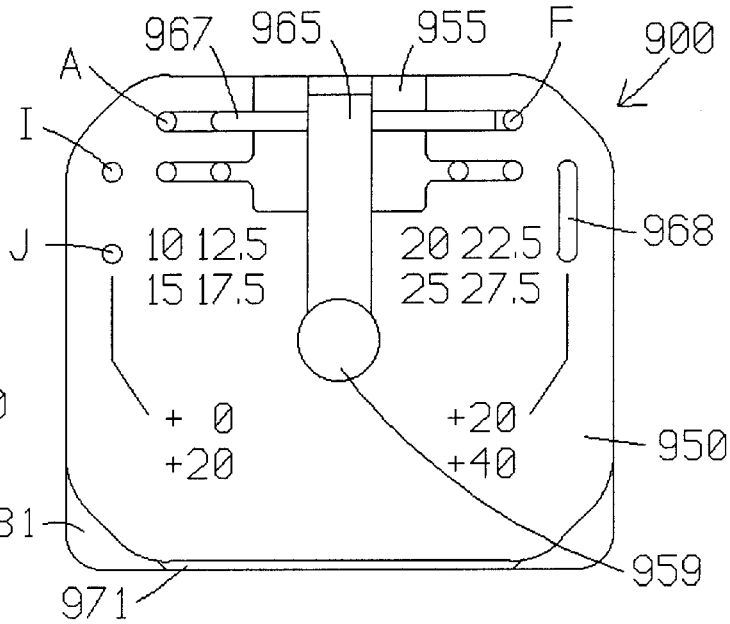
FIG. 60 is an end view of another alternative embodiment dumbbell constructed according to the principles of the present invention.

Yet another dumbbell constructed according to the principles of the present invention is designated as 900 in FIG. 60. The dumbbell 900 is generally similar in construction and operation to the dumbbells 700 and 800 described above. Therefore, the following description of the dumbbell 900 will focus primarily on its unique attributes.

The dumbbell 900 has two selector rods 967 and 968 which extend the entire length of the dumbbell 900. The first selector rod 967 may be described as an L-shaped bar having a relatively shorter segment which extends radially across one of the end supports 950, and a relatively longer segment which extends axially between the end supports 950 (and through interior supports and any selected weight plates). The longer segment may be inserted into any of eight different holes in the end support 950. The respective locations of these holes are designated as A–H in FIGS. 60–65. The shorter segment may be secured relative to the end support 950 by means of a spring clip 965 and/or by another suitable means. The clip 965 is made of steel and secured between the end support 950 and the end fastener 959. In the alternative, the clip 965 may be an integrally molded portion of the end support 950. A recessed area 955 in the end support 950 provides access to the inward side of the shorter segment of the selector rod 967, for purposes of grasping same. Grooves extend from the recessed area 955 to the outer holes A, C, F, and H to seat the shorter segment of the selector rod 967 in a desired position relative to the end support 950.

The second selector rod 968 may be described as a J-shaped bar having a relatively longer axial segment, a relatively shorter axial segment, and an intermediate radial segment extending therebetween. The longer axial segment extends between the end supports 950 (and through interior supports and any selected weight plates) and may be inserted into any of four different holes in the end support 950. The respective locations of these holes are designated as I–L in FIGS. 60–65. The shorter axial segment may be inserted into an adjacent one of the holes I–L, depending on the position of the longer axial segment. The shorter axial segment only extends into the one end support 950 and may be secured relative thereto by means of a ball detent arrangement and/or by another suitable means.

Figure 61:
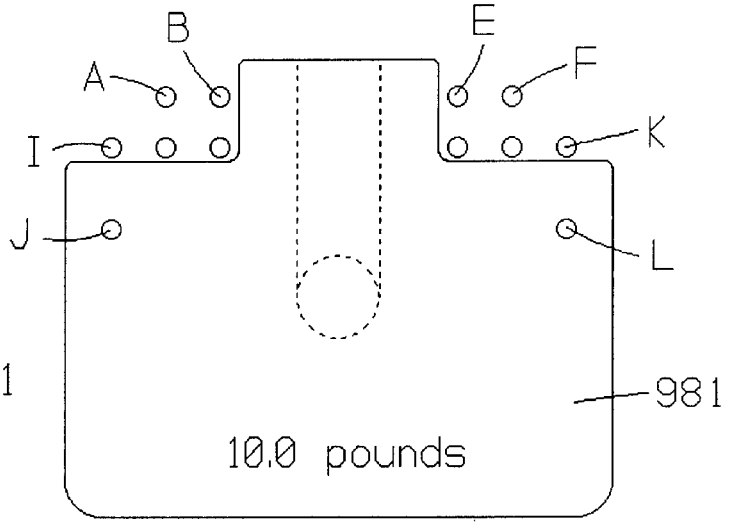
FIG. 61 is an end view of a first weight plate on the dumbbell of FIG. 60.
Figure 62:
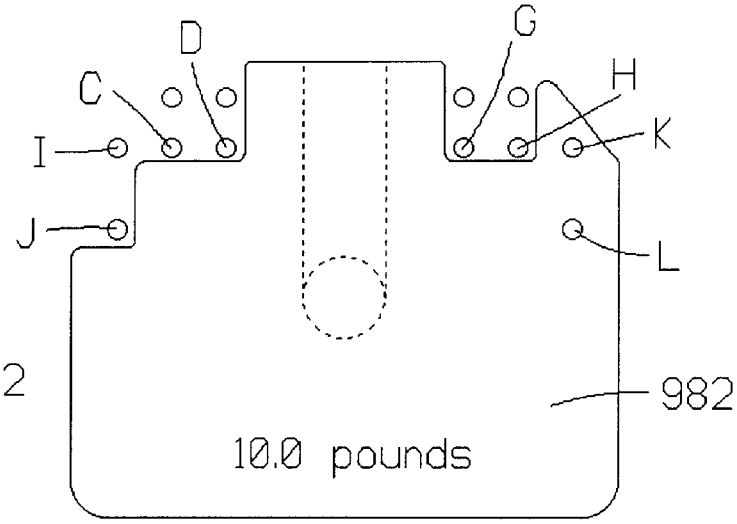
FIG. 62 is an end view of a second weight plate on the dumbbell of FIG. 60.
Figure 63:
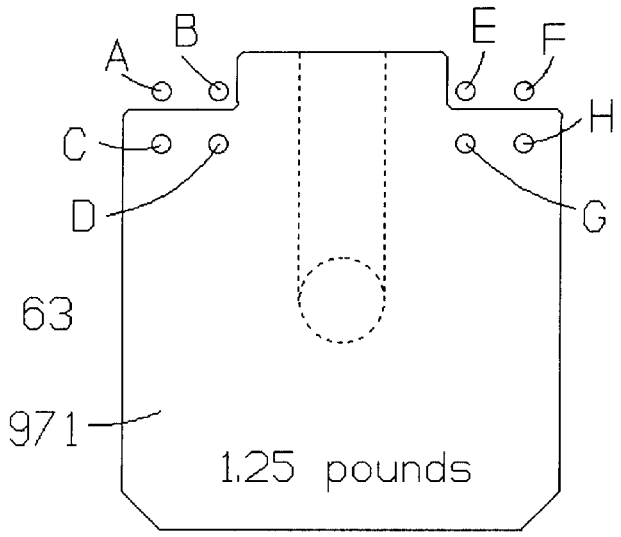
FIG. 63 is an end view of a third weight plate on the dumbbell of FIG. 60.
Figure 64:
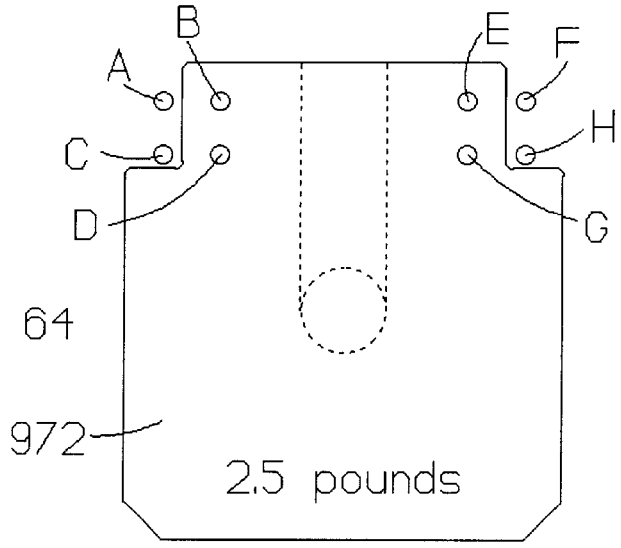
FIG. 64 is an end view of a fourth weight plate on the dumbbell of FIG. 60.
Figure 65:
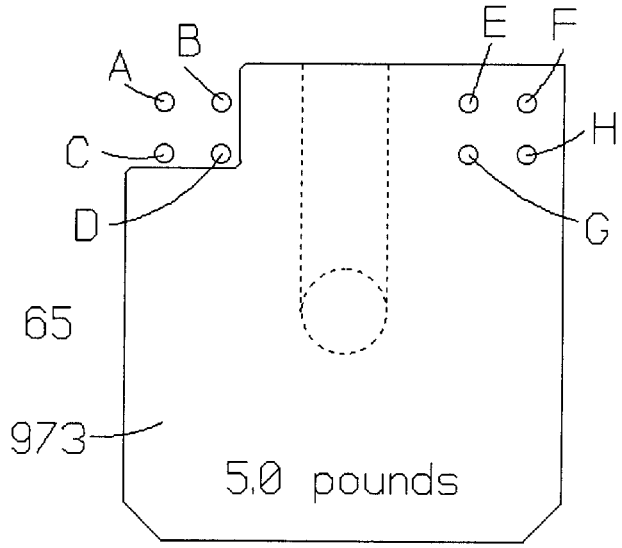
FIG. 65 is an end view of a fifth weight plate on the dumbbell of FIG. 60.

The dumbbell 900 includes a pair of weight plates 981 and a pair of weight plates 982 which are disposed at opposite ends of the dumbbell 900. In particular, each of the plates 981 is disposed just outside a respective interior support, and each of the plates 982 is disposed just outside a respective plate 981. As shown in FIGS. 61–62, the plates 981 and 982 are configured to be bypassed by the first selector rod 967 regardless of the hole A–H occupied by same. Furthermore, the plate 981 is configured to be engaged by the second selector rod 968 when its longer segment occupies either hole J or hole L. Also, the plate 982 is configured to be engaged by the second selector rod 968 when its longer segment occupies either hole K or hole L. As a result of this arrangement, when the longer segment of the second selector rod 968 occupies hole location I, neither of the plates 981 or 982 is engaged; and when the longer segment of the second selector rod 968 occupies hole location J, only the plate 981 is engaged; and when the longer segment of the second selector rod 968 occupies hole location K, only the plate 982 is engaged; and when the longer segment of the second selector rod 968 occupies hole location L, both of the plates 981 and 982 are engaged. Assuming that each of the plates 981 and 982 weighs ten pounds, the pairs of weights 981 and 982 are capable of adding twenty to forty pounds of weight to the dumbbell 900 in twenty pound increments.

The dumbbell 900 also includes pairs of weight plates 971–973 disposed at opposite ends of the dumbbell 900. In particular, each of the plates 973 is disposed just outside a respective plate 982; each of the plates 972 is disposed just outside a respective plate 973; and each of the plates 971 is disposed just outside a respective plate 972 (and just inside a respective end support 950). The plates 971–973 are configured to be bypassed by the second selector rod 968 regardless of the hole I–L occupied by same. Furthermore, the plate 971 is configured to be engaged by the first selector rod 967 when its longer segment occupies any of the holes C–D or G–H; the plate 972 is configured to be engaged by the first selector rod 967 when its longer segment occupies any of the holes B, D–E, or G; and the plate 973 is configured to be engaged by the first selector rod 967 when its longer segment occupies any of the holes E–G.

Assuming that each of the plates 971 weigh one and one-quarter pounds, and each of the plates 972 weighs two and one-half pounds, and each of the plates 973 weighs five pounds, the plates 971–973 are capable of adding two and one-half to seventeen and one-half pounds of weight to the dumbbell 900, in two and one-half pound increments. Indicia on the end support 950 show the weight associated with each of the selector rod locations (with an unloaded handle assembly weighing ten pounds).

In each of the FIGS. 61–65, a respective weight plate is depicted with an elongate slot and handle location shown in dashed lines to emphasize that the slots are not necessary if the handle does not extend across the plates. In this regard, rigid boxes or frames may be provided to partially enclose and selectively retain the weight plates, and the handle may be configured to extend only between the two boxes. The boxes or frames may include flanges to space the weight plates and/or support intermediate portions of the selector rod(s).

Figure 67:
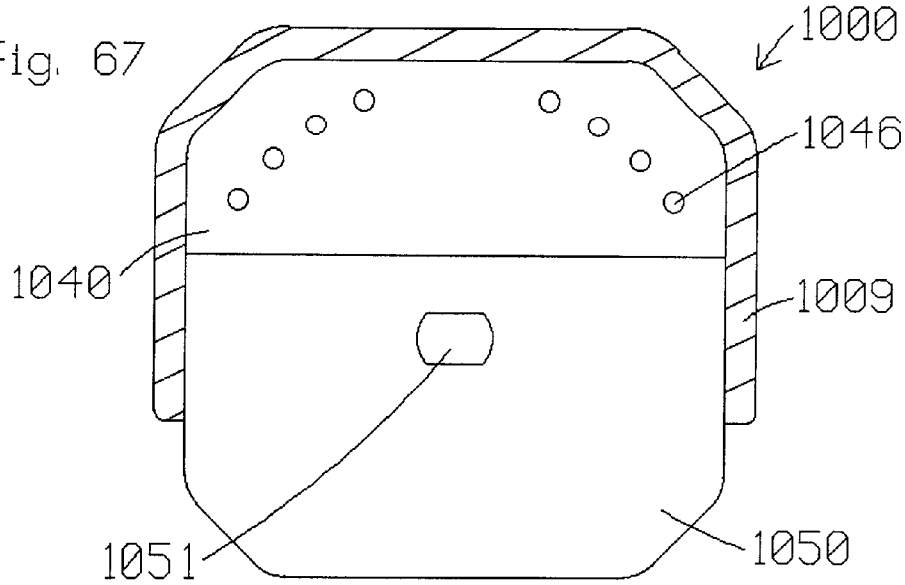
FIG. 67 is a sectioned end view of the weight supporting member of FIG. 66, taken along the section line 67–67.
Figure 66:
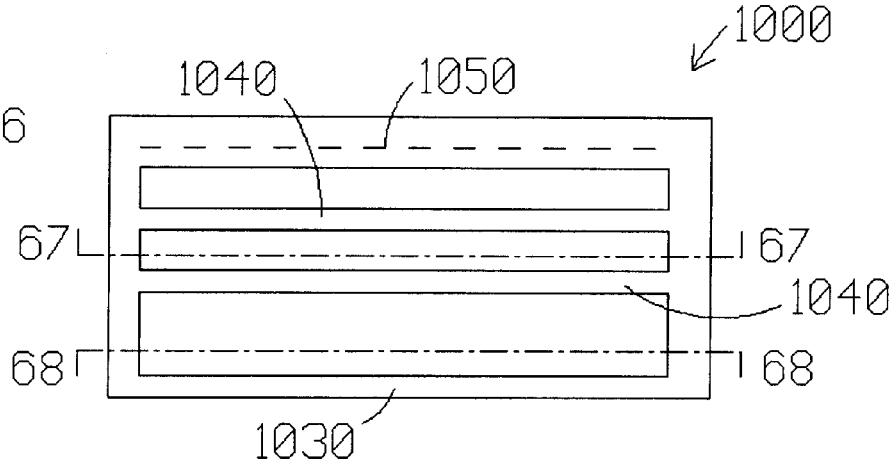
FIG. 66 is a bottom view of a weight supporting member constructed according to the principles of the present invention and suitable for use in place of certain components on the preferred embodiment dumbbell of FIG. 31.
Figure 68:
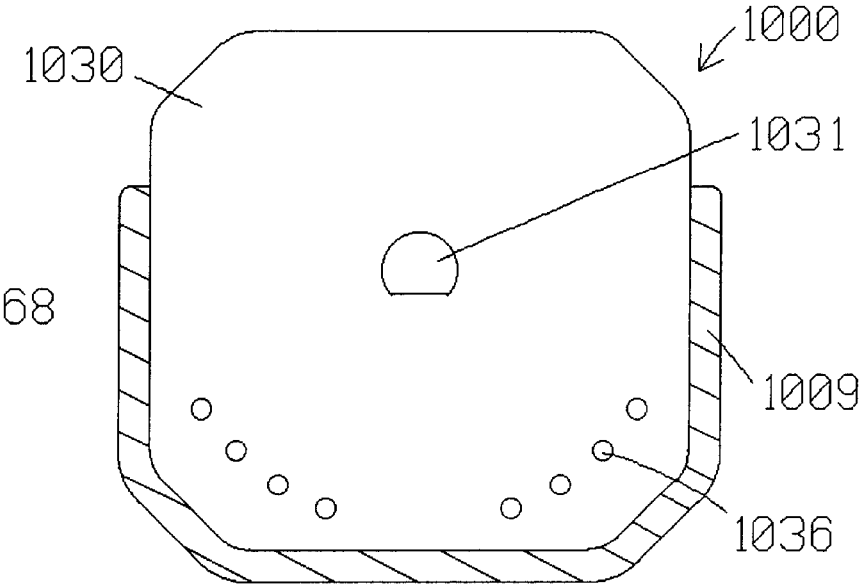
FIG. 68 is a sectioned end view of the weight supporting member of FIG. 66, taken along the section line 68–68.

Another possible handle unit or base suitable for use on various embodiments, including any of the dumbbells 700, 800, or 900, is designated as 1000 in FIGS. 66–68. The base 1000 includes box-like weight supporting members like those suggested above, but also is configured for use with a "full length" handle. The base 1000 may be described as a shell or housing having a U-shaped cross-section or outer wall 1009 which opens downward when properly oriented relative to an underlying cradle. One end of the wall 1009 is bounded by an interior support 1030 which has a profile comparable to that of the dumbbell as a whole. A central opening 1031 extends through the support 1030 to receive an end portion of a shaft having a profile comparable in configuration to the opening 1031. Circumferentially spaced holes 1036 extend through the support 1030 to accommodate a selector rod. An opposite end of the wall 1009 is bounded by an exterior support 1050 which also has a profile comparable to that of the dumbbell as a whole. A central opening 1051 extends through the support 1050 to receive an end of a shaft having a profile comparable in configuration to the opening 1051. The support 1050 is retained on the end of the shaft, between an end fastener and the end portion (disposed between the end and the handle portion of the shaft). Circumferentially spaced holes extend through the support 1050, in alignment with the holes 1036 (and holes 1046) to accommodate the selector rod.

Intermediate the supports 1030 and 1050, spacers 1040 extend inward and downward from the wall 1009 to define weight receiving cavities therebetween. Circumferentially spaced holes 1046 extend through the spacers 1040 to accommodate the selector rod. An advantage of this base 1000 is that it can be manufactured as a single, integrally molded unit. Another advantage is that the wall 1009 shrouds the upper half of the dumbbell.

Figure 70:
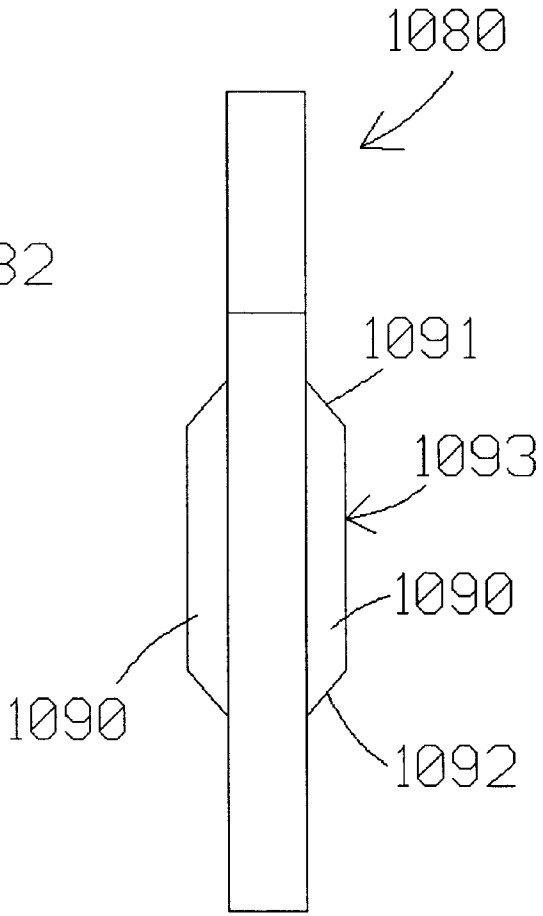
FIG. 70 is a side view of the weight plate of FIG. 69.
Figure 69:
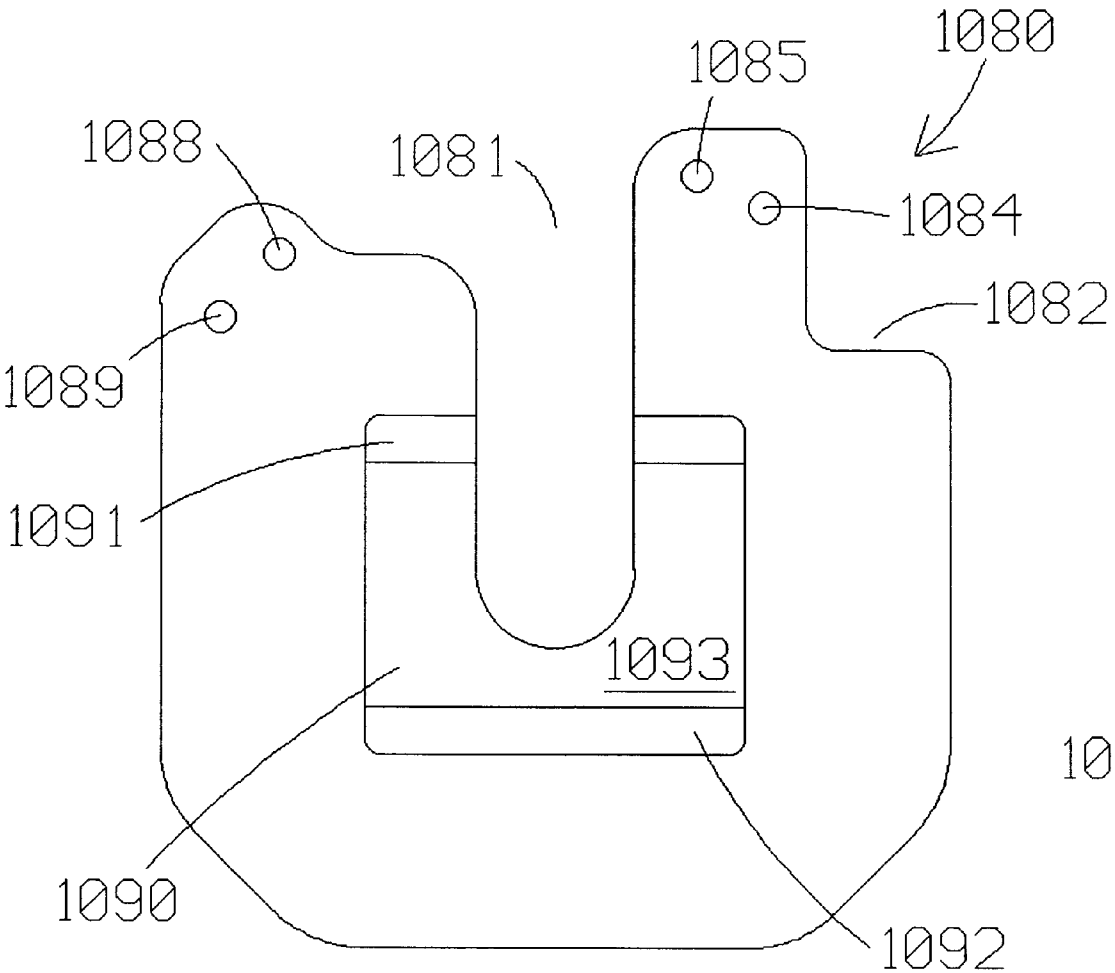
FIG. 69 is an end view of a weight plate suitable for use with the weight supporting member of FIG. 66.
Figure 71:
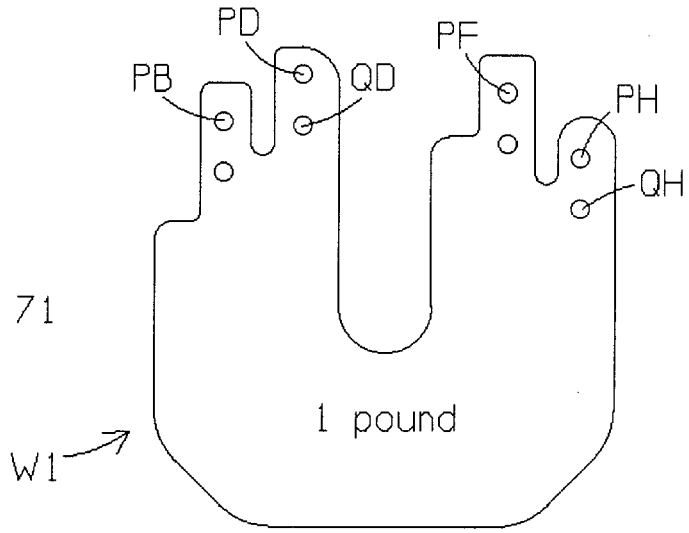
FIG. 71 is an end view of another "first" weight plate constructed according to the principles of the present invention.
Figure 72:
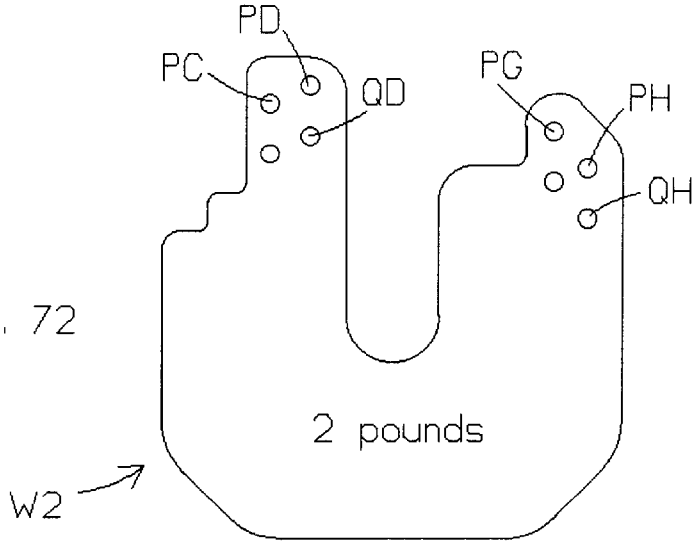
FIG. 72 is an end view of another "second" weight plate constructed according to the principles of the present invention.
Figure 73:
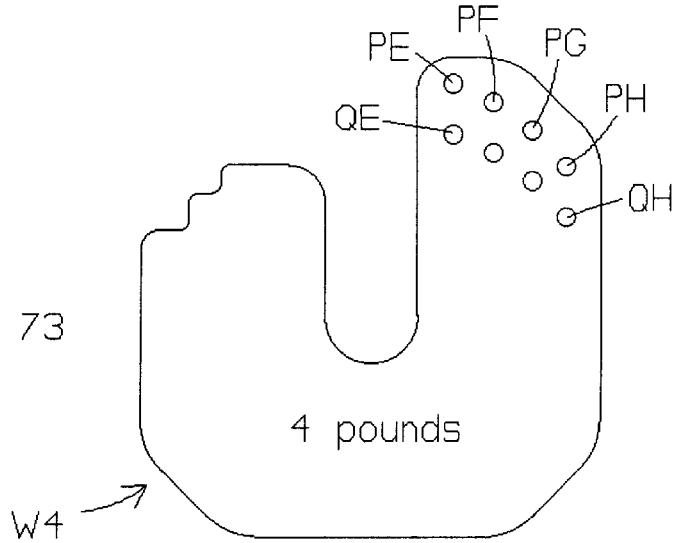
FIG. 73 is an end view of another "third" weight plate constructed according to the principles of the present invention.
Figure 74:
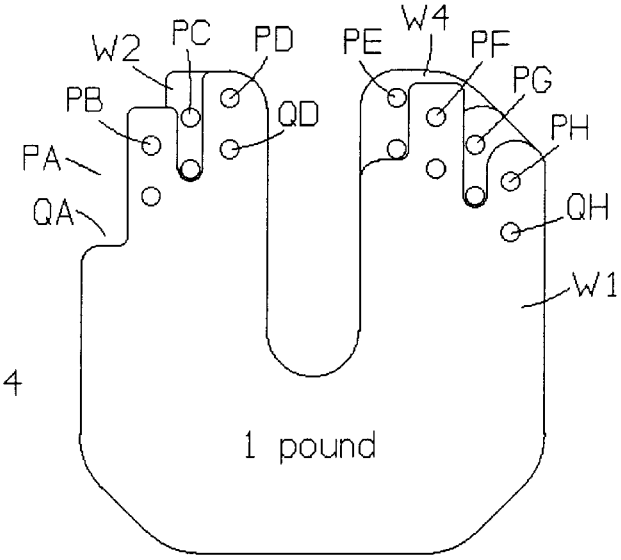
FIG. 74 is an end view of the plates of FIGS. 71–73 aligned with one another.
Figure 75:
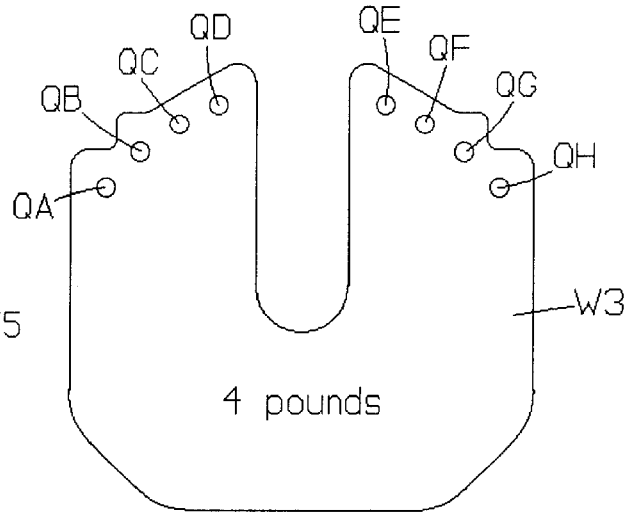
FIG. 75 is an opposite end view of the aligned plates of FIGS. 74.
Figure 76:
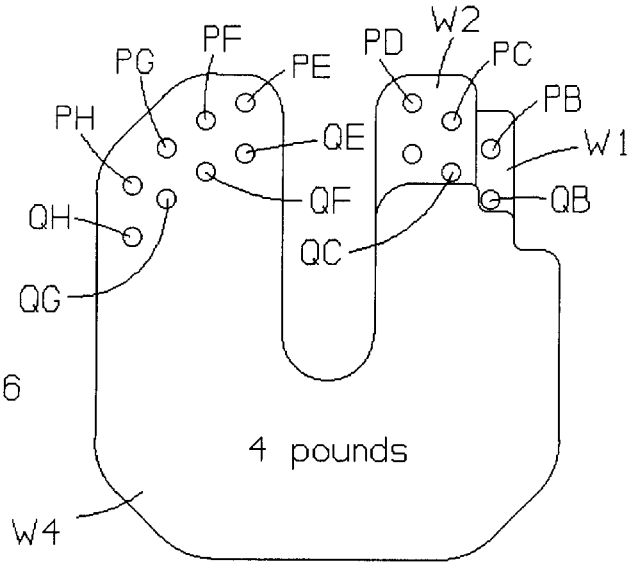
FIG. 76 is an end view of a "fourth" weight plate constructed according to the principles of the present invention and suitable for use together with the plates of FIG. 74.
Figure 77:
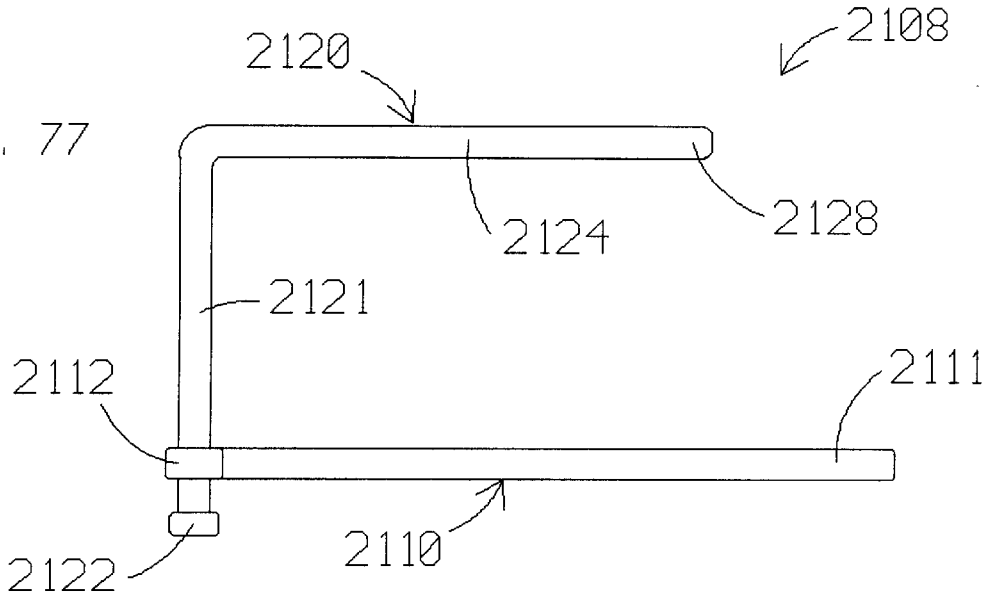
FIG. 77 is a side view of a selector pin constructed according to the principles of the present invention and suitable for use with the plates of FIGS. 74 and 76.

FIGS. 69–70 show a weight plate 1080 which is provided with built-in spacers 1090, and which may be used, for example, together with the base 1000 and/or on the dumbbell 700 (with the elimination of the spacers 740). For purposes of demonstrating interchangeability, the weight plate 1080 has the same end profile as the weight plate 780 shown in FIG. 41 (but is viewed from an opposite end). Like the plate 780, the plate 1080 includes an elongate slot 1081 and a notch 1082. Also, holes 1084–1085 and 1088–1089 extend through the plate 1080 to accommodate the selector rod. The spacers or axial offsets 1090 extend outward from each end of the plate 1080, but other arrangements are also possible.

Each spacer 1090 includes an upwardly inclined or beveled surface 1091, a downwardly inclined or beveled surface 1092, and an intermediate surface 1093 which extends radially. With reference to the dumbbell 700, for example, one of the surfaces 1093 bears against the weight plate 1070, and the other surface bears against the weight plate 1090. The beveled surfaces 1091 and 1092 facilitate the return of any selected weight plates relative to any unselected weight plates.

Another dumbbell constructed according to the principles of the present invention is designated as 100 in FIGS. 1–8. The dumbbell 100 includes a parallelepiped block 110, which is preferably one or two pieces of injection molded plastic. A central opening 112, bounded by opposing end walls 111, is provided in the block 110 to receive and accommodate a person's hand. A cylindrical handle 120 is disposed within the opening 112 and extends perpendicularly between the end walls 111. The handle 120 has an outer diameter of about one inch and is sized and configured to be grasped.

Eight slots 114 are provided in the block 110 to receive and accommodate weights **140*a* and 140*b*. Each slot 114** is sized and configured to receive up to five one-pound weights

140*a* or one five-pound weight 140*b*. In other words, up to forty pounds of weights 140*a* and 140*b* may be inserted into the block 110.

Figure 6:
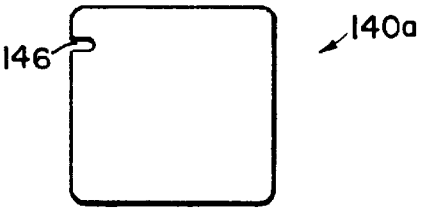
FIG. 6 is an end view of one of the weights of FIG. 4.
Figure 9:
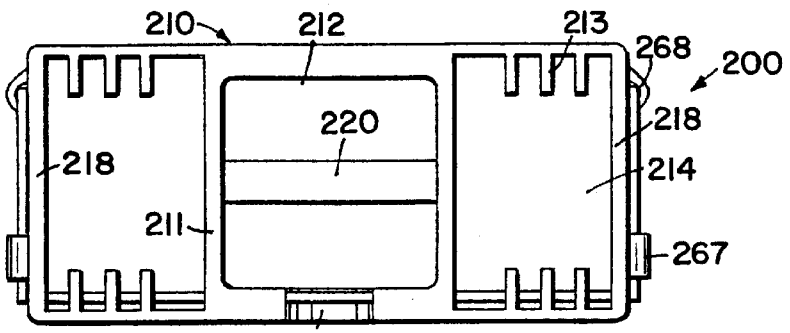
FIG. 9 is a top view of a second exercise dumbbell constructed according to the principles of the present invention.

FIG. 6 shows an end view of one of the weights 140*a*. The weight 140*a* is a twelve gauge steel plate approximately six inches wide and six inches high (the weights 140*b* present the same end view and are five times as thick). A notch 146 is provided in the weight 140*a* to accommodate a latch or selector rod 160, as further explained below. The sidewalls of the notch 146 may be made outwardly divergent in order to facilitate insertion of the latch 160 into the notch 146.

Figure 1:
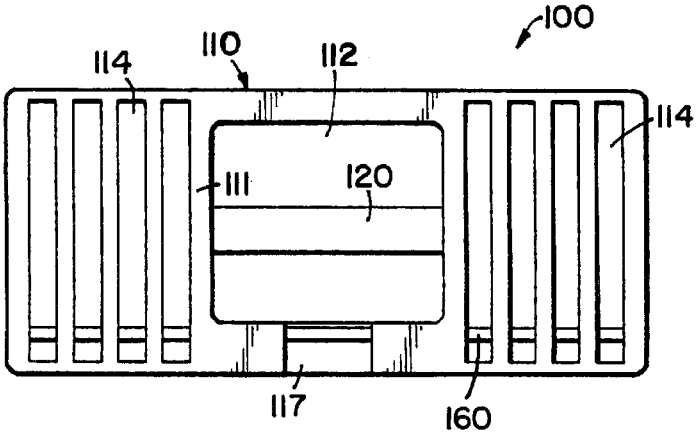
FIG. 1 is a top view of a first exercise dumbbell constructed according to the principles of the present invention.
Figure 2:
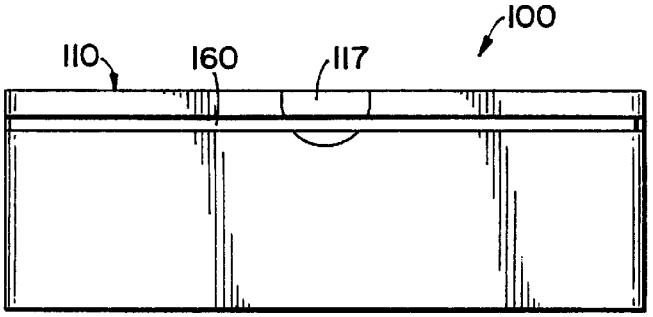
FIG. 2 is a front view of the dumbbell of FIG. 1.
Figure 3:
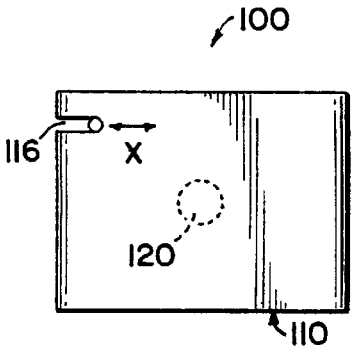
FIG. 3 is an end view of the dumbbell of FIG. 1.
Figure 4:
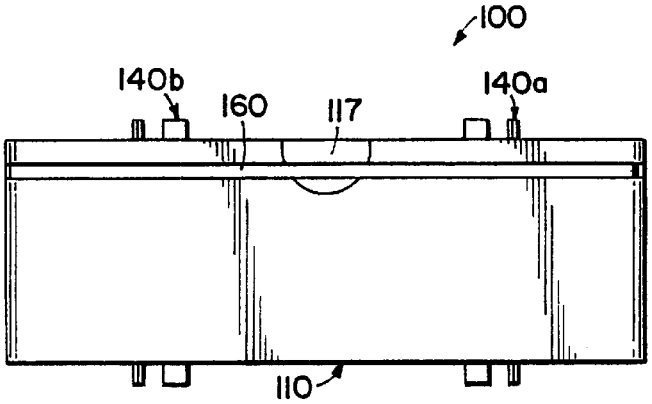
FIG. 4 is a front view of the dumbbell of FIG. 1 with a plurality of weights connected thereto.

FIG. 3 shows an end view of the block 110. A longitudinal notch 116 is provided in the block 110 to align with the notch 146 in the weight 140*a* and likewise accommodate the latch 160. This notch may be provided with outwardly divergent sidewalls, as well. A transverse notch 117 is provided in the block 110 to facilitate operation of the latch 160 as further explained below.

Figure 5:
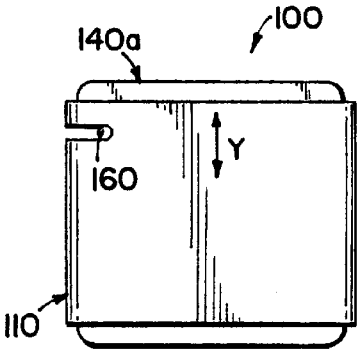
FIG. 5 is an end view of the dumbbell and weights of FIG. 4.
Figure 7:
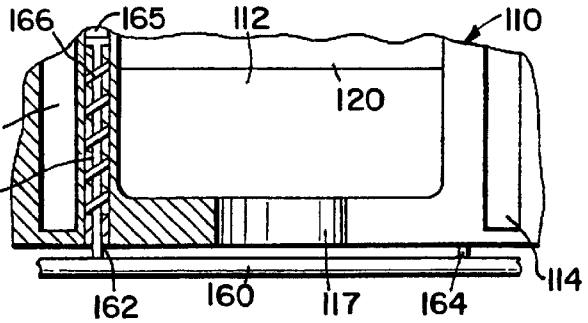
FIG. 7 is an enlarged and partially sectioned top view of a portion of the dumbbell of FIG. 1 with a latch portion occupying a discrete position relative to the remainder of the dumbbell.

As indicated by the arrows in FIG. 3, the latch 160 is movable in the direction X relative to the block 110. As shown in FIG. 7, the latch is movable (in the direction X) to a position outside the confines or planform of the block 110. When the latch 160 occupies the "open" position shown in FIG. 7, the weight 140*a* is freely movable in the direction Y (shown in FIG. 5) relative to the block 110. FIG. 5 shows the relative positions of the weights 140*a* and 140*b* and the block 110 when the notches 116 and 146 are aligned to receive the latch 160. When the weights 140*a* and 140*b* are latched in place, the longitudinal axis of the handle 120 is generally aligned with the inertia centers of the weights 140*a* and 140*b*.

When the latch 160 occupies the "closed" position shown in FIG. 5, the weight 140*a* is latched against movement relative to the block 110 (in the direction Y or otherwise). In particular, the relatively longer walls of the slot 114 prevent the weight 140*a* from moving axially relative to the handle 120; and the relatively shorter walls of the slot 114 prevent the weight 140*a* from moving in the radial direction X; and the latch 160 (along with the opposite, relatively shorter wall of the slot 114) prevents the weight 140*a* from moving in the radial direction Y.

FIG. 7 shows how the latch 160 is movably connected to the block 110. A cylindrical opening or bore 161 is provided in each of the end walls 111 of the block 110 to receive a respective shaft 164. Each shaft 164 has a first end connected to the latch 160 and a second, opposite end having a relatively large diameter head 165. A helical spring 166 is mounted on each shaft 164 and compressed between the head 165 and a plug 162 which inserts into the outer end of the opening 161 to secure the spring 166 and the head 165 therein. The spring 166 biases the latch 160 toward the notches 116 and 146 and the closed position shown in FIG. 5. The spring 166 acts in the direction X, perpendicular to the direction Y, and thus, is not subject to gravitational force acting on the weight 140*a*.

The notch 117 enables a person to "reach behind" the latch 160 and pull it toward the open position shown in FIG. 7. The relative sizes of the weights 140*a* and 140*b* and the block 110 are such that the block 110 may be pushed downward relative to the weights 140*a* and 140*b* to temporarily secure the latch 160 in the open position (bearing against the outside edges of the weights 140*a* and 140*b*). Subsequent upward movement of the block 110 relative to the weights 140*a* and 140*b* and/or downward movement of the weights 140*a* and 140*b* relative to the block 110 will cause the latch 160 to snap into the notches 116 and 146.

Figure 8:
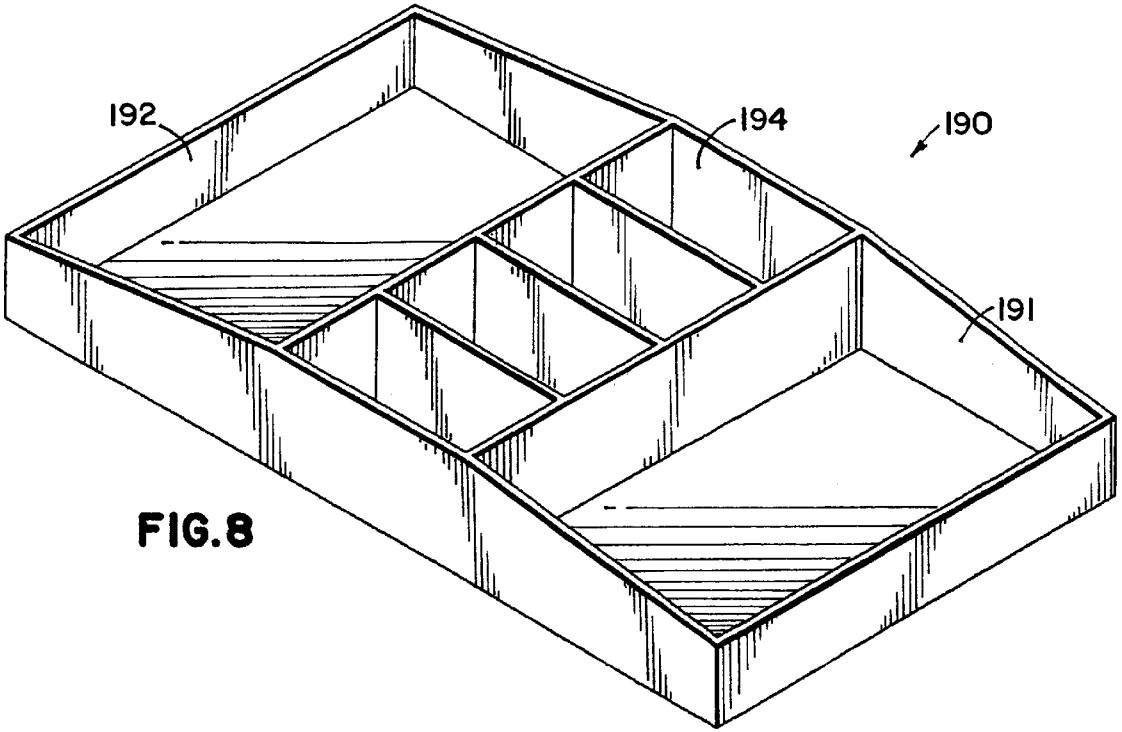
FIG. 8 is a perspective view of a base sized and configured to support two of the dumbbells of FIG. 1 and the weights of FIG. 4.

FIG. 8 shows a base or housing 190 which is sized and configured to receive two of the dumbbells 100 and up to eighty pounds of weights 140*a* and 140*b*. A first compartment 191 is provided for a first dumbbell 100, and a second compartment 192 is provided for a second dumbbell 100. Each of four compartments 194 is sized and configured to receive and accommodate twenty pounds of weights 140*a* and 140*b*. On one contemplated embodiment, twenty one-pound weights 140*a* and twelve five-pound weights 140*b* are provided together with two blocks 110 and one base 190. Assuming that each block 110 weighs fives pounds, this arrangement provides two dumbbells 100 which may be adjusted between five and forty-five pounds in one pound increments.

Among other things, those skilled in the art will recognize that the dumbbell 100 and/or the base 190 provide convenient and reliable means for holding the weights in place prior to selection; changing the amount of weight engaged for exercise motion; supporting the weights during exercise motion; and/or returning the weights to their proper location at the conclusion of exercise motion.

Some additional variations of the present invention are embodied on the dumbbell designated as 200 and described with reference to FIGS. 9–13. The dumbbell 200. similarly includes a block-shaped member 210, which is preferably one or two pieces of injection molded plastic. A central opening 212 is provided in the block 210 to receive and accommodate a person's hand. The opening 212 is bounded by opposing end walls 211. A cylindrical handle 220 is disposed within the opening 212 and extends perpendicularly between the end walls 211.

Eight upwardly opening slots or compartments 214 are provided in the block 210 to receive and accommodate weights 240*a* and 240*b*. The compartments 214 are bounded by a bottom wall 219, and the handle 220 is positioned to align more with the centers of inertia of the weights 240*a* and 240*b* within the compartments 214 than with the geometric center of the end walls 211 on the block 210. The compartments are bounded by flanges 213 rather than continuous intermediate walls. One compartment 214 on each side of the block 210 is sized and configured to receive one ten-pound weight 240*b*, and the other three compartments 214 on each side of the block 210 are sized and configured to receive up to five one-pound weights 240*a* or one five-pound weight. In other words, up to fifty pounds of weights 240*a* and 240*b* may be inserted into the block 210.

The weight 240*a* is a twelve gauge steel plate approximately six inches wide and six inches high (the weights 240*b* are similar in shape but ten times as thick). As on weights 140*a* and 140*b*, a notch is provided in each weight 240*a* and 240*b* to accommodate a latch or selector rod 260, as explained below. In addition, a hemispherical opening 245 is provided in each weight 240*a* and 240*b* to facilitate handling of the weights 240*a* and 240*b*.

Figure 11:
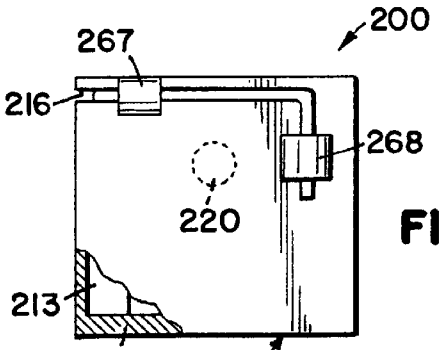
FIG. 11 is a partially sectioned end view of the dumbbell of FIG. 9.
Figure 10:
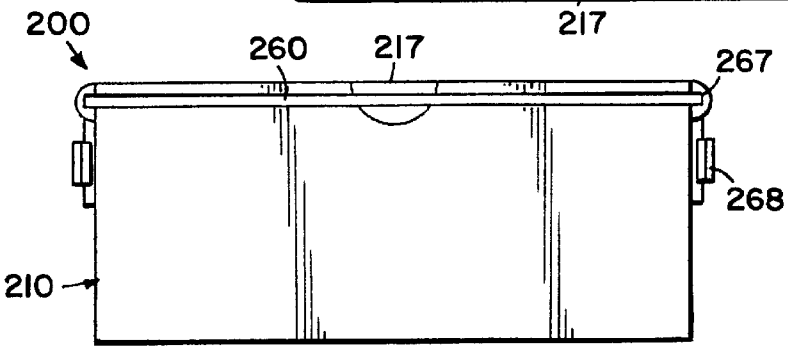
FIG. 10 is a front view of the dumbbell of FIG. 9.

FIG. 11 shows an end view of the block 210. A notch 216 is provided in the block 210 to align with the notches in the weights 240*a* and 240*b* and similarly receive the latch 260. A discrete notch 217 is provided in the block 210 to facilitate manipulation of the latch 260, as explained below.

Figure 13:
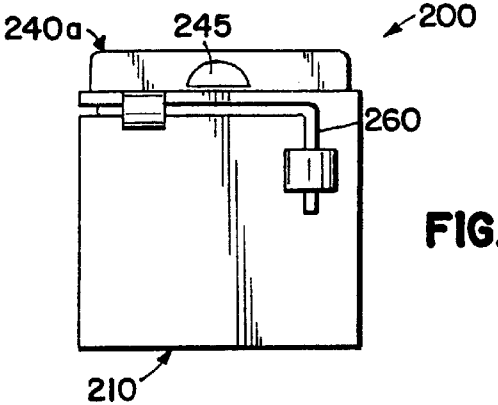
FIG. 13 is an end view of the dumbbell and weights of FIG. 12.
Figure 12:
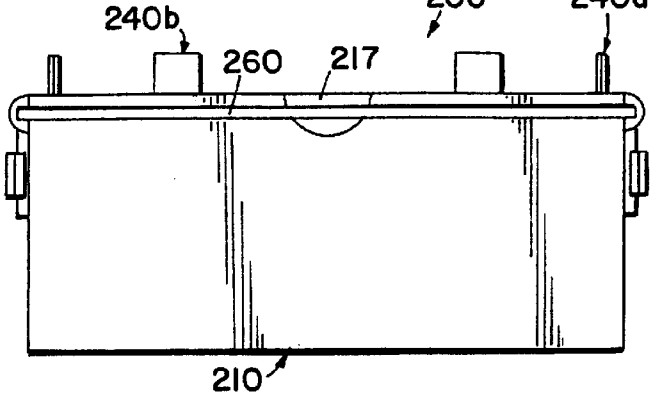
FIG. 12 is a front view of the dumbbell of FIG. 9 with a plurality of weights connected thereto.
Figure 14:
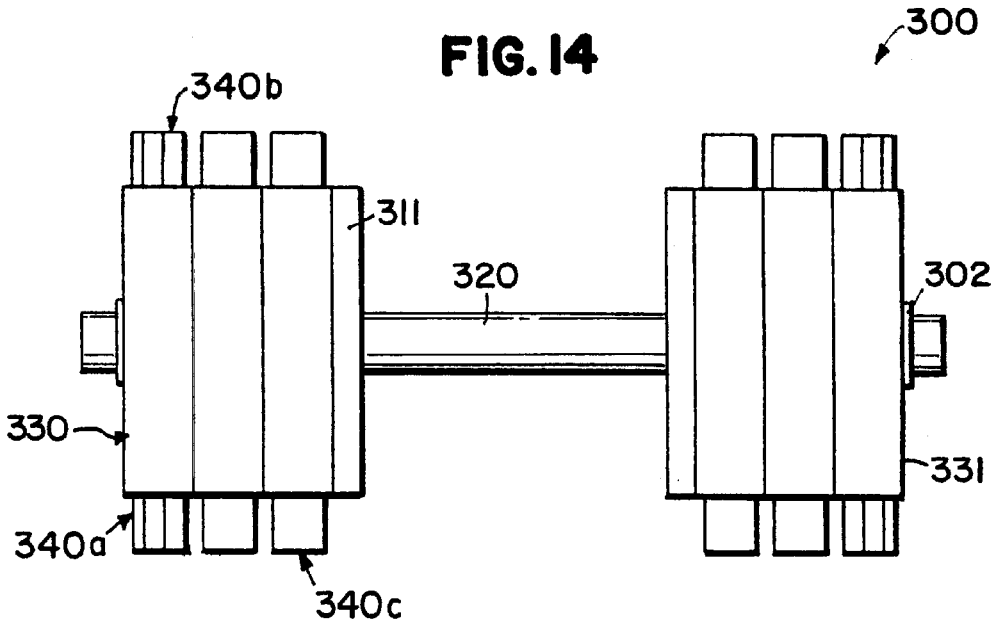
FIG. 14 is a front view of a third exercise dumbbell constructed according to the principles of the present invention.
Figure 15:
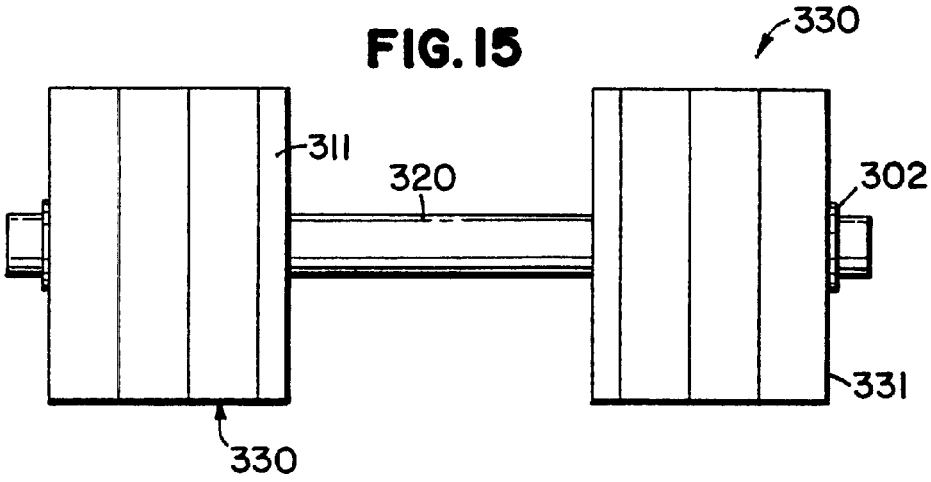
FIG. 15 is a front view of the dumbbell of FIG. 14 with the weights removed.

As in the case of the foregoing embodiment 100, the latch 260 is movable in a first, horizontal direction relative to the block 210 (with reference to the upright orientations shown in FIGS. 10–13). The latch 260 is movable between an open position, outside the planform of the block 210, and a closed position, shown in FIGS. 11 and 13. When the latch 260 occupies the open position, the weights 240*a* and 240*b* are movable in a second, vertical direction relative to the block 210. FIG. 13 shows the relative positions of the weights 240*a* and 240*b* and the block 210 when the notches are aligned to receive the latch 260. When the latch 260 occupies the closed position, the weights 240*a* and 240*b* are latched against movement relative to the block 110 (in any direction).

The latch 260 includes a middle portion which selectively occupies the notch 216, and opposite outside portions which extend perpendicularly away from the middle portion and overlie opposite outside walls 218 of the block 210, and opposite distal portions which extend perpendicularly away from respective outside portions and toward the bottom wall 219. The outside portions are slidably mounted to respective outside walls 218 by means of sleeve members 267, and the distal portions snap into and out of engagement with resilient clip members 268. The clip members 268 releasably retain the latch 260 in the closed position inside the notch 116. The arrangement is such that the clip members 268 are not subject to gravitational force acting on the weights 240*a* and 240*b*. Like on the dumbbell 100, the notch 217 enables a person to "reach behind" the latch 260 and pull it toward the open position.

A base similar to that shown in FIG. 8 may be provided for two of the dumbbells 200 and up to one hundred pounds of weights. On one contemplated embodiment, the base is sized and configured to receive and accommodate twenty one-pound weights 240*a*, eight five-pound weights (not shown), and four ten-pound weights 240*b*. Assuming that each block 210 weighs five pounds, this arrangement provides two dumbbells 200 which may be adjusted between five and fifty-five pounds in one pound increments.

Among other things, those skilled in the art will recognize that the dumbbell 200 provides convenient and reliable means for enclosing the weights during exercise motion, as well as holding the weights in place prior to selection; changing the amount of weight engaged for exercise motion; supporting the weights during exercise motion; and/or returning the weights to their proper location at the conclusion of exercise motion.

Figure 105:
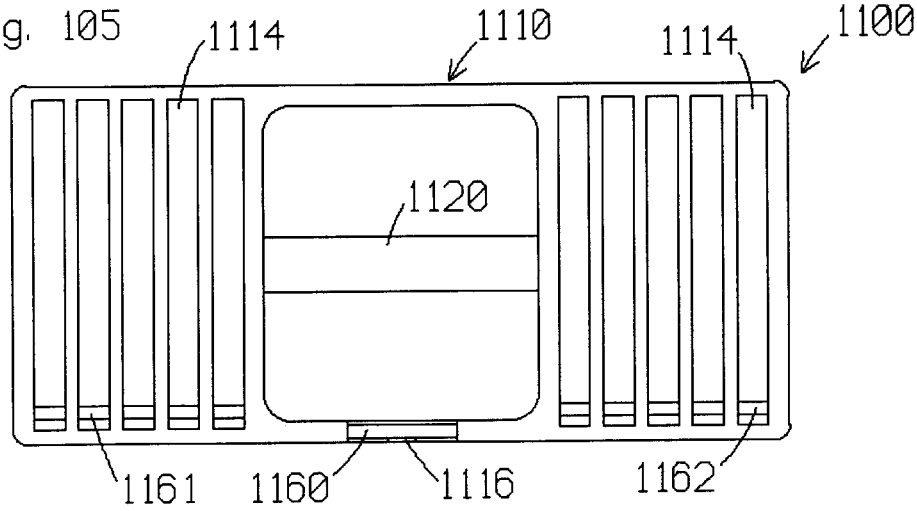
FIG. 105 is a top view of another dumbbell constructed according to the principles of the present invention.
Figure 106:
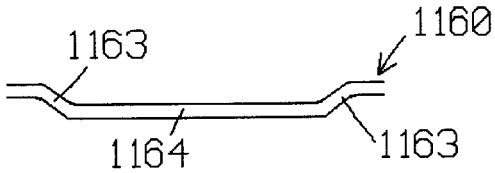
FIG. 106 is a fragmented, top view of a selector pin on the dumbbell of FIG. 105.
Figure 107:
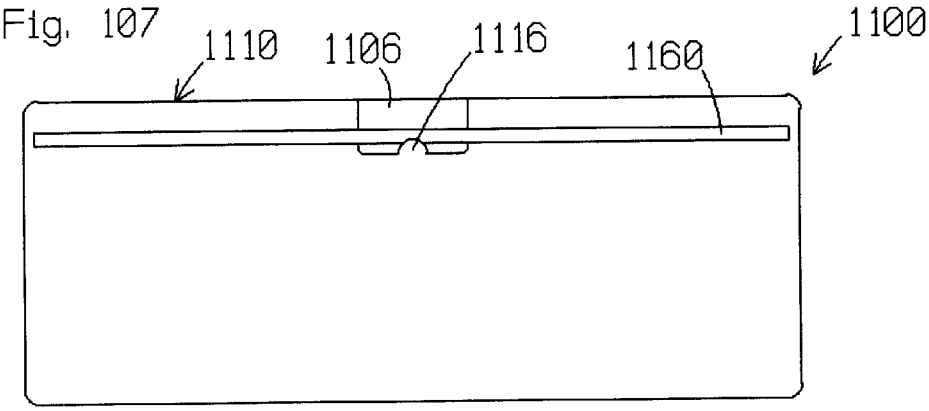
FIG. 107 is a front view of the dumbbell of FIG. 105.
Figure 111:
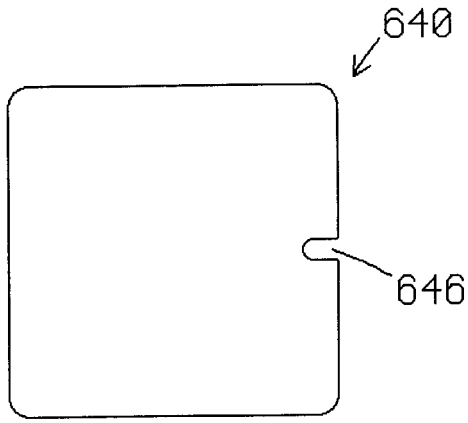
FIG. 111 is an end view of a weight plate suitable for use with the dumbbell of FIG. 108.
Figures 112, 113:
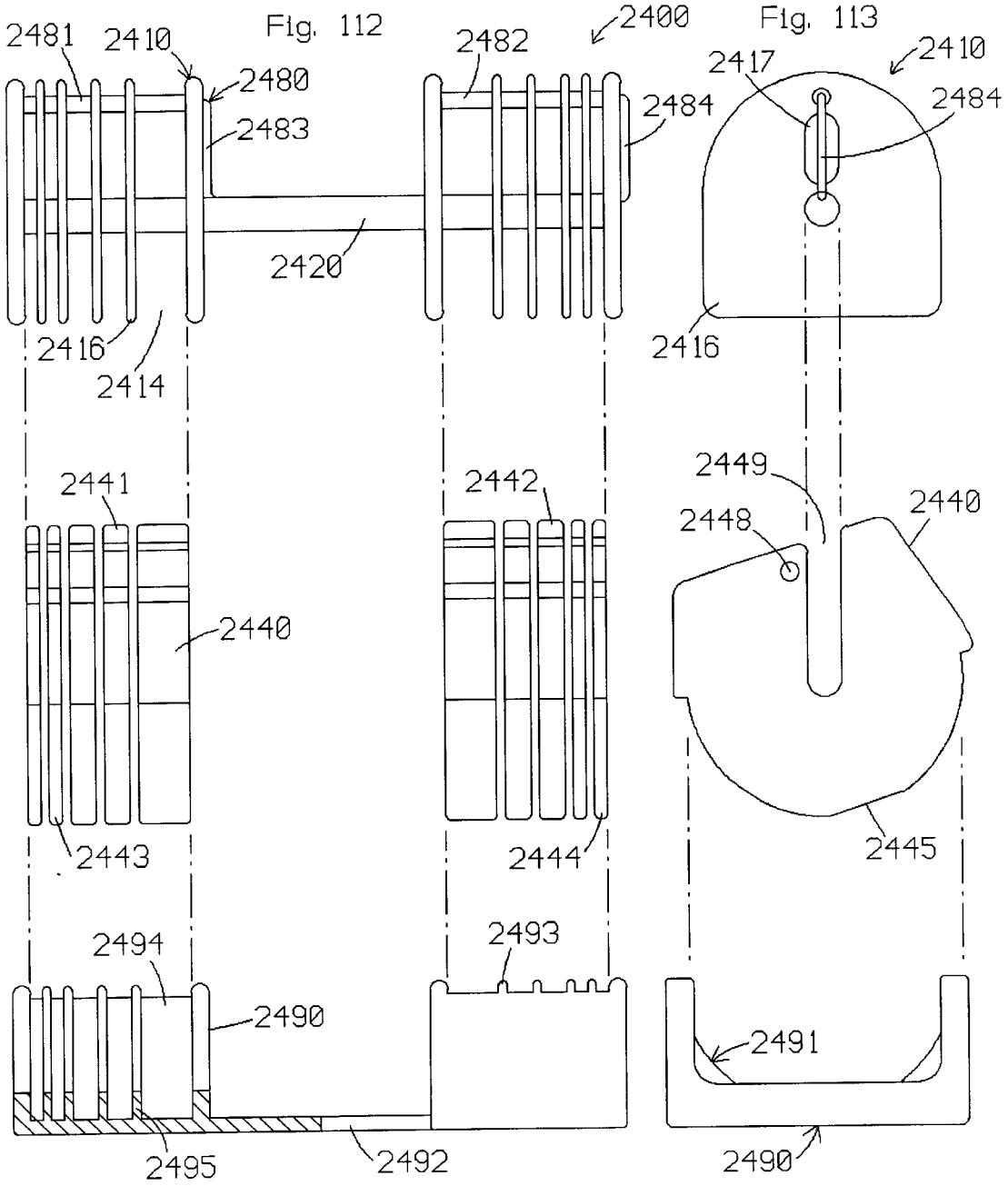
FIG. 112 is a front view of a dumbbell handle assembly, dumbbell weight plates, and a weight plate holder constructed according to the principles of the present invention and aligned relative to one another.
FIG. 113 is an end view of the items shown in FIG. 112 aligned relative to one another.

Additional variations of the present invention are embodied on a dumbbell designated as 1100 in FIGS. 105 and 107. Among other things, FIGS. 105–107 show an alternative selector pin arrangement suitable for use on dumbbells like those designated as 100 and 200. Generally speaking, the dumbbell 1100 includes a base 1110 with a handle 1120 and weight compartments 1114 disposed at opposite ends of the handle 1120. The compartments 1114 are configured to hold weights 140 that are of like size, but alternatively, may be configured to hold weights of different sizes. An elongate slot is provided in the base 1110 and cuts across each of the compartments 1114 to receive a selector pin 1160. As shown in FIG. 6, a notch is provided in each of the weights to align with the slot and receive the selector pin 1160.

The selector pin 1160 includes opposite first and second weight engaging segments 1161 and 1162 and an intermediate segment 1164 rigidly interconnected therebetween. The intermediate segment 1164 extends parallel to the weight engaging segments 1161 and 1162 but is radially offset by means of angled segments 1163. As a result of the offset, the weight engaging segments 1161 and 1162 can engage the weights 1140 without causing interference between the intermediate segment 1164 and the handle 1120.

A notch 1106 in the base 1110 facilitates grasping of the selector pin 1160 for purposes of moving same into and out of the slot in the base 1110. When the pin 1160 occupies the position shown in FIG. 105, any properly positioned weights are secured to the base by respective weight engaging portions 1161 and 1162. When the pin 1160 is pulled outward from the base 1110, weights may be removed from the compartments 1114 or inserted into vacant compartments 1114 at the discretion of the user. A resilient tab 1116 overlies the notch 1106 to provide a means for encouraging the pin 1160 to remain in the position shown in FIG. 105.

Among other things, the subject invention may be described, for example, along the following lines. An adjustable exercise weight system, comprising: a base that includes a handle and weight supports at opposite ends of the handle; and a selector rod that includes first and second segments which are movable radially into engagement with respective weight supports, and an intermediate segment which is interconnected between the first and second segments and offset radially relative thereto.

FIGS. 108–111 show a dumbbell 600 which is similar in many respects to the previous embodiment 1110, as well as the dumbbells 100 and 200. Generally speaking, the dumbbell 600 includes a base 610 having a handle 620 and weight compartments 651 and 652 at opposite ends of the handle 620. The compartments 651 and 652 are configured to hold weights like the weight 640 shown in FIG. 111. Opposite end slots are provided in the base 610 and cut across respective compartments 651 and 652 to receive respective portions 661 and 662 of a selector pin 660 (which are also configured to enter notches 646 in the weights 640). An intermediate pin portion 664 is interconnected between the weight engaging portions 661 and 662 by means of radially extending portions 663. As a result of the radial offset, the intermediate portion 664 rests adjacent the handle 620 when the weight engaging segments 661 and 662 are moved into engagement with any weights 640 within the compartments 651 and 652.

The radially extending portions 663 remain accessible to facilitate movement of the selector pin 660 into and out of the slots in the base 610. When the pin 660 occupies the position shown in FIG. 109, any properly positioned weights 640 are secured to the base by respective weight engaging portions 661 and 662. When the pin 660 is pulled outward from the base 610 to the position shown in FIG. 108, weights 640 may be removed from the compartments 651 and 652 or inserted into vacant compartments 651 and 652 at the discretion of the user. The user holds the intermediate portion 664 of the pin 660 against the handle 620 to encourage the pin 660 to remain in the position shown in FIG. 109. An axially extending slot is provided in the handle 620 to receive the intermediate portion 664 of the pin 660. As suggested by FIG. 109, the upper and lower halves of the base 610 are identical and thus, can be made from a single mold and secured together by rivets 601 or other suitable means to provide the base 610 with the aforementioned slots incorporated therein.

Among other things, the subject invention may be described, for example, as an adjustable exercise weight system, comprising: a base which includes a handle and weight supports at opposite ends of the handle; and a selector rod which includes first and second segments which are movable into engagement with respective weights, and an intermediate segment interconnected between the first and second segments and selectively held adjacent the handle.

FIGS. 97–104 show a dumbbell 2300 having two different weight selection systems, including a half-weight selection system that uses an "offset" selector rod 2370 which is similar in some respects to those discussed above. Generally speaking, the dumbbell 2300 includes a handle 2320 and downwardly opening boxes 2312 secured to opposite ends of the handle 2320, thereby defining a base 2310. Opposite side supports 2360 are also interconnected between the boxes 2312 to house respective, opposite side selector rods 2361 and 2362, as well as enhance the structural integrity of the base 2310. Each of the boxes 2312 is divided into weight receiving compartments 2317 and 2319 by means of walls or spacers 2323. The innermost compartment 2317 on each end of the base 2310 is sized and configured to receive a relatively smaller weight plate 2380, and the remaining compartments 2319 on each end of the base 2310 are sized and configured to receive relatively larger weight plates 2390, which weigh twice as much as the plates 2380.

Figures 100, 101, 102, 103:
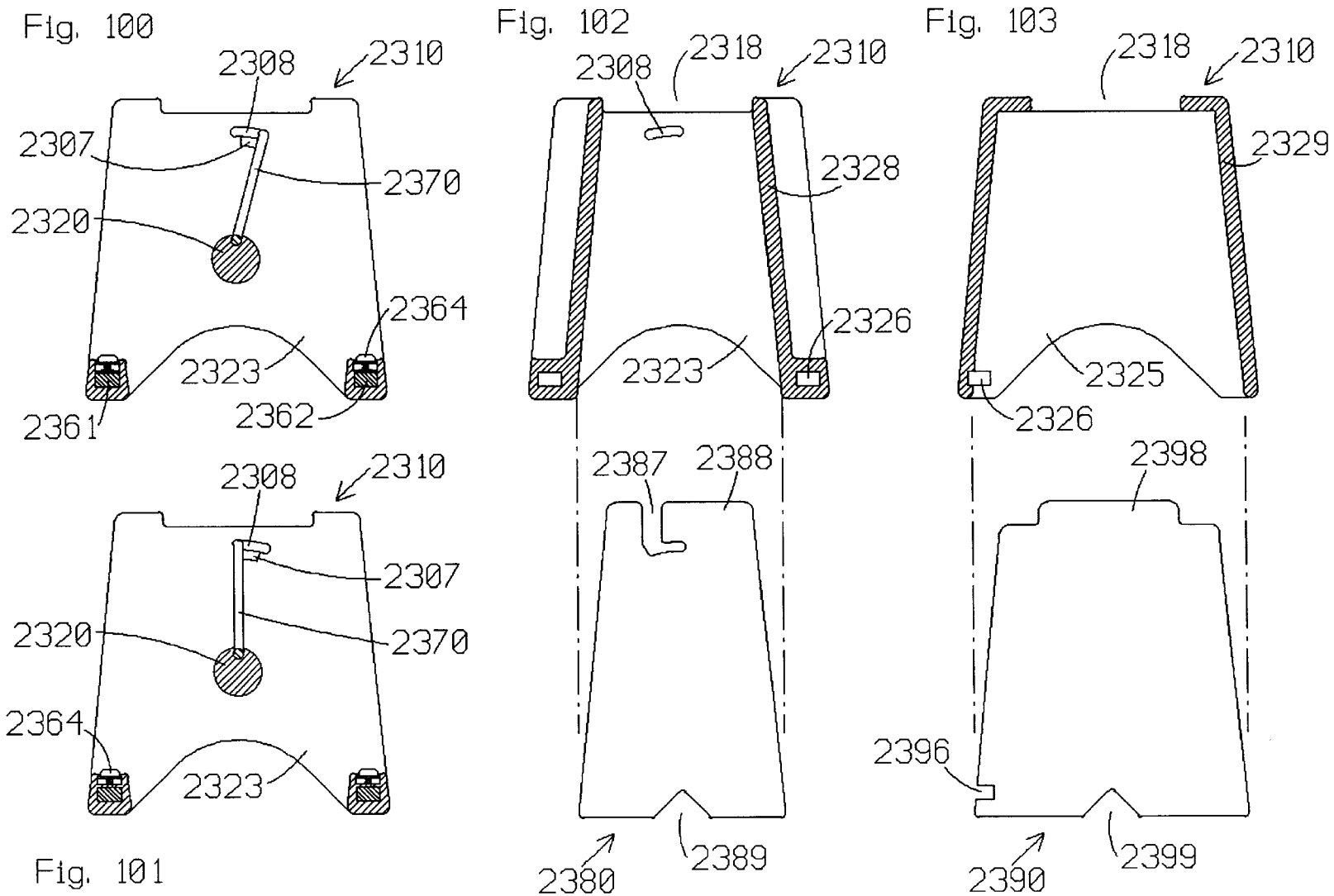
FIG. 100 is a sectioned end view of the handle assembly shown in FIG. 98.
FIG. 101 is a sectioned end view of the handle assembly of FIG. 100, with a supplemental selector rod in a different orientation.
FIG. 102 is another sectioned end view of the handle assembly of FIG. 98, shown in alignment with one of the supplemental weight plates of FIG. 98.
FIG. 103 is yet another sectioned end view of the handle assembly of FIG. 98, shown in alignment with one of the primary weight plates shown in FIG. 98.

A separate selector rod 2370 is provided to selectively engage only the "half-weights" 2380. The selector rod 2370 has first and second weight engaging segments 2371 and 2372 which project into respective compartments 2317, and which are rigidly interconnected by a radially offset intermediate segment that nests within the handle 2320. As shown in FIGS. 100–101, the segments 2371 and 2372 project through respective arcuate slots 2308, and the selector rod 2370 is rotatable between opposite ends of the slot 2308. Nubs 2307 project outward from the opposing faces of the innermost walls 2323 to discourage undesired movement of the selector rod 2370 from one orientation to the other.

As shown in FIG. 102, which constitutes an opposite end view relative to those of FIGS. 100–101, the weight plate 2380 fits between opposite sidewalls 2328 on the base 2310, and the slot 2308 aligns with the lower portion of an opening 2387 in the plate 2380. The upper portion of the opening 2387 extends vertically upward from the lower portion to the upper edge 2388 of the plate 2380. When the respective weight engaging segment 2371 or 2372 is vertically aligned with the upper portion of the opening 2387, the selector rod 2370 and the remainder of the base 2310 are free to move upward relative to the weight plate 2380. On the other hand, when the respective weight engaging segment 2371 or 2372 is rotated to an opposite end of the lower portion of the opening 2387, the weight plate 2380 is constrained to move upward (and elsewhere) together with the selector rod 2380 and the remainder of the base 2310.

As shown in FIG. 103, the weight plate 2390 fits between opposite sidewalls 2329 on the base 2310, and a notch 2396 in the weight plate 2390 aligns with an opening 2326 extending through adjacent portions of the spacers 2325 (and 2323) and one of the sidewalls 2329. In the absence of a respective selector rod 2361 or 2362, the base 2310 is free to move upward relative to the weight plate 2390. On the other hand, when a respective selector rod 2361 or 2362 is moved through the notch 2396, the associated weight plate 2390 is constrained to move upward (and elsewhere) together with the base 2310. The upper end 2398 of the weight plate 2390 is shaped similar to the upper end 2388 of the half-weight plate 2380, and both are sized and configured to fit through respective openings 2318 in the base 2310.

Figure 104:
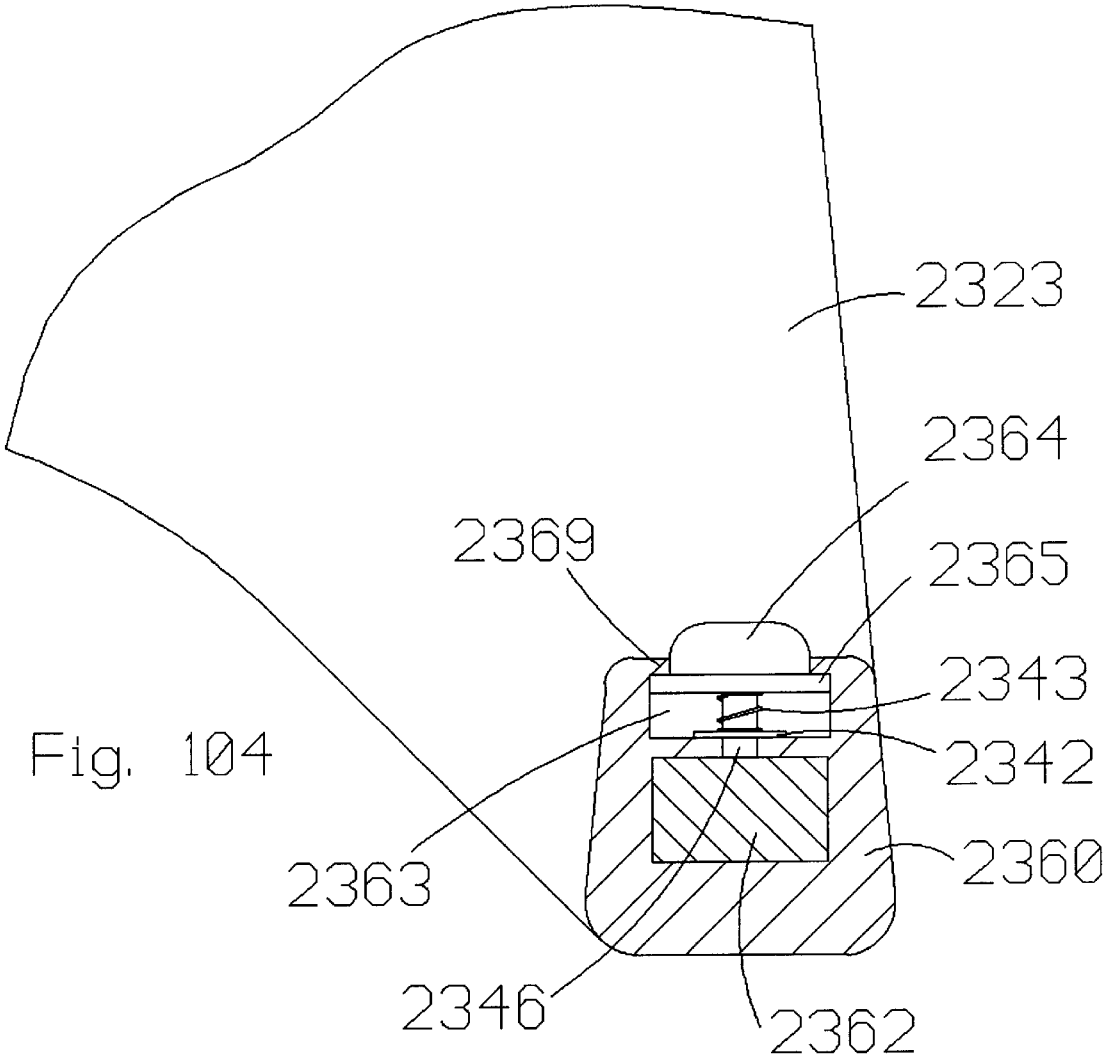
FIG. 104 is an enlarged, sectioned end view of a portion of the handle assembly shown in FIGS. 100–101.

Each of the selector rods 2361 and 2362 is independently movable into engagement with a desired number of weight plates 2390 on a respective end of the dumbbell 2300. FIG. 104 shows how the selector rod 2362 is moved and biased to remain in a desired position relative to the base 2310. The support 2360 is provided with a channel 2363 disposed above the opening 2326. A post 2346 is rigidly secured to the selector rod 2362 and extends upward through the channel 2363. A stop 2342 is rigidly secured to an intermediate portion of the post 2346 and occupies a lowermost position within the channel 2363. A button 2364 is slidably mounted on the post 2346, and opposite sides of a bottom plate 2365 on the button 2364 extend beneath opposing shoulders 2369 on the support 2360 to retain the button 2364 within the channel 2363. A spring 2343 is compressed between the plate 2365 and the stop 2342 to bias the button 2364 upward against the shoulders 2369. The plate 2365 is provided with opposite side tabs 2366 which project upward and engage opposite side openings 2368 in the shoulders 2369. The distance between openings 2368 is equal to the combined thickness of a weight plate 2390 and a spacer 2323.

Figure 98:
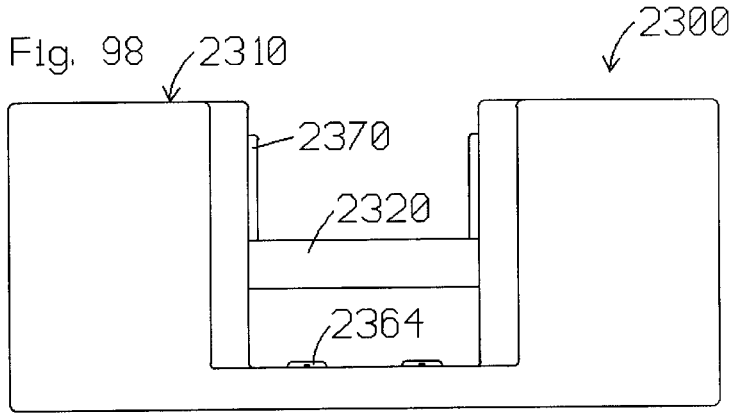
FIG. 98 is a front view of components of the dumbbell of FIG. 97, including a dumbbell handle assembly, weight plates, and a weight plate holder in alignment relative to one another.
Figure 99:
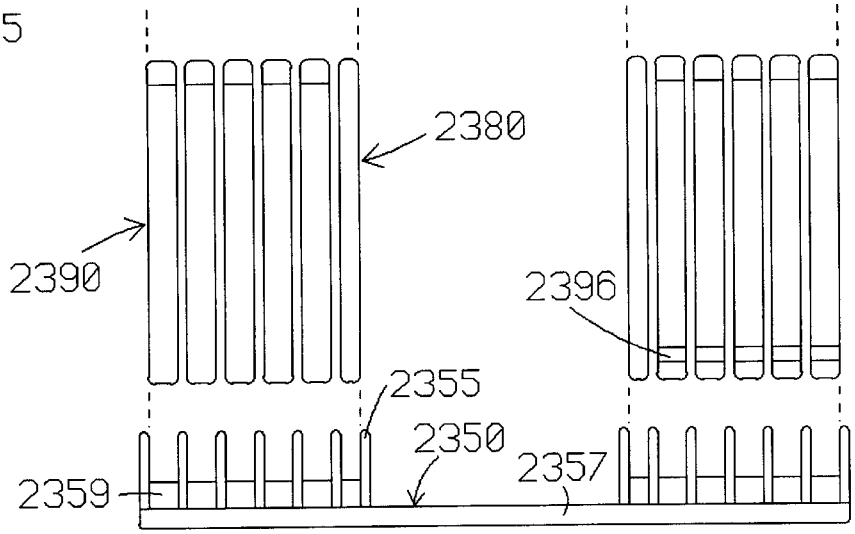
FIG. 99 is an end view of the handle assembly shown in FIG. 98.

FIG. 98 shows a cradle 2350 suitable for holding the weight plates 2380 and 2390 when not in use. The cradle 2350 includes a bottom wall 2357 and spacers 2355 that extend upward from the bottom wall 2357 and align with the walls 2323 and 2325 on the base 2310. The spacers 2355 are sized and configured to fit within the notches 2315 in the walls 2323 and 2325 (shown in FIG. 97). A ridge 2359, having a V-shaped profile, extends upward from the bottom wall 2357 of the cradle 2350 and cooperates with similarly sized and shaped notches 2389 and 2399 in respective weight plates 2380 and 2390 to maintain same in position relative to one another.

Assuming that the base 2310 weighs ten pounds, and the plates 2380 weigh two and one-half pounds each, and the plates 2390 weight five pounds each, the dumbbell 2300 is capable of providing balanced weight resistance of ten pounds to sixty-five pounds in increments of five pounds. If balance is not a critical concern, the plates 2380 could alternatively weight one and one-quarter pounds each in order to provide increments of two and one-half pounds (with the five pound increments provided by engaging an additional plate 2390 on only one end of the dumbbell 2300).

The foregoing embodiment 2300 may also be described in terms of an adjustable exercise weight system, comprising: a base which includes a handle and weight supports at opposite ends of the handle; weights sized and configured for engagement by the weight supports; and selector rods which are movable relative to the handle and into engagement with any of the weights at respective ends of the handle. The selector rods may be nested within sidewalls which form the weight supports and/or may be stored between the weights. In addition and/or the alternative, secondary weights may be provided for selection by alternative means and without interfering with operation of the selector rods. One such secondary system includes opposite side selector segments which are simultaneously movable into engagement with respective secondary weights and/or are radially offset relative to an intermediate segment interconnected therebetween.

Figure 16:
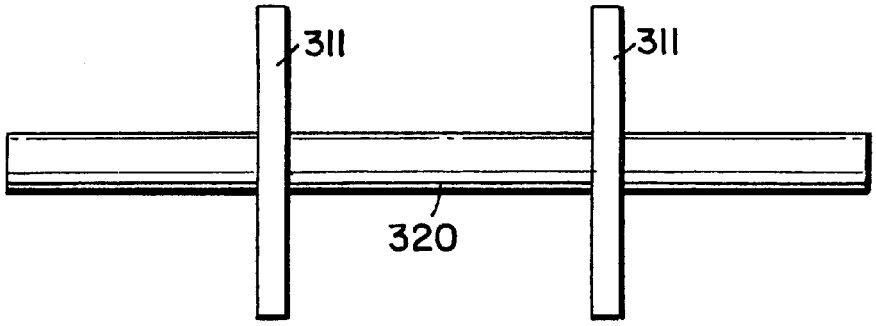
FIG. 16 is a front view of the dumbbell of FIG. 14 with the weights and the weight supports removed.

Additional variations of the present invention are embodied on a dumbbell designated as 300 in FIGS. 14–21. As shown in FIG. 16, the dumbbell 300 has a cylindrical bar 320 which is approximately sixteen inches long and one inch in diameter. Rigid plates 311 are secured to the bar 320 at locations about six inches apart from one another, thereby defining an intermediate handle portion and opposite distal portions.

Three weight supports or housings 330 are mounted on each of the distal portions of the bar 320, adjacent a respective plate 311. As shown in FIGS. 17–19, each housing 330 has a rectangular end wall 331 and opposite side walls or shoulders 337. A hole 332 is formed through the end wall 331 to receive the bar 320, and each housing 330 is mounted on the bar 320 in such a manner that the end wall 331 is relatively distant from the plates 311. The plates 311 have the same rectangular shape as the end walls 331.

The innermost housing 330 on each side of the bar 320 cooperates with a respective plate 311 to define a weight compartment or slot. The intermediate housing 330 on each side of the bar 320 cooperates with the end wall 331 of a respective innermost housing 330 to likewise define a weight compartment or slot. Similarly, the outermost housing 330 on each side of the bar 320 cooperates with the end wall 331 of a respective intermediate housing 330 to likewise define a weight compartment or slot. Posts 338 on the housings 330 cooperate with holes 339 in adjacent housings 330 and the plates 311 to maintain alignment and facilitate interconnection of the parts. A fastener 302 is fixedly mounted on each end of the bar 320 to prevent axial movement of the housings 330 relative to the bar 320.

Leaf springs 334 are provided on opposite sides of the housing 330. The leaf springs 334 may be described as inwardly convex and/or as having inwardly projecting portions 335 which are generally arcuate in shape. As explained below, the integral leaf springs 334 perform both the latching and biasing functions which required discrete components on the previous embodiments. Openings 336 are provided in the end wall 331 to facilitate injection molding process which makes the housings 330.

Each compartment on the dumbbell 300 is sized and configured to receive up to five pounds of weight, for example. In this regard, each compartment may support five one-pound weights 340*a*, or two two-pound weights 340*b* and one one-pound weight 340*a*, or one five-pound weight 340*c*. In other words, up to thirty pounds of weights 340*a*–340*c* may be inserted into the compartments on the dumbbell 300. A base similar to that shown in FIG. 8 may be provided for two of the dumbbells 300 and up to sixty pounds of weights. On one contemplated embodiment, the base is sized and configured to receive and accommodate four one-pound weights 340*a*, eight two-pound weights 340*b*, and eight five-pound weights 340*c*. Assuming that each "empty" dumbbell 300 weighs three pounds, this arrangement provides two dumbbells 300 which may be adjusted between three and thirty-three pounds in one pound increments.

Figure 20:
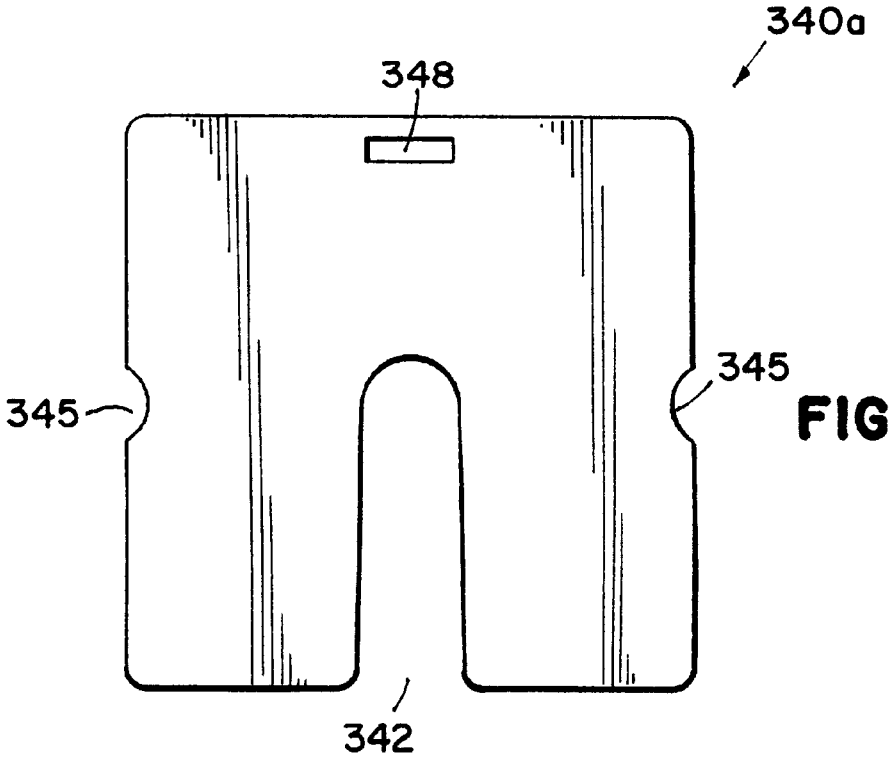
FIG. 20 is an end view of one of the weights on the dumbbell of FIG. 14.

The weight 340*a* is a twelve gauge steel plate approximately six inches wide and seven inches high (the weights 240*b* are similar in shape but twice as thick, and the weights 240*c* are similar in shape but five times as thick). As shown in FIG. 20, a relatively deep, central notch 342 is provided in each weight 340*a*–340*c* to accommodate the bar 320. Relatively shallow, arcuate notches 345 are provided in opposite sides of each weight 340*a*–340*c* to interact with the arcuate portions 335 of the leaf springs 334. In particular, as the weight 340*a* is inserted into a compartment, the peripheral edges of the weight 340*a* encounter the opposing leaf springs 334 and force the latter away from one another. When the arcuate portions 335 of the leaf springs 334 encounter the notches 345, the former snap toward one another and into the latter to bias the weight 340*a* against further movement relative to the housing 330.

The weights 340*a*–340*c* may be removed from the compartments by pushing the assembly downward against a floor surface. Under such circumstances, the weights 340*a*–340*c* are first to encounter the floor and thus, are subjected to an upward force equal in magnitude to the downward force. When the force is sufficient to overcome the biasing effect of the leaf springs 334, the arcuate portions 335 deflect away from one another and out of the notches 345. Once the arcuate portions 335 are bearing against the linear edges of the weights 340*a*–340*c*, the leaf springs 334 offer little resistance to removal of the weights 340*a*–340*c*.

Figure 21:
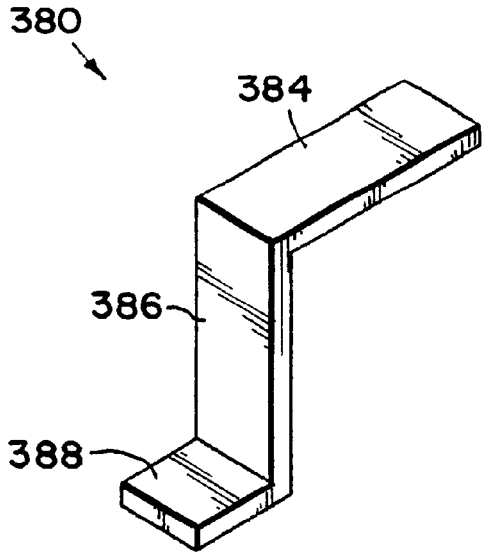
FIG. 21 is a perspective view of an optional tool suitable for use together with the dumbbell of FIG. 14.

An alternative method of removing the weights 340*a*–340*c* from the compartments may be described with reference to an optional opening 348 shown in the weight 340*a* in FIG. 20 and an optional tool 380 shown in FIG. 21. The tool 380 has a first distal portion 384 sized and configured for grasping, an intermediate portion or offset 386, and a second distal portion 388 sized and configured for insertion into the opening 348 in the weight 340*a*. The tool 380 essentially allows a user to "grab" any of the weights 340*a*–340*c* and exert a sufficiently large pulling force to extract same from a weight housing 330.

Among other things, those skilled in the art will recognize that the dumbbell 300 provides convenient and reliable means for holding the weights in place prior to selection; changing the amount of weight engaged for exercise motion; supporting the weights during exercise motion; and/or returning the weights to their proper location at the conclusion of exercise motion.

Still another dumbbell constructed according to the principles of the present invention is designated as 400 in FIGS. 22–29. The dumbbell 400 generally includes a handle assembly 410, a plurality of weights 440*a*–440*h* which are selectively connected to the handle assembly 410, and a base 490 which supports any of the weights 440*a*–440*h* that are not connected to the handle assembly 410.

The handle assembly 410 includes first and second plates 411 which are oval in shape. The plates 411 are rigidly secured to a cylindrical bar 420 at discrete locations spaced about six inches apart from one another. The bar 420 has an outside diameter of approximately one inch and is approximately sixteen inches long. The plates 411 cooperate with the bar 420 to define an intermediate bar portion which is sized and configured for grasping, as well as opposite distal ends of the bar 420. A rod 418 is rigidly secured between the plates 411 for reasons explained below.

A latch 430 is movably connected to the plates 411. The latch 430 may be described as equal in length to the bar 420 and extending parallel thereto. Optional end plates, similar in size and shape to the plates 411, for example, may be secured to the opposite, distal ends of the bar 420 to eliminate any perceived or potential hazard posed by protruding ends. The latch 430 moves within generally L-shaped slots 413 in the plates 411 (primarily in the radial direction designated as Y in FIG. 24). The latch 430 is movable between a "closed" position, shown in FIGS. 22–23, and an "open" position, shown in FIGS. 24–25, as more fully explained below.

The handle assembly 410 further includes a means for locking the latch 430 in either position relative to the plates 411. In particular, a relatively long tube 432 is movably mounted on the latch 430 between the plates 411. One end of the tube 432 has a relatively larger inside diameter which is bounded axially by a shoulder or rim 434. A relatively smaller tubular member 436 is mounted on the latch 430 proximate the larger diameter end of the long tube 432. A helical spring 438 is disposed within the larger diameter end of the tube 432 and compressed between the member 436 and the rim 434. The spring 438 biases the tube 432 away from the member 436.

Figure 23:
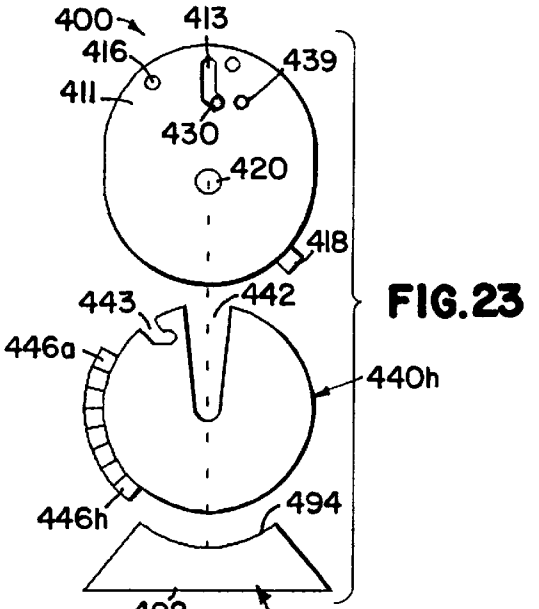
FIG. 23 is an end view of the dumbbell of FIG. 22, shown relative to an underlying base.
Figure 25:
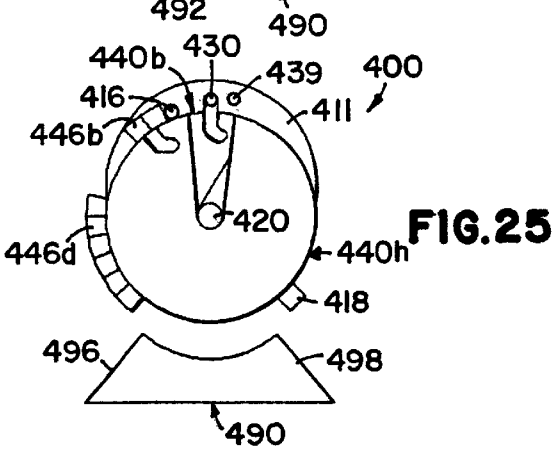
FIG. 25 is an end view of the dumbbell of FIG. 22, shown in a second selective configuration and relative to the underlying base first shown in FIG. 23.
Figure 27:
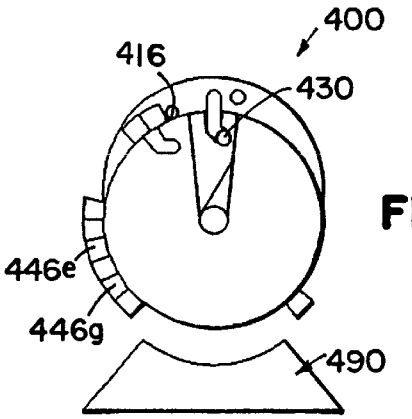
FIG. 27 is an end view of the dumbbell of FIG. 22, shown in a third selective configuration and relative to the underlying base first shown in FIG. 23.

A peg 439 projects from an opposite end of the tube 432 and parallel to the latch 430. As shown in FIG. 23, the peg 439 inserts into a first, radially inward hole in the plate 411 to secure or lock the latch 430 in the closed position. As shown in FIG. 25, the peg 439 inserts into a second, radially outward hole in the plate 411 to secure or lock the latch 430 in the open position. Movement of the tube 432 against the force of the spring 438 and toward the member 436 unlocks the latch 430 and allows it to be moved between the open position and the closed position. In other words, the latch 430 moves in a first, radial direction Y between a closed position and an open position, and the tube 432 moves in a second, axial direction X to lock and unlock the latch 430.

Each of the weights 440*a*–440*h* includes identical first and second plates 444, and a respective connector rod 446*a*–446*h* rigidly interconnected therebetween. Each plate 444 may be described as disc-shaped and includes a first, relatively large notch 442 to receive and accommodate the handle bar 420, and a second, generally L-shaped notch 443 which coincides in size and shape with a portion of the slots 413 in the plates 411.

The rod 446*a* is relatively short, and the weight 440*a* is disposed between the plates 444 on the other weights 440*b*–440*h*. The rod 446*h* is relatively long, and the plates 444 on the weight 440*h* are disposed outside the other weights 440*a*–440*g*. The rods 446*b*–446*g* and the plates 444 on the weights 440*b*–440*g* fall in between these two extremes.

The weights 440*a*–440*h* are supported by a base 490 when not carried away together with the handle assembly 410. The base 490 has a flat bottom surface 492 and an arcuate top surface 494. The top surface 494 coincides with the lower periphery of the plates 411 and 444 and supports same in cup-like fashion. The base 490 has opposing side walls or surfaces 496 and 498 which extend in convergent fashion from opposite edges of the bottom surface 492 to opposite edges of the top surface 494. The side walls 496 and 498 cooperate with the rods 446*h* and 418, respectively, to maintain the weights 440*a*–440*h* and the handle assembly 410 in relative alignment. In particular, when the rods 446*h* and 418 abut respective side walls 496 and 498, the slots 413 in the plates 411 are disposed within the confines of the notches 442 in the plates 444 on the weight 440*h*. The same is true for each of the other weights 440*a*–440*g* having a respective rod 446*a*–446*g* rotated as far as possible toward the side wall 496.

A peg or stop 416 is provided on each of the plates 411 to facilitate alignment of the notches 443 relative to the slots 413. The pegs 416 project toward one another from respective plates 411 at a radial distance from the bar 420 equal to the radial distance between the rods 440*a*–440*h* and the bar 420. As a result, the rod 446*a* encounters the pegs 416 as the weight 440*a* is rotated relative to the handle assembly 410 and away from the surface 496 on the base 490. When the rod 446*a* abuts the pegs 416, the notches 443 in the plates 444 on the weight 440*a* align with the slots 413 in the plates 411, thereby allowing the latch 430 to occupy the radially inward ends of the notches 443, as well as the radially inward ends of the slots 413.

FIGS. 112–115 show a dumbbell 2400 having a selector pin 2480 with radially offset weight engaging portions (like the dumbbell 2000), and weight plates 2440–2444 that are selectively rotatable into and out of orientations suitable for engagement by the selector pin 2480 (like the previous embodiment 400).

The weight plates 2440–2444 weigh different amounts but have the same cross-section. In particular, each of the plates 2440–2444 may be described in terms of a trapezoidal upper half and a semi-circular lower half. A central edge portion of the lower half is interrupted by a flat bottom surface 2445. Opposite side shoulders 2446 and 2447 are defined at opposite side junctures between the two halves. An elongate slot 2449 extends into a flat upper surface of the upper half, disposed opposite the bottom surface 2445. The slot 2449 defines an angle of fifteen degrees relative to the parallel top and bottom surfaces. A hole 2448 extends through the upper half proximate the top surface and along a center line drawn perpendicular to the top and bottom surfaces.

For weight plates 2440–2444 weighing 20 pounds, 10 pounds, 5 pounds, 2½ pounds, and 1¼ pounds, respectively, the combined pairs of weights 2440–2444 can be selected in any combination between zero and 77½ pounds in increments of 2½ pounds. In this instance, the depicted weight plates 2442 and 2444 are one-half as dense as the depicted weight plates 2441 and 2443. The reduced density may be obtained by using a less dense material to make the plates 2442 and 2444, and/or by removing material from the interior of the plates 2442 and 2444.

The base 2410 includes a handle 2420 having a longitudinal axis, axially distributed spacers 2416 secured to the handle 2420, and the selector pin 2480. The spacers 2416 have round tops and square bottoms, and cooperate to define weight receiving gaps 2414 therebetween. The bottoms of the spacers 2416 are sized and configured to fit inside respective dividers on the cradle 2490. Each spacer 2416 is provided with a hole 2418 similar in size to the holes 2448 in the weights and disposed at the same radial distance from the handle 2420. Openings 2417 are provided in one of the end spacers 2416 to facilitate withdrawal of the selector rod 2480.

The selector rod 2480 has weight engaging portions 2481 and 2482 that are relatively larger in diameter than the radial portions 2483 and 2484 the intermediate portion (nested inside the handle 2420). An advantage of this arrangement is that the relatively thicker portions 2481 and 2482 are well suited for supporting weight, and the relatively thinner portions are less obtrusive. The weight bearing portions 2481 and 2482 are axially movable into and out of respective weight accommodating gaps 2414 to selectively latch any desired weight plates 2440–2444 to the base 2410. The selector rod 2480 may be latched to the base 2410 by any suitable means discussed with reference to other embodiments.

When free of the base 410, the weight plates 2440–2444 rest in a cradle or weight holder 2490. The cradle 2490 provides individual weight compartments 2494 at opposite ends of a bottom panel 2492. Each compartment 2494 is bounded by an arcuate bottom wall 2491 and U-shaped dividers which include a transverse portion 2495 and opposite upright portions 2493. The arcuate bottom wall 2491 extends upward on opposite sides of the cradle 2490 and terminates in opposite side ledges 2496 and 2497.

Figure 114:
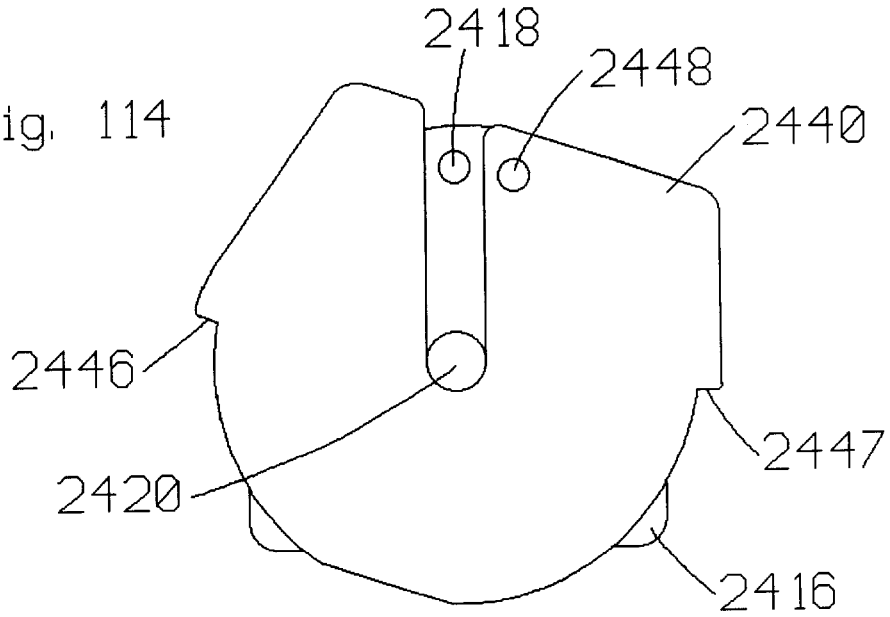
FIG. 114 is an end view of one of the weight plates of FIG. 112 in front of a spacer on the handle assembly of FIG. 112.
Figure 115:
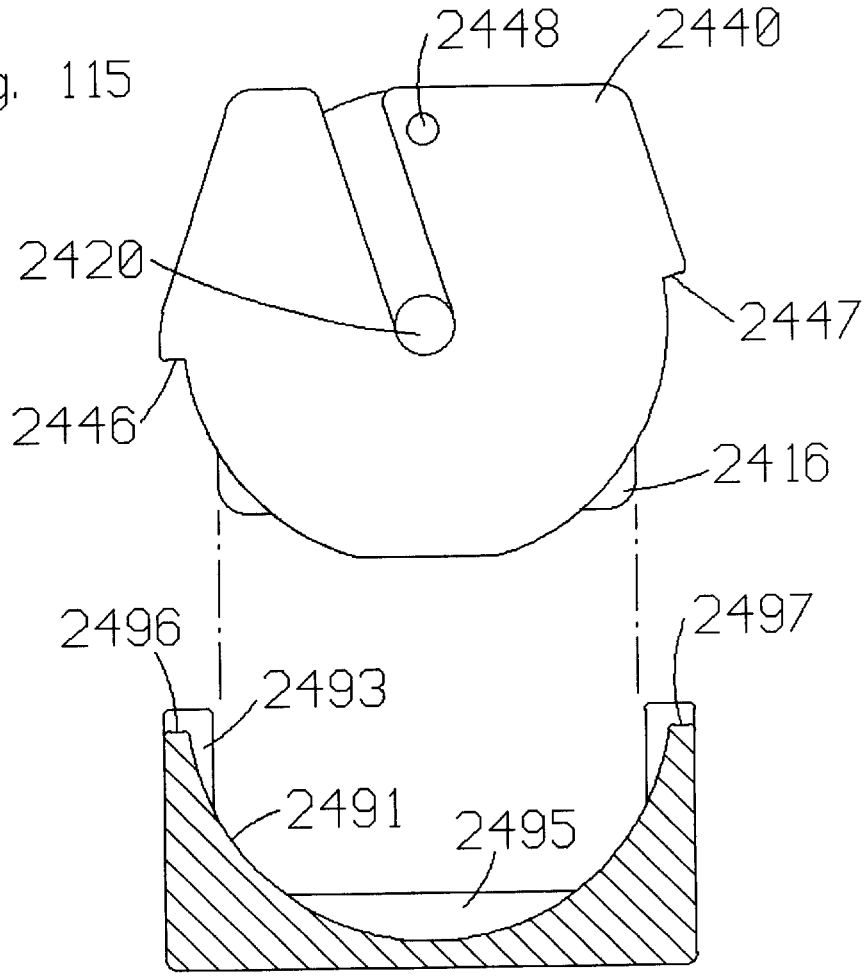
FIG. 115 is an end view of the weight plate of FIG. 114 in a different orientation relative to the spacer of FIG. 114, and aligned with the weight plate holder of FIG. 112.

As shown in FIG. 114, when the shoulder 2447 on the weight plate 2440 is rotated against the ledge 2497 on the cradle 2490, the slot 2449 extends vertically upward and facilitates upward and downward movement of the handle 2420 relative to the plate 2440. As shown in FIG. 115, when the shoulder 2446 on the weight plate 2440 is rotated against the ledge 2496 on the cradle 2490, the hole 2448 in the plate 2440 aligns with the hole 2418 in the spacer 2416 and facilitates engagement of the plate 2440 by the selector rod 2480. Upon insertion of the selector rod 2480 and upward movement of the handle 2420, the plate 2440 is withdrawn from the cradle 2490 and movable together with the handle 2420 for exercise purposes.

Among other things, the subject invention may be described, for example, in terms of an adjustable exercise weight system, comprising: a base which includes a handle and weight supports at opposite ends of the handle; weights sized and configured to interact with the weight supports in complementary fashion; and a selector rod which is movable relative to the handle and into engagement with any of the weights which are moved to a ready position relative to the base, without engaging any of the weights which occupy a rest position relative to the base. The weights may be selected in any combination and/or the selector rod may be configured to simultaneously engage weights on both ends of the handle.

The present invention may also be described in terms of various methods of adjusting resistance to exercise, based upon one or more of the embodiments disclosed herein. For example, one such method involves providing a handle assembly with a movable selector rod; maintaining weight plates in spaced relationship relative to the handle assembly; moving the selector rod out of a weight engagement position; effecting an alignment change between the selector rod and the weight plates; and moving the selector rod back into the weight engagement position to engage a desired number of the weight plates, as determined by alignment of the selector rod relative to the weight plates. Recognizing that the weights plates are provided at each end of the handle assembly, the method may provide a selector rod at each end of the handle assembly. Under such circumstances, a user is not required to engage the same number or combination of weight plates at each end of the handle assembly, and the independent selection at each end of the handle assembly facilitates adjustments by one-half as much weight, but sacrifices balance in the process.

The present invention may be also be said to provide a method of adjusting resistance to exercise, comprising the steps of providing a handle assembly with a longitudinal axis and a movable selector rod; providing multiple weight plates in axially spaced relationship relative to the handle assembly; and without interrupting the axially spaced relationship between the weight plates and the handle assembly, changing the relative spatial relationship between the selector rod and the weight plates to latch any combination of the weight plates to the handle assembly.

The present invention may also be said to provide a method of adjusting resistance to exercise, comprising the steps of providing a handle assembly with a movable selector rod; providing a first weight next to the handle assembly; providing a second weight next to the first weight; selectively maneuvering the selector rod to secure only the first weight to the handle assembly; and selectively maneuvering the selector rod to secure only the second weight to the handle assembly.

The present invention may also be described in terms of providing a base sized and configured to support a plurality of weights in either of two positions; providing a handle assembly with a handle bar and a movable latch; selectively moving a desired number of the weights to an "engageable" position relative to the base; and moving the latch into engagement with the weights occupying the "engageable" position. In the alternative, the weights may remain stationary, and the selector rod may be moved to engage a different number of weights. In any of these methods, a further step may involve providing a biasing force and/or a structural interconnection which encourages the latch and the weights to remain interengaged.

Figure 22:
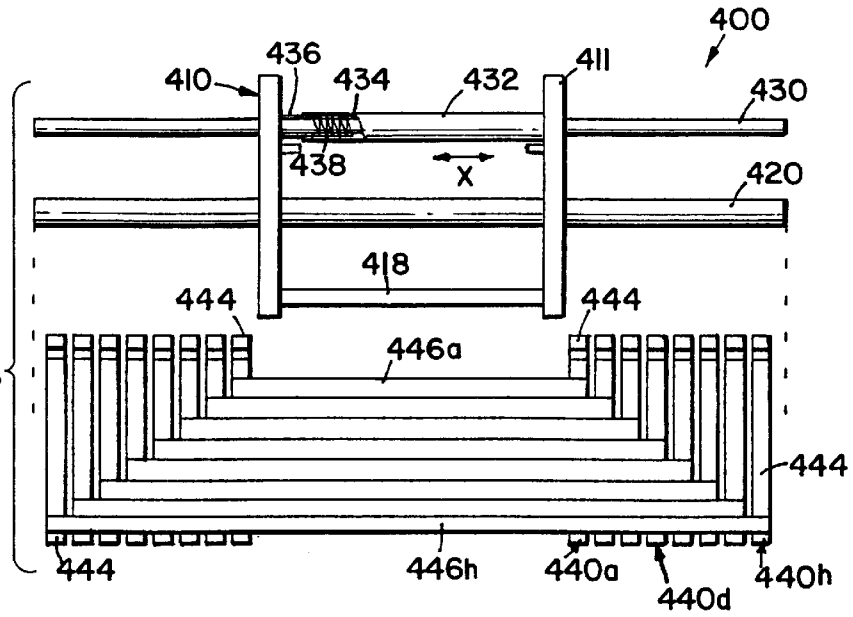
FIG. 22 is a front view of a fourth exercise dumbbell constructed according to the principles of the present invention, shown in an operative configuration with no discretionary weights connected to the handle assembly.
Figure 24:
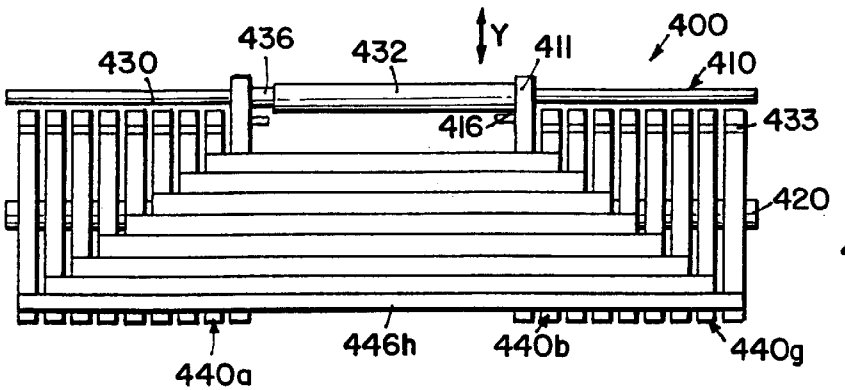
FIG. 24 is a front view of the dumbbell of FIG. 22, shown in a first selective configuration.
Figure 29:
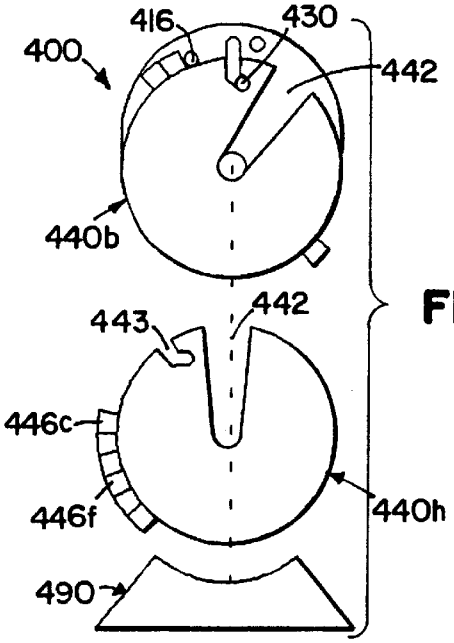
FIG. 29 is an end view of the dumbbell of FIG. 28, shown relative to the underlying base first shown in FIG. 23.
Figure 26:
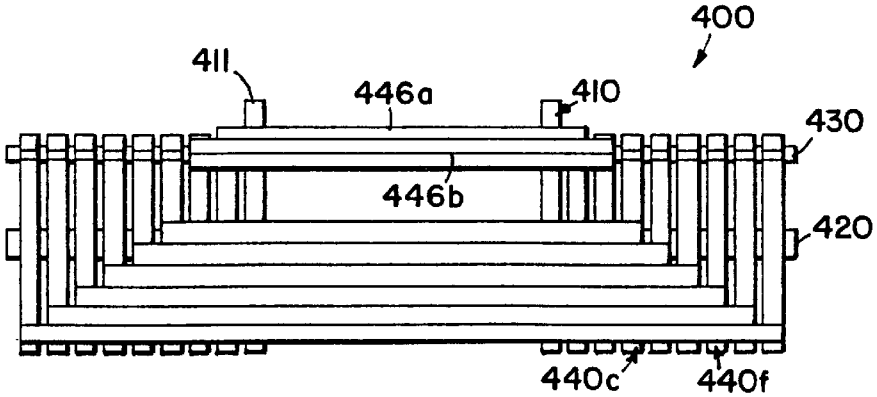
FIG. 26 is a front view of the dumbbell of FIG. 25.
Figure 28:
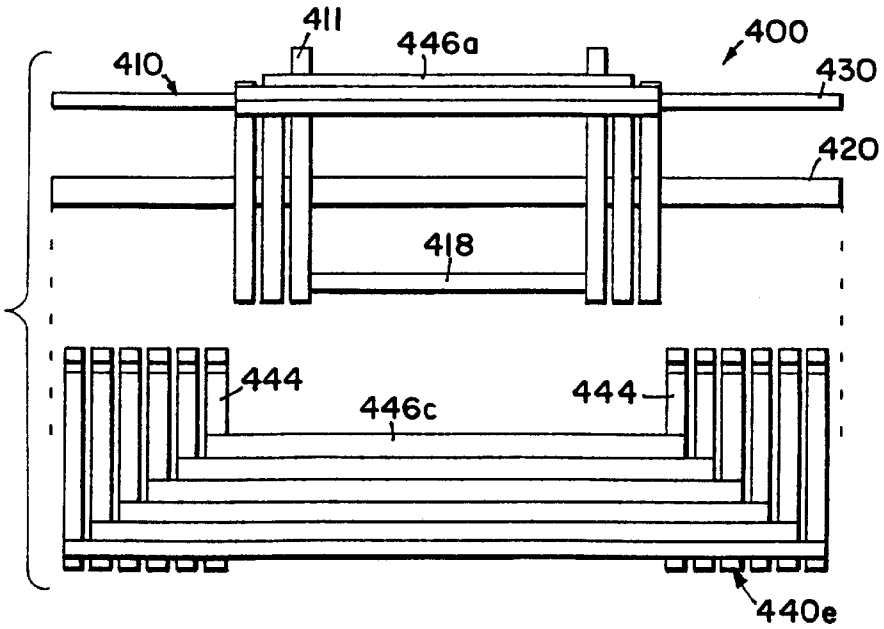
FIG. 28 is a front view of the dumbbell of FIG. 22, shown in an operative configuration with two discretionary weights connected to the handle assembly.

Various stages of many such methods are illustrated with reference to the dumbbell 400, for example. In FIGS. 22–23, the latch 430 occupies the closed position relative to the plates 411 and is locked in that position by the peg 439. In FIG. 24, the latch 430 is locked in the open position, and the weights 440*a*–440*h* are free to rotate relative to the handle assembly 410 and/or the base 490. In FIGS. 25–26, the first two weights 440*a*–440*b* are shown rotated toward the pegs 416 until their notches 443 align with the slots 413. In FIG. 27, the latch 430 again occupies the closed position and is locked in that position by the peg 439. In FIGS. 28–29, the handle assembly 410 and weights 440*a*–440*b* are moved away from the base 490 and the remaining "unselected" weights 440*c*–440*h*.

With reference to the dumbbell 400, further method steps may include, for example, maintaining each of the plates 444 a fixed distance from the handle assembly 410 and/or adjacent plates 411 and 444. In this regard, spacers may be provided on the handle assembly 410 and/or on the plates 444 themselves. Methods and/or method steps may also be described with reference to additional and/or other embodiments disclosed herein. For example, the present invention discloses a method of providing adjustable resistance to exercise involving the steps of disposing weights on opposite sides of a handle; supporting a desired number of weights against movement in a first direction relative to the handle; and applying a biasing force in a second, orthogonal direction to maintain the support for the weights.

Yet another variation is to arrange a plurality of loose weight plates in a row; move the desired number of plates upward relative to the remainder so that holes through the displaced plates align with holes in plates on a handle assembly; and insert a rod through the aligned holes to connect the displaced plates to the handle assembly. Moreover, clips may be used to connect multiple weight plates or weight housings to build weight modules which, in turn, may be selectively connected to a handle assembly or within compartments on a handle assembly.

Figure 116:
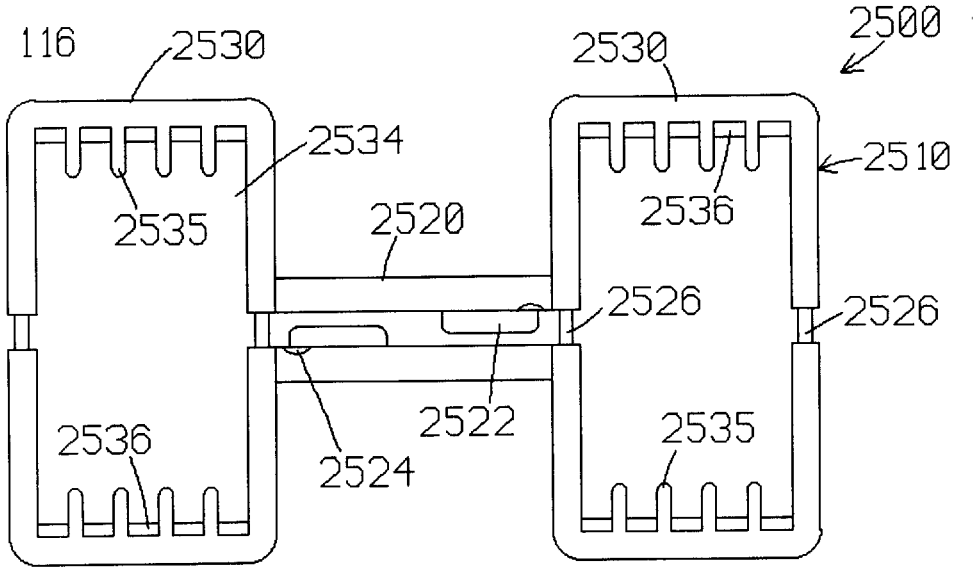
FIG. 116 is a top view of another dumbbell constructed according to the principles of the present invention.
Figure 117:
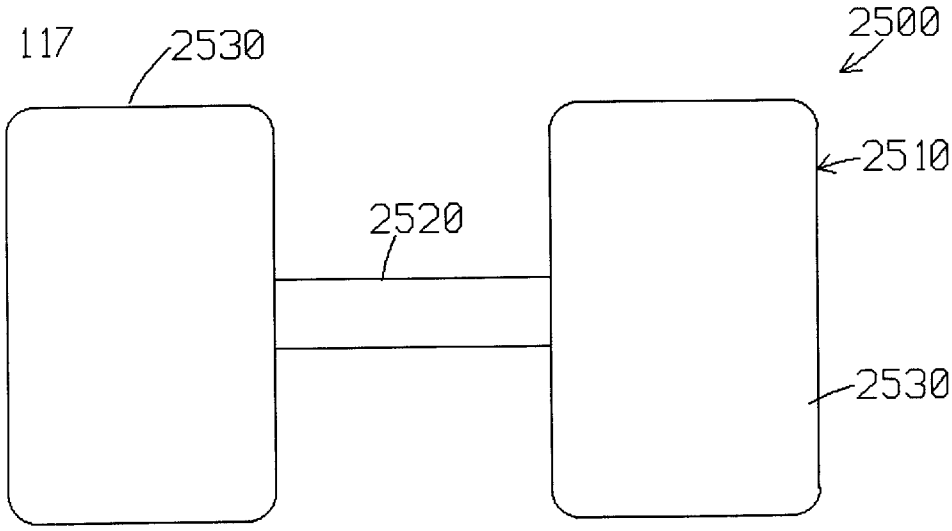
FIG. 117 is a side view of the dumbbell of FIG. 116.
Figure 118:
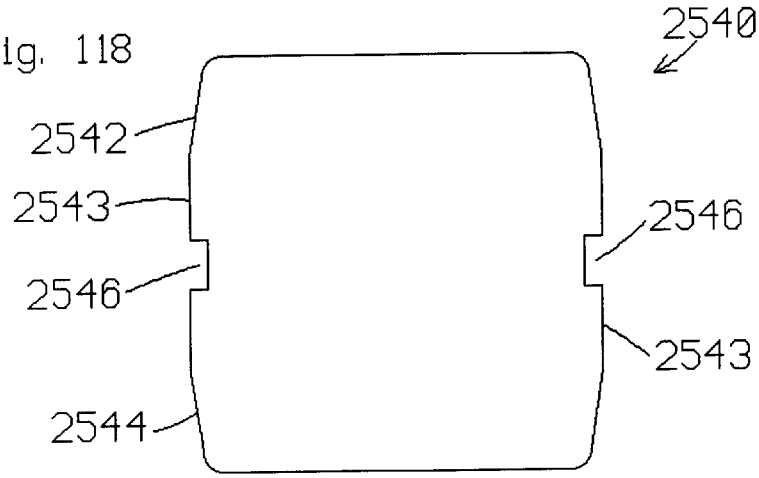
FIG. 118 is an end view of a weight plate suitable for use with the dumbbell of FIG. 116.

FIGS. 116–118 show still another dumbbell 2500 constructed according to the principles of the present invention. The dumbbell 2500 is made from two identical halves that telescope relative to one another and cooperate to define a base 2510. In this regard, first and second posts 2526 are secured to one of the halves and slidable relative to the other half. Stops may be provided to prevent complete separation of the two halves. Each half includes a handle portion 2520 and U-shaped shells 2530 connected to opposite ends of the handle portion 2520. An alignment tab 2522 extends outward from each handle portion 2520 and toward a receiving slot in the opposite handle portion 2520. Also, a depression 2524 is formed in each handle portion 2520 to facilitate separation of the two halves from one another.

Each shell 2530 includes opposite end walls and an intermediate side wall which cooperate with their respective counterparts to define an open-ended weight compartment 2534. A ridge 2536 extends along each side wall, parallel to the handle 2520. Also, axially spaced dividers 2535 project outward from each side wall, transverse to the handle 2520. Each of the dividers 2535 is wider and deeper than the ridges 2536.

When the halves of the base 2510 are separated as shown in FIG. 116, a desired number of weight plates 2540 may be inserted into the compartments 2534. The dividers 2535 are equally spaced on this embodiment 2500 but in the alternative, they could be arranged to accommodate weight plates of more than one thickness. A representative weight plate 2540 is shown in FIG. 118. The weight plate 2540 may be described as a generally square plate-having horizontal top and bottom edges, vertical intermediate side edges 2543, and tapered upper and lower side edges 2542 and 2544. Rectangular notches 2546 are formed in the intermediate side edges 2543 equidistance from the top and bottom edges. The notches 2546 are sized and configured to receive respective ridges 2536 on the base 2510 when the two halves of the base 2510 are brought together. The user's grasp on the handle 2520 prevents the base 2510 from separating and thereby retains the weights 2540 within the compartments 2534. In addition, tension springs may act upon the posts 2526 to urge the two halves of the base 2510 toward one another.

The subject invention may also be described, for example, in terms of an adjustable exercise weight system, comprising: a base having a handle and weight supports at opposite ends of the handle, wherein the weight supports define weight receiving gaps therebetween; and weights sized and configured to insert between the weight supports when the weight supports define relatively wider gaps therebetween, as measured transverse to the handle, and to remain captured between the weight supports when the weights supports define relatively narrower gaps therebetween.

Figure 119:
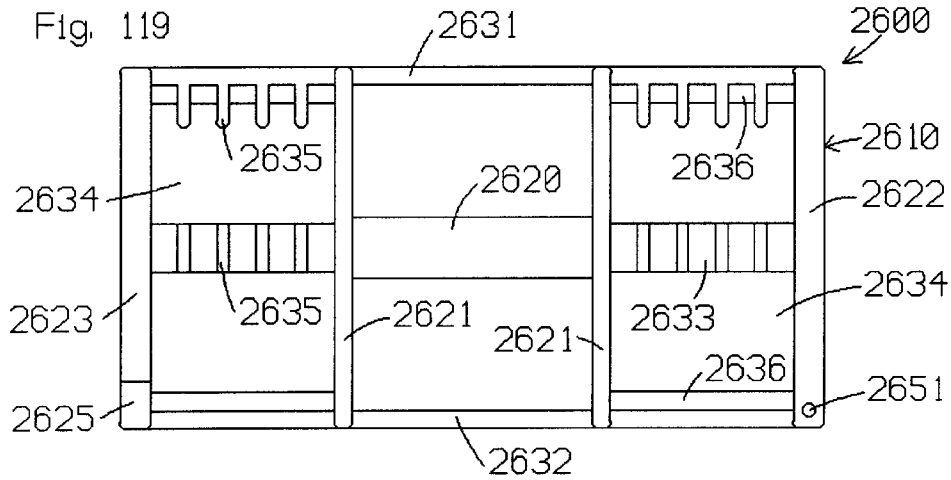
Figure 120:
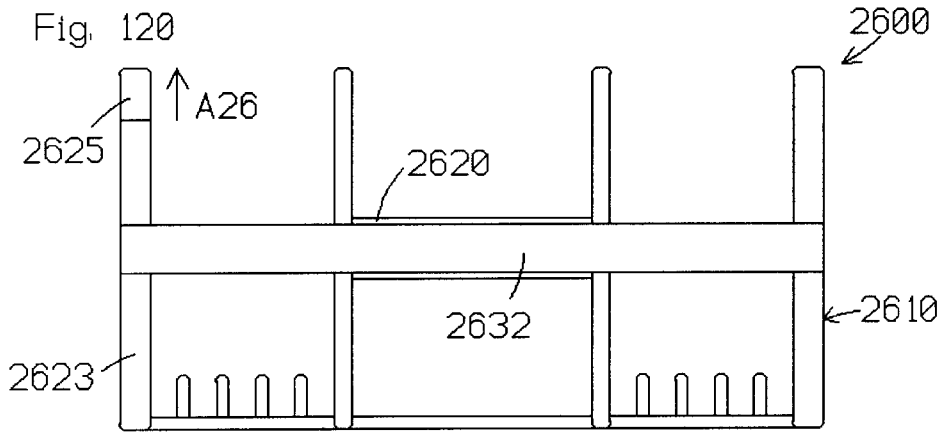
Figure 121:
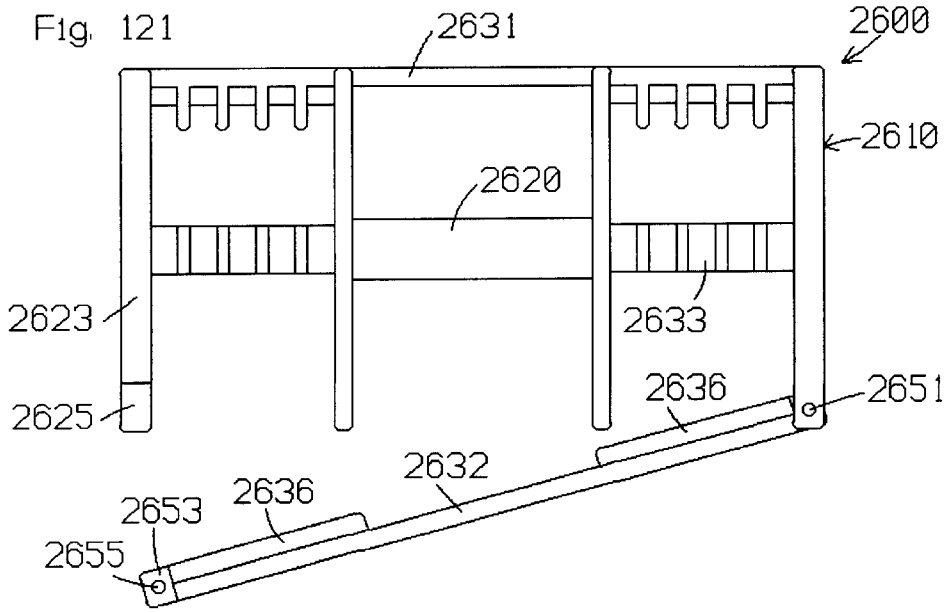

FIGS. 119–121 show a dumbbell 2600 which is similar in some respects to the dumbbell 2500. The dumbbell 2600 includes a handle 2620 and weight receiving compartments 2634 disposed at opposite ends of the handle 2620. An inside wall 2621 is rigidly secured to each end of the handle 2620. A bottom support 2633 is rigidly secured between the inside walls 2621 and projects across the bottom ends of the compartments 2634. Outside walls 2622 and 2623 are rigidly secured to respective ends of the bottom support 2633. A first side support 2631 is similarly secured between the inside walls 2621 and the outside walls 2622 and 2623. A ridge 2636 extends along the first side support 2631, parallel to the handle 2620.

Axially spaced dividers 2635 project outward from both the first side support 2631 and the bottom support 2633, in a direction transverse to the handle 2620. The dividers 2635 on the bottom support 2633 are aligned with the dividers 2635 on the first side support 2631, and each of the dividers 2635 is wider and deeper than the ridge 2636.

An opposite, second side support 2632 has a first end which is pivotally connected to the outside wall 2622 by means of a bolt 2651 or other suitable fastener. A hole 2655 extends through an opposite, second end 2653 of the second side support 2632 to receive a pin (not shown) on the outside wall 2623. The pin is secured to a spring-biased block 2625 which is slidable upward from its position shown in FIG. 120, against a spring bias, to release the second side support 2632. A similar ridge 2636 extends along the second side support 2632, parallel to the handle 2620.

When the second side support 2632 is pivoted away from the remainder of the base 2610 as shown in FIG. 121, a desired number of weight plates (such as the plates 2540, for example) may be inserted into the compartments 2634. The dividers 2635 are equally spaced on this embodiment 2600 but in the alternative, they could be arranged to accommodate weight plates of more than one thickness. Subsequent to upward movement of the pin and block 2625 (in the direction of arrow A26), the second side support 2632 is pivoted into the position shown in FIG. 119 and secured in place by releasing the spring-biased pin and block 2625. The opposing ridges 2636 cooperate with the notches 2546 in the weight plates 2540 to retain the plates 2540 within the compartments 2634.

The present invention has been described with reference to specific embodiments and particular applications. However, this disclosure will enable those skilled in the art to derive additional embodiments and/or applications. Moreover, features of the various methods and/or embodiments may be mixed and matched in numerous ways to arrive at additional variations of the present invention. Therefore, the scope of the present invention is to be limited only to the extent of the following claims.

What is claimed is:

1. A method of adjusting resistance to exercise, comprising the steps of:

providing a handle assembly with weight supports and with a handle which defines a longitudinal axis;

providing weights sized and configured to be supported by the weight supports; and providing a selector rod having first and second axially extending end portions sized and configured to engage respective weights disposed at opposite ends of the handle assembly, and an intermediate portion which is radially offset from the end portions.

2. The method of claim 1, further comprising the step of repositioning the selector rod and at least one of the weights relative to one another to change which weights are secured to the handle assembly.

3. The method of claim 1, further comprising the step of providing a base to support the weights in respective, axially spaced positions.

4. The method of claim 3, wherein the weights are configured and arranged for rotational movement within the base.

5. The method of claim 3, wherein the intermediate portion of the selector rod is configured and arranged to nest inside the handle.

6. The method of claim 3, wherein the handle and the selector rod are configured and arranged to be grasped together in a person's hand.

7. The method of claim 3, wherein the selector rod is configured and arranged so that a first radially measured distance is defined between the handle and the intermediate portion of the selector rod, and a second, relatively greater radially measured distance is defined between the handle and each of the end portions.

8. The method of claim 3, wherein the selector rod is movably mounted on the handle assembly for axial movement relative thereto.

9. The method of claim 8, further comprising the steps of moving the selector rod axially to a disengagement position relative to the weights, effecting a change in orientation between the selector rod and at least one of the weights, and moving the selector rod to an engagement position relative to the weights, thereby changing which weights are connected to the handle assembly.

10. The method of claim 9, wherein the weights are configured and arranged for rotational movement within the base, and desired weights are rotated relative to the base to effect the change in orientation between the selector rod and the weights.

11. The method of claim 3, wherein the selector rod is movably mounted on the handle assembly for radial movement relative thereto.

12. The method of claim 11, wherein the weights are provided with radially extending slots to accommodate movement of the selector rod radially into and out of engagement with the weights.

13. The method of claim 3, wherein the selector rod is movably mounted on the handle assembly for rotational movement relative thereto.

14. The method of claim 13, wherein each of the weights engaged by the selector rod is provided with an arcuate slot that is centered about a rotational axis defined by the selector rod.

15. The method of claim 13, wherein the selector rod is also movably mounted on the handle assembly for axial movement relative thereto.

16. The method of claim 1, further comprising the step of providing a base to support the weights in respective rest positions.

17. The method of claim 1, wherein the intermediate portion of the selector rod is configured and arranged Lo nest inside the handle.

18. The method of claim 1, wherein the selector rod is movably mounted on the handle assembly for axial movement relative thereto.

19. The method of claim 18, further comprising the steps of moving the selector rod axially to a disengagement position relative to the weights, effecting a change in orientation between the selector rod and at least one of the weights, and moving the selector rod to an engagement position relative to the weights, thereby changing which weights are connected to the handle assembly.

20. The method of claim 1, wherein the selector rod is movably mounted on the handle assembly for radial movement relative thereto.

21. The method of claim 1, wherein the selector rod is movably mounted on the handle assembly for rotational movement relative thereto.

22. The method of claim 1, wherein the selector rod is movably mounted on the handle assembly for both axial and rotational movement relative thereto.

23. A method of adjusting resistance to exercise, comprising the steps of:

providing a handle assembly with weight supports and with a handle which defines a longitudinal axis;

providing weights sized and configured to be supported by the weight supports; and providing a selector rod having a first portion which is movable axially and rotatable relative to the handle assembly, and a second portion which is sized and configured to engage the weights and movable along the first portion in a direction perpendicular to the axis.

24. The method of claim 23, wherein the first portion of the selector rod rotates about a rotational axis, and at least one of the weights is provided with holes disposed at two different radii from the rotational axis.

25. The method of claim 23, further comprising the step of providing a base to support the weights in respective, axially spaced positions.

26. The method of claim 23, wherein the first portion of the selector rod is configured and arranged to nest inside the handle.

27. An exercise dumbbell system, comprising:

a handle that defines a longitudinal axis;

weight supports mounted on opposite ends of the handle, wherein the weight supports and the handle cooperate to define a handle assembly;

weights sized and configured to be supported by respective weight supports; and a selecting means for selecting any combination of at least two said weights disposed at one end of the handle assembly, wherein the selecting means includes a rod which is sized arid configured to span the at least two said weights.

28. The exercise dumbbell system of claim 27, further comprising a base sized and configured to support the weights in respective, axially spaced positions.

29. The exercise dumbbell system of claim 28, wherein the weights are sized and configured for rotational movement within the base.

30. The exercise dumbbell system of claim 28, wherein the rod has first and second axially extending end portions which are sized and configured to engage respective weights at respective ends of the handle assembly, and an intermediate portion which is radially offset from the end portions.

31. The exercise dumbbell system of claim 30, wherein the intermediate portion of the rod is sized and configured to nest inside the handle.

32. The exercise dumbbell system of claim 30, wherein a first radially measured distance is defined between the longitudinal axis and the intermediate portion of the rod, and a second, relatively greater, radially measured distance is defined between the longitudinal and each of the end portions of the rod.

33. The exercise dumbbell system of claim 28, wherein the rod is movably mounted on the handle assembly for axial movement relative thereto.

34. The exercise dumbbell system of claim 33, wherein the rod is also movably mounted on the handle assembly for rotational movement relative thereto.

35. The exercise dumbbell system of claim 28, wherein the rod is movably mounted on the handle assembly for rotational movement relative thereto.

36. The exercise dumbbell system of claim 28, wherein the selecting means includes both a first rod that is configured and arranged to engage any combination of at least two weights disposed at one end of the handle assembly, and a second rod that is configured and arranged to engage any combination of at least two weights disposed at an opposite end of the handle assembly.

37. The exercise dumbbell system of claim 36, wherein the first rod and the second rod are integral portions of a single selector rod.

38. The exercise dumbbell system of claim 36, wherein each said rod is movable radially relative to the handle assembly.

39. The exercise dumbbell system of claim 36, further comprising a latching means for latching each said rod in a desired position relative to the handle assembly.

40. The exercise dumbbell system of claim 28, wherein the base has vertically oriented weight spacers that align with respective weight supports when the weights and the handle assembly are supported by the base.

* * * * *